United States Patent [19]

Aitken et al.

[11] Patent Number: 4,658,690

[45] Date of Patent: Apr. 21, 1987

[54] ELECTRONIC MUSICAL INSTRUMENT

[75] Inventors: William A. Aitken, Oxfordshire; Anthony J. Sedivy; Michael S. Dixon, both of London, all of England

[73] Assignee: Synthaxe Limited, London, England

[21] Appl. No.: 691,486

[22] PCT Filed: May 9, 1984

[86] PCT No.: PCT/GB84/00158

§ 371 Date: Jan. 8, 1985

§ 102(e) Date: Jan. 8, 1985

[87] PCT Pub. No.: WO84/04619

PCT Pub. Date: Nov. 22, 1984

[30] Foreign Application Priority Data

| | | | |
|---|---|---|---|
| May 10, 1983 | [GB] | United Kingdom | 83 12842 |
| Nov. 4, 1983 | [GB] | United Kingdom | 83 29585 |
| Feb. 17, 1984 | [GB] | United Kingdom | 84 04247 |
| Mar. 1, 1984 | [GB] | United Kingdom | 84 05436 |

[51] Int. Cl.[4] ..... G10D 1/08; G10D 3/00; G10H 3/12; G10H 3/14

[52] U.S. Cl. ..... 84/1.14; 84/1.16; 84/267; 84/DIG. 30

[58] Field of Search ..... 84/1.13, 1.14, 1.15, 84/1.16, 267, 291, 292, 293, 314 R, 314 N, 318, DIG. 3, DIG. 30; D17/14, 15, 18

[56] References Cited

U.S. PATENT DOCUMENTS

| | | | |
|---|---|---|---|
| D. 105,339 | 7/1937 | Mickus | 84/267 X |
| 3,465,086 | 9/1969 | Borell | 84/1.16 |
| 3,555,166 | 1/1971 | Gasser | 84/1.16 X |

(List continued on next page.)

FOREIGN PATENT DOCUMENTS

| | | |
|---|---|---|
| 1019175 | 10/1977 | Canada . |
| 1217186 | 5/1966 | Fed. Rep. of Germany . |
| 2078427 | 6/1980 | United Kingdom . |

OTHER PUBLICATIONS

*Sound International,* "Avator", Paddy Kingsland, Dec. 1978.

*Sound International,* Steve Hackett, "Roland G500", Dec. 1978.

Advertisement, "The Touch", (Guitar Picture Quality so Poor Nothing Can Be Seen).

*Guitar Player,* "Guitars of Tomorrow?", Tom Mulhern, pp. 58–60, Oct. 1982.

*Sound International,* "Oh, Atlanta . . .", Report of NAMM Trade Show, Jun. 9 to 12, Atlanta, Georgia, Sep. 1979.

Various Covers of "The Guitar Book".

*Primary Examiner*—William B. Perkey

*Attorney, Agent, or Firm*—Majestic, Gallagher, Parsons & Siebert

[57] ABSTRACT

A guitar-like electronic musical instrument for use with a synthesizer (18) has a body (20) and a neck (22). The neck carries six pitch strings (40) which the player depresses onto conductive frets to determine the selected note. The body carries six trigger strings (50) which can be plucked or strummed to initiate or trigger the desired notes. Alternatively they can be triggered by six keys (70). The trigger strings (50) and pitch strings (40) are at an angle to each other. The three lower strings and the three higher strings can be triggered together by group trigger keys (300,302) and all six strings triggered by a master trigger key (204). If either of switches (200,202) are actuated, notes will be triggered automatically as soon as the pitch string is depressed onto the fret. Touching of the string is detected by an a.c. waveform superposed on a d.c. potential. Hall effect devices are used to sense triggering by the trigger strings (50) or keys (70). Each fret has eleven conductive sections so that sideways bending can be detected, and bend detection coils are embedded in the finger board for the same purpose. A vibrato arm (210) using a Hall effect device can be used to introduce a vibrato effect. A console (32) enables resetting of the note of each string, storing various set values for each string, transposition of the instrument as a whole and a 'Capo' effect to be obtained. A pedal unit (30) allows some functions to be selectively operated during playing, such as variation in the decay rate, or sustaining of notes played while a hold pedal is depressed.

23 Claims, 58 Drawing Figures

U.S. PATENT DOCUMENTS

| | | | |
|---|---|---|---|
| 3,691,285 | 9/1972 | Larrison | 84/293 X |
| 3,742,114 | 6/1973 | Barkan | 84/1.16 |
| 3,786,167 | 1/1974 | Borell et al. | 84/1.16 |
| 3,813,473 | 5/1974 | Terymenko | 84/1.16 |
| 3,871,247 | 3/1975 | Bonham | 84/1.16 |
| 3,902,395 | 9/1975 | Avant | 84/1.16 |
| 4,038,897 | 8/1977 | Murray et al. | 84/1.16 |
| 4,078,464 | 3/1978 | Sugiyama | 84/1.01 |
| 4,177,705 | 12/1979 | Evangelista | 84/1.16 |
| 4,182,213 | 1/1980 | Iodice | 84/1.16 X |
| 4,306,480 | 12/1981 | Eventoff et al. | 84/1.16 X |
| 4,321,852 | 3/1982 | Young, Jr. | 84/1.16 |
| 4,336,734 | 6/1982 | Polson | 84/1.16 X |
| 4,339,979 | 7/1982 | Norman | 84/DIG. 30 X |
| 4,348,930 | 9/1982 | Chobanian et al. | 84/1.16 X |
| 4,372,187 | 2/1983 | Berg | 84/1.16 |
| 4,468,997 | 9/1984 | Young, Jr. | 84/1.16 X |

STEP (2) CAPO UPDATE ROUTINE

STEP 6 UPDATE PITCH
(PRE INITIATE TRIGGER)

STEP (7) INITIATE TRIGGER

STEP (8) MANUAL TRIGGER HOLD

STEP (11) AUTOMATIC TRIGGER HOLD?

STEP (12) HOLD PITCH
(PRE HOLD TRIGGER)

STEP (13) PITCH HOLD DURING RELEASE?

STEP (14) UPDATE PITCH
(PRE TRIGGER RELEASE)

STEP (15) HOLD PITCH
(PRE RELEASE TRIGGER)

STEP (16) RELEASE TRIGGER

ELECTRONIC MUSICAL INSTRUMENT

BACKGROUND OF THE INVENTION

This invention relates to electronic music making and in particular to electronic musical instruments.

DESCRIPTION OF THE PRIOR ART

The prior art can principally be divided into two groups, namely electric fingerboard stringed instruments, and synthesisers. The expression 'fingerboard stringed instruments' is here used to denote instruments in which the strings are struck, plucked or bowed without the use of a keyboard, and the note played is determined by shortening the effective length of the string by the amount necessary to cause it to vibrate at the desired pitch. It is first desirable to consider such fingerboard stringed instruments generally.

1. Stringed Instruments

There are many forms of "guitar-like" or plucked, stringed instruments, from the Oriental Koto and the Indian Sitar, to the American Banjo and the Spanish Guitar. Although there are marked differences in the sizes, materials used, forms of construction and numbers of strings employed on these instruments, one common feature of the guitar family of stringed instruments is that the musician can produce a variety of notes on each string by altering that effective length of the string. This is done by pressing the string down on the face of the neck of the instrument (this face is called the fretboard on a guitar).

This feature makes this family of stringed instruments stand apart from those of the keyboard family (piano, harpsichord, clavichord etc), in which each note produced has its own individual key on the keyboard with its own individual string.

The violin family (including the viola, cello and string bass), has a similar pitch control arrangement to the guitar family in that each string produces a variety of pitches according to the length of the string, but the dynamic performance of a note is usually started and sustained by bowing the string.

In contrast, the guitar family of instruments is dynamically triggered by plucking the string. This may be done with the bare fingers, or it may be done with individual finger picks, or a plectrum or quill. In each case the result is similar. The string is displaced from its state of equilibrium by the plucking device prior to the start of the note, and the string is released at the moment the note is required to start. The string will then vibrate, producing a musical note. The amplitude of the note that the string produces now goes through a dynamic cycle of 'Attack' and 'Decay' which will depend on the extent to which the string was originally displaced, and also on the inherent acoustic characteristics of the particular instrument.

Unlike a violin, the duration that the note remains audible or "sustains" is dependent on these last two factors, whereas a violin note can be sustained for as long as the player chooses by bowing the string.

The natural decay of the plucked string of a guitar can be brought to a premature end by damping the vibrating string with the hand. This can effectively make the note "switch off" if the musician desires.

This fact limits the playing style of the guitar player. An open string, that is a string which is free-standing in its natural state of mechanical equilibrium—i.e. it has not had its musical note value modified by the musician's finger "stopping" it on the fretboard and thereby shortening its effective length, may be plucked, and will continue on its natural attack and decay cycle in a free standing state, regardless of the behaviour of the guitar player's hands, so long as he does not interrupt this cycle by damping the vibrating open string.

However, when a guitar player modifies the note produced by the string by holding it down on the fretboard and shortening the effective string length, he can start the dynamic cycle by plucking it, but he has to keep the string pressed down on the fretboard with his finger in order to maintain the natural attack and decay cycle of that string. If he does take his finger off the string, the note will prematurely switch off, or damp.

The surface of the neck of a guitar is divided by lateral wires, or frets, set perpendicular to the strings. This divides the physical length of each string into exact and successive semitone values. As the player runs the string up the fretboard with his finger, the pitch produced by the string will rise in ascending chromatic intervals as the length of the string shortens by succeeding ratios of 1:12th root of 2.

2. Electric Stringed Instruments

Electric instruments (such as electric guitars, violins, basses, or mandolins) generate analogue audio frequency voltages which are modified and reproduced via a special amplifier. (There are some hybrid devices which produce sounds in both an electronic and a non electronic fashion simultaneously. Such instruments are usually known as semi-acoustic instruments.)

The strings of these electric instruments are made of magnetic material, and vibrate when excited in the same way as a non-electric instrument. Mounted underneath the strings is a pick-up in the form of an electro-magnetic coil. As the strings vibrate above the coil, they vary the magnetic flux density of the field around the coil, inducing an alternating current in the coil related to the vibrations of the strings. The varying voltage from the output of the coil is fed to an amplifier and then to a loudspeaker to produce the sound.

Electric instruments use the same method of pitch control and dynamic triggering/attack and decay as their non-electric counterparts. The design of the electric versions of instruments, particularly their necks, share the same mechanical and acoustic constraints as non-electric instruments.

3. Synthesisers

The musical instruments which are commonly known as synthesisers (or 'synths') originated with the advent of the Voltage Controlled Oscillator (VCO). In early analogue versions, the pitch and the dynamic parameters of a musical instrument are controlled by two completely different elements.

The Voltage Controlled Oscillator generates the preset pitch of the musical note to be produced. This is controlled by feeding an analogue voltage to the VCO control input related to the pitch desired at the VCO output. The dynamic performance of the musical note is controlled by following the output of the VCO with a Voltage Controlled Amplifier (VCA). By triggering the control input of the VCA with a voltage which goes through a cycle of rise time and fall time ('Attack' and 'Decay'), the dynamic performance of the note heard (or envelope shape) can be modified by altering the attack and decay characteristics of the control input "trigger" signal to the VCA. Countless variations in signal processing can produce a wide range of subtleties in shaping the sounds produced, but all early analogue synths use this basic control system.

From the beginning such synthesisers or electronic organs have adopted a piano-style keyboard which is familiar to a large number of musicians and is a convenient way of inputting information as to the note(s) desired to be played. Each key on an early synth keyboard produces a unique analogue voltage to be fed to the VCO control input. This control voltage is related to the pitch to be produced by the VCO when each particular key is pressed.

When a key is pressed, the specially shaped control voltage signal is "triggered" at the corresponding VCA input, producing the dynamic attack and decay of the note (or envelope shape).

Subsequent synthesisers have made use of unique digital codes rather than analogue voltages for each key of the keyboard. In this form, the basic pitch information can easily be manipulated like data in a computer, and when the code has been through all the desired processing, it is converted by a digital-to-analogue converter (DAC) into the correct analogue voltage to set the pitch of the associated VCO.

Some of these later synthesisers also employ keyboards which produce not only the dynamic trigger signals, but also velocity and pressure sensing circuits which produce signals proportional to how fast a player hits the keys, and with how much pressure he holds the keys down. These signals can be used via processing circuitry, to modify a variety of parameters, including the loudness of the notes and the harmonic content of the notes. This makes the instrument far more musically expressive.

The latest generation of synthesisers are basically computers with special software which makes them into musical instruments. The waveform, rather than being split into pitch and envelope shape parameters with VCO's and VCA's, is defined very accurately in digital form, and stored in memory as wavetables or families of wavetables. The structure of the digital waveforms can be defined in a variety of ways according to the design of the software. Control parameters can be put in from a keyboard, waveforms or time dependent spectral information can be drawn with a light pen on a video terminal, and natural sounds can be sampled via a microphone and a DAC to form a particular wavetable. Once initially defined in memory, the original signal may be further modified according to the desires of the musician, and the inventiveness of the software designer.

These instruments are musically controlled in real-time, again with the use of a piano-style keyboard, which produces the digital pitch control codes, trigger signals, and sometimes velocity and pressure sensing.

To date, only synthesisers which are controlled by a piano-style keyboard have had any significant success as real-time musical instruments.

4. Guitar Synthesisers

Then there a number of devices called guitar synthesisers which incorporate features of an electric stringed instrument and of a synthesiser. These devices are basically electric guitars which use additional Pitch-to-Voltage Convertors which analyse the frequency and amplitude of the electro-magnetic oscillations in the pick-up coil, and attempt to convert them into accurate control signals to drive the pitch and trigger parameters of a synthesiser.

The most difficult problem associated with such a system is the harmonic content of the original signal in the guitar pick-up. Very often the harmonic content is high enough to make the pitch-to-voltage convertor prone to error, producing some very unpredicatable results. Also, the guitar player very often wishes to play chords, rather than monophonic melodies, and this adds crosstalk problems to a guitar-synth system which is capable of polyphony. In fact most guitar synths are only monophonic. Furthermore, the triggering system is very basic; when the amplitude of the coil signal exceeds a preset threshold, the envelope shape cycle is triggered, and as long as the amplitude remains above that threshold, the note can be held. It is usually very difficult to predict how long the synth note (as opposed to the natural guitar note) will be held, and the dynamic level of the synth note is simply switched on or off at a fixed level, depending on whether the natural guitar note level is above or below a predefined threshold. The guitar synth to date does not offer velocity or pressure parameters with which to make the control of the synth more expressive. It is usually very difficult to predict the dynamic performance of such a system.

For all of these reasons, the guitar synthesiser has never been really successful.

Further examples of guitar synthesisers are described in various articles in *Sound International,* in particular:

November 1980 (Electro-Harmonix, article by Robin Millar),,

December 1978 (Roland G500, by Steve Hackett; ARP Avatar, by Paddy Kingsland),

December 1979 (Fairlight CMI, by David Crombie),

May 1980 (general article "So you Want to Buy a Synth . . . ", by David Crombie), and also in *The Guitar Book* by Tom Wheeler, see the chapter on Guitar Synthesisers at pages 289–292.

5. Other forms of Synthesiser Control

Some isolated attempts to operate a synthesiser from other input devices have been made:

(a) *The Lyricon*—see *Sound International* May 1979, article by John Walters, and also May 1978 page 23. The Lyricon looks like a wind instrument and has a reed as well as keys which operate electric switches rather than controlling the note produced by the reed. The dynamic performance (attack, decay, sustain and release) is achieved by analysing the pressure produced by blowing the mouthpiece, and deriving the appropriate control voltages. Filter effects, and sliding effects (glissandi) can also be derived from the mouthpiece transducer system.

(b) *The Touch*—manufactured by Oncor Sound Inc, 471 W. 5th South, Salt Lake City, Utah 84101, United States of America, see also *Sound International* September 1979 (News item), and UK Patent Application No. 2078427. This instrument looks at first glance like a guitar, but has no strings over the fingerboard section of the instrument. Instead the fingerboard has embedded in it 96 touch-sensitive capacitative sensors corresponding to 16 finger positions for the 6 strings. The fingers of the left hand (conventionally) thus select the note or chord to be sounded. The right hand strikes an array of short strum bars which occupy the position normally occupied by the lower section of a guitar. The strum bars are used to trigger the notes selected by the left hand.

We have found that in actual fact this instrument proves to be difficult to play, because the strings which normally guide the player to the correct place on the fretboard are missing. Furthermore the number of notes which can be played is limited by the area required for each capacitative sensor.

The instrument is monophonic, and is relatively inflexible in that it can not produce many of the effects to which a guitar player is accustomed.

(c) *The Music Room*—described in *Guitar Player,* October 1982, pages 58, 60 and 62. This instrument again has touch-sensitive panels on the fretboard, though in this case there are 31 panels each extending across the full width of the neck of the instrument. The positions of the touch-sensitive panels on the neck no longer retain the precise distance relation required in a normal guitar. Triggering of the notes is by means of further touch-sensitive panels on the body of the instrument which correspond to respective 'strings' of the conventional guitar. Chord playing is not analogous to a conventional guitar. Again, the instrument is monophonic and relatively inflexible.

(d) *The Kaleidophon*—see *Sound International* September 1980, article by Sue Steward. This has four strings each of tape about ⅛th inch (3 mm) wide, laid over a long thin conductive surface mounted on the wooden neck. The tape is pressed down onto the neck to play a note and the position at which contact is made is detected by determining the resultant resistance. This is inherently prone to inaccuracies. Note triggering is quite different from a conventional guitar and the instrument is also incapable of producing other effects familiar to the guitar player.

(e) U.S. Pat. No. 4,372,187 In this arrangement, the usual guitar strings are split into two parts, with part of each string extending the length of the neck and part being on the body of the instrument where it can be plucked. The neck strings make electrical contact with conductive frets, and the body strings initiate triggering of the notes determined by the neck strings.

(f) U.S. Pat. No. 3,555,166 This patent describes an instrument which on the neck has a first array of switches and on the body a second array of switches. The second array contains six individual switches which trigger the notes produced, and on the neck there are sufficient rows of six smaller switches to cover the different notes to be played. However this instrument is not attractive for the musician to play in view of the number of switches on the neck which have an unusual feel.

SUMMARY OF THE INVENTION

The invention has various aspects which are defined in the appended claims, to which reference should be made.

A preferred embodiment of the invention takes the form of a guitar-like electronic musical instrument for use with a synthesiser having a body and a neck. The neck carries six pitch strings, which the player depresses onto conductive frets to determine the selected note. The body carries six trigger strings which can be plucked or strummed to initiate or trigger the desired notes. Alternatively they can be triggered by six keys. The trigger strings and pitch strings are at an angle to each other. The three lower strings and the three higher strings can be triggered together by group trigger keys and all six strings triggered by a master trigger key. If an appropriate switch is actuated, notes will be triggered automatically as soon as the pitch string is depressed onto the fret. Touching of the string is detected by an d.c. waveform superposed on a d.c. potential. Hall effect devices are used to sense triggering by the trigger strings or keys. Each fret has eleven conductive sections so that sideways bending can be detected, and bend detection coils are embedded in the fingerboard for the same purpose. A vibrato arm using a Hall effect device can be used to introduce a vibrato effect. A console enables resetting of the notes of each string, storing various set values for each string, transposition of the instrument as a whole, and a 'Capo' effect to be obtained. A pedal unit allows some functions to be selectively operated during playing, such as variation in the decay rate, or sustaining of notes played while a hold pedal is depressed.

BRIEF DESCRIPTION OF THE DRAWINGS

The preferred embodiment will be described in more detail, by way of example, with reference to the drawings, in which.

DETAILED DESCRIPTION OF A PREFERRED EMBODIMENT OF THE INVENTION

Figure 1:
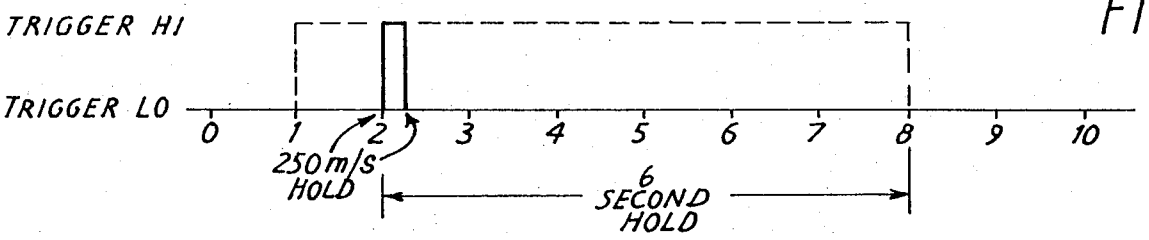
FIG. 1 is a representation of a trigger signal pulse.

The preferred embodiment of the invention which will now be described is called the SYNTHAXE (trade mark) electric musical instrument and has a considerable number of features of interest and inventiveness relative to the prior proposals described above.

The instrument comprises a network of transducers which are co-ordinated and controlled by microprocessor technology and which have tactile, operational and physical similarities to the family of "guitar-like" or stringed and plucked musical instruments. The SYNTHAXE instrument also has some tactile and physical similarities to the violin family of stringed instruments. Although the SYNTHAXE instrument as described below is configured in physical appearance and tactile feedback to mimic a guitar more than a violin, some of the transducers described may be rearranged in a variety of ways to make them feel more like one type of instrument than another. These rearrangements are usually no more than those of size and shape. The SYNTHAXE instrument produces electronic digital codes, rather than the more conventional forms of musical signal, such as acoustic vibrations in the case of natural or non-electric guitars, etc, or electro-magnetically induced analogue voltages in the case of electric guitars, etc. These digital codes are used to control the pitch and triggering characteristics of a synthesiser via transcoding software and digital-to-analogue conversion (if necessary) or via transcoding software and digital data links.

The SYNTHAXE instrument therefore allows a player who possesses the musical skills of a guitar player or a violin player (or player of similar instruments belonging to those families) to have the kind of control over a synthesiser which has previously only been available to a musician who is familiar with the techniques of playing piano-style keyboard instruments.

Although the version of the instrument described below has been made to appeal primarily to guitar players, there are many violin-style features which can be easily assimilated by the guitar player, and which can, because of the flexibility afforded by the design, be presented to the player in switchable modes.

Furthermore the SYNTHAXE instrument, in some of its operating modes, allows the performer to apply accurately to the synthesiser musical techniques, methods and control which have, up to now, only been feasible on the guitar or violin families of stringed instruments, and which are impossible on a piano-style keyboard controlled instrument.

In addition, the SYNTHAXE instrument in the embodiment described below brings new musical techniques, methods and control, compatible with the established musical, physical and psychological traditions of the guitar and violin families of stringed instruments, but which have up to now been impossible, owing to the mechanical and acoustic limitations of the traditional instruments.

The SYNTHAXE instrument thus gives a wider, more accurate and more predictable degree of musical control over a synthesiser to players familiar with the techniques of the guitar and violin families of musical instruments.

Attack and Decay Cycle

Before describing the preferred embodiment of the invention, the typical form of attack and decay cycle for a note struck on a synthesiser keyboard imitating a stringed instrument will first be described, together with the triggering operation.

When a key is depressed on a piano-style keyboard controller, a trigger signal is produced which initiates the dynamic control routine as pre-programmed on the synthesiser. The trigger control line is LO (low) when a key is not pressed, and HI (high) when a key is depressed. FIG. 1 is a representation of the trigger signal as the key is pressed down for 250 mS. The trigger circuit of the synthesiser detects the rising edge of the trigger signal at 2 seconds, and initiates the sound producing routine as dictated by the type of synthesiser.

The performance of an analogue synthesiser envelope shaper (dynamic control circuit) is pre-set. It consists of a VCA the amplitude of which may respond to up to four separate control characteristics e.g. ATTACK, DECAY, SUSTAIN and RELEASE. The terminology is arbitrary, and may vary from machine to machine. The cycle is sometimes termed the ADSR cycle. For further details reference should be made to the text book "*The Complete Synthesiser*" by David Crombie, published by Omnibus Press (ISBN 0.7119.0056.6).

Typically, the ATTACK time is the time the VCA takes to move from the untriggered state (max VCA attenuation) immediately prior to the moment of trigger initiation to the point of maximum VCA Amplitude.

Figure 2:
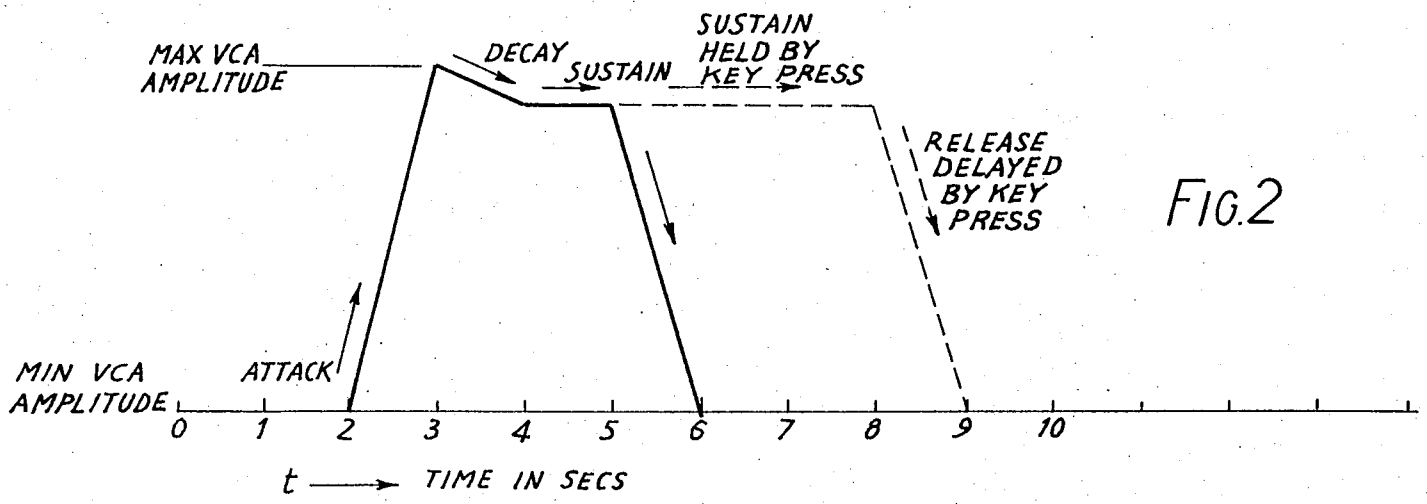
FIG. 2 shows an idealized ADSR response.

At t=2 sec, the trigger signal (continuous line) goes HI, a trigger initiation is detected and the VCA amplitude starts its ATTACK routine. As the ATTACK time has been set 1 second, the VCA takes one second to rise to maximum amplitude, as shown in FIG. 2.

After reaching maximum amplitude at 3 seconds, the VCA goes through the DECAY, SUSTAIN and RELEASE processes as dictated by the associated controls on the synthesiser (continuous line). In the example, the whole process lasts four seconds, finishing at t=6 secs.

Note that, although the trigger signal may only last 250 ms., the complete dynamic perforamnce has lasted four seconds. However, if the key is pressed down for six seconds, the trigger signal stays HI for six seconds, and the VCA is held in the SUSTAIN mode for a longer period than that pre-set on the synthesiser control panel, making the complete cycle last for a total of seven seconds.

Thus, in the above example, the trigger signal may be held for durations between a few milliseconds and six seconds without making any difference to the ADSR sequence. Also, even if a trigger is held for a period longer than the complete ADSR cycle, when the trigger signal is de-triggered (i.e. the finger is taken off the key, and the trigger signal goes from HI to LO), the VCA still has to go through the RELEASE characteristic as pre-set on the synthesiser control panel.

Figure 3:
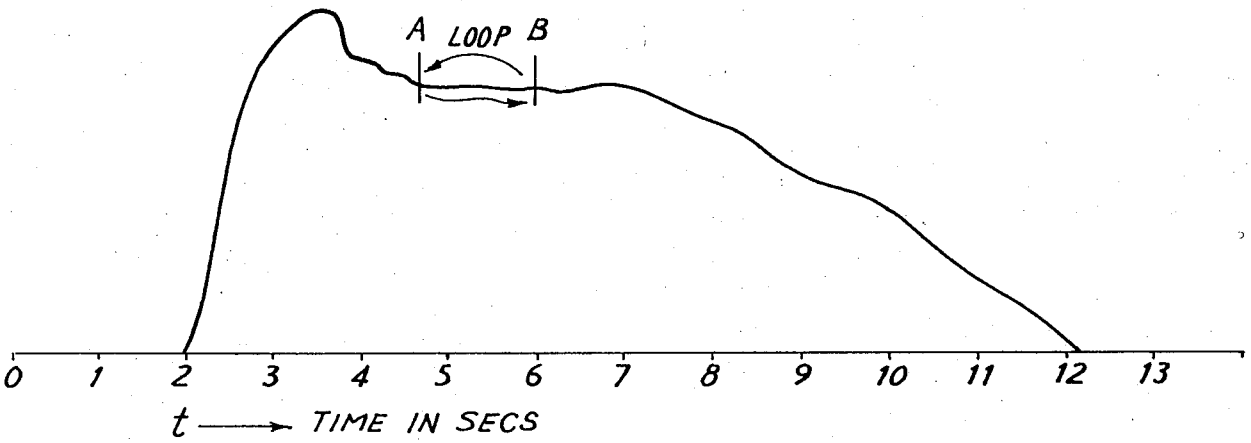
FIG. 3 shows a practical digital ADSR response.

The corresponding operations in a digital synthesiser will now be described. In its basic mode, the digital synthesiser stores a pre-defined waveform in memory, and when a trigger is initiated (again by the detection of the leading edge of the trigger signal as it goes from LO to HI) the waveform is "read" out of the memory. Only a finite amount of data can be stored in memory, and the waveform used in the basic mode will last for only a finite period. The waveform may for example be as shown in FIG. 3.

In one of the operating modes of a digital synthesiser, if the trigger signal is held for a period shorter than the time it takes to "read out" the waveform, the sound will be brought to a premature end by the de-triggering.

However, if the trigger signal is held for a period longer than it takes to "read out" the stored waveform, the sound will only last as long as the time it takes to "read out" the waveform. After this period, all the available data will have been used, and the sound will come to an end—even though the key has been held down, and the trigger signal has also been held.

An alternative operating mode in digital synthesisers is to use a LOOP. This works by choosing a section of the waveform which when looped, or indefinitely repeated, will produce the effect of lengthening the note. In the looped mode, if the key is held for a period extending further than the time taken to reach the end of loop point (B), the data read loops back to point (A), and repeats that section of the waveform for as long as required. On de-trigger, the loop routine is continued after the trigger signal has gone from HI to LO, but the amplitude of the repeated loop section is progressively reduced, giving the effect of a RELEASE characteristics as described above in relation to an analogue synthesiser.

In the loop mode, the relationship between the duration of the held trigger signal and the duration of the whole note is similar to that for the analogue system in that the note may be indefinitely sustained by holding the trigger signal, and after the de-trigger the not continues with progressively diminishing amplitude according to a preset RELEASE value.

General System Description

Figure 4:
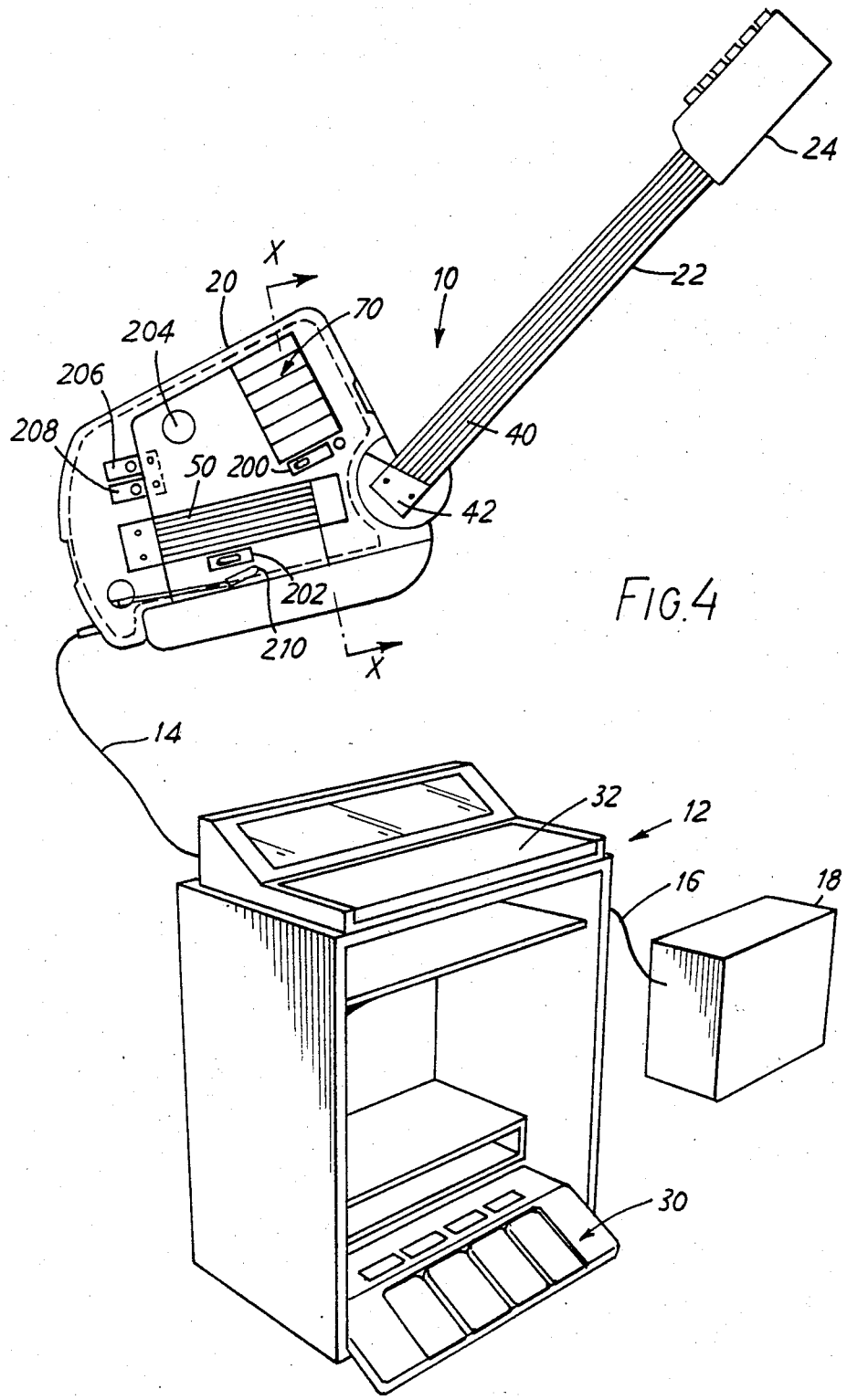
FIG. 4 illustrates the main components of a system embodying the invention.

The preferred SYNTHAXE embodiment will now be described with reference to the drawings. FIG. 4 shows the main physical components of the apparatus, namely the instrument 10 and the pedestal unit 12, which are connected by a cable 14. The instrument in this embodiment is modelled on a guitar and thus has a body 20, a neck 22 and a head 24 at the further end of the neck. The pedestal unit 12 houses foot pedals 30 at floor level, and a console 32 at its upper surface. The console 32 mounts various hand-operated controls which are more conveniently not put on the instrument 10 itself.

The output of the pedestal unit 12 is applied through a cable 16 to a conventional synthesiser 18, shown diagrammatically.

Figure 5:
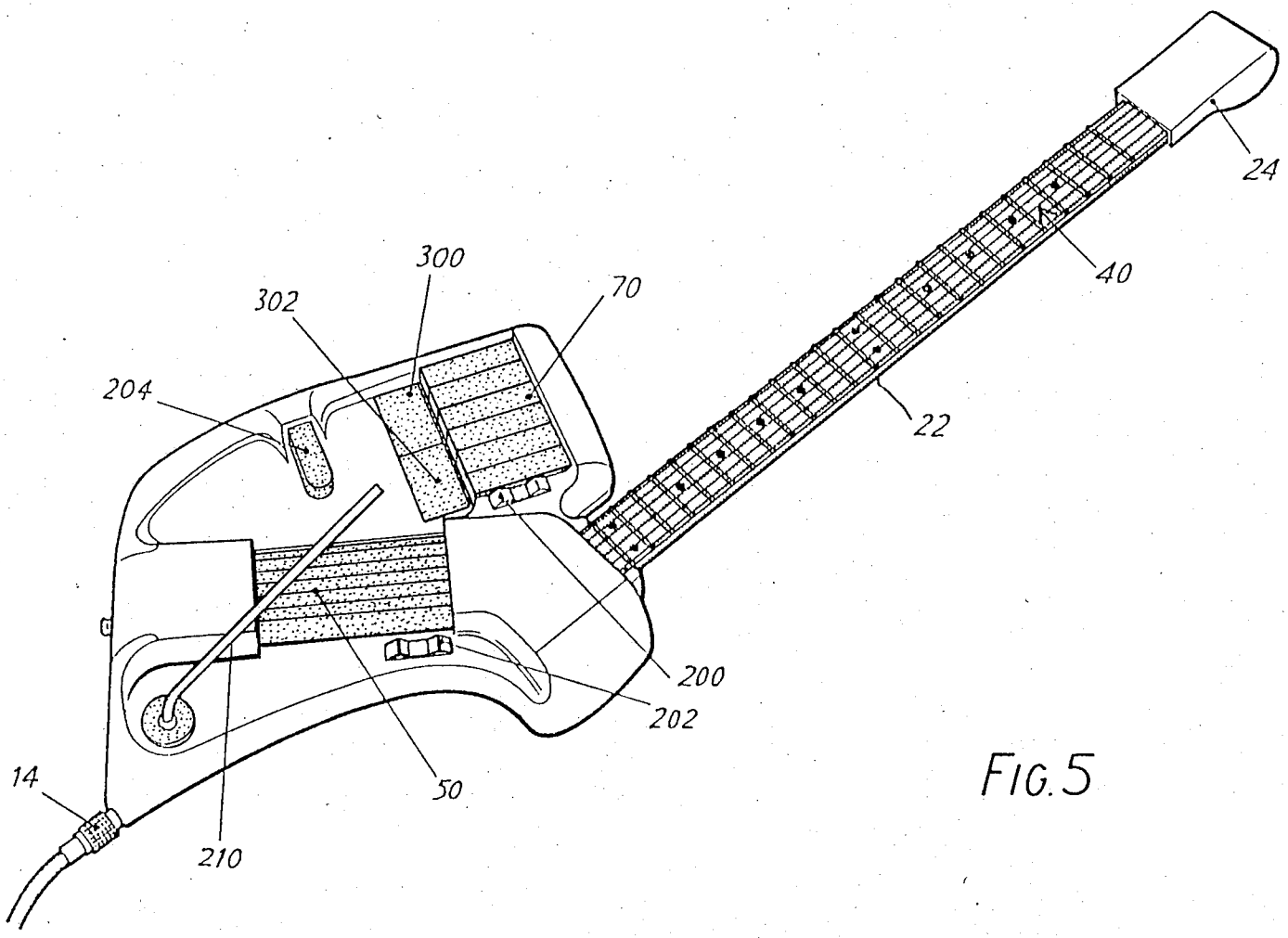
FIG. 5 is a front view of a modification of the guitar-like instrument of the system of FIG. 4.
Figure 6:
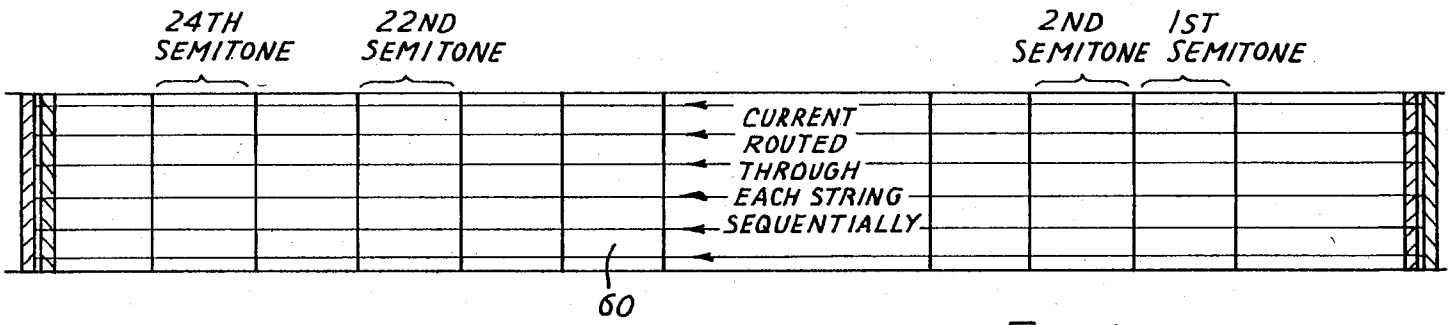
FIG. 6 shows part of the neck.
Figure 7:
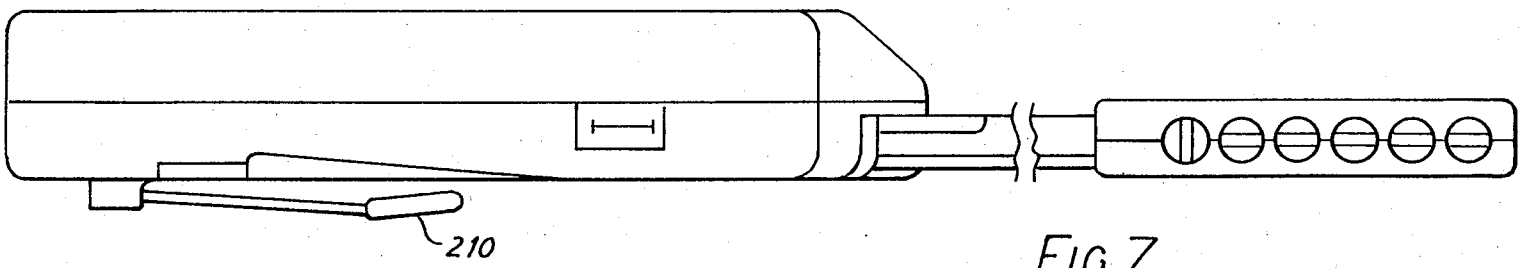
FIG. 7 is a top view of the instrument.

The instrument 10 is shown more clearly in FIG. 5, though with some modifications and improvements. The neck is shown in more detail in FIG. 6. The instrument is either hung on a strap (not shown) from the body when standing, or rested across the player's knees when seated, as with a normal guitar. As will be seen in FIG. 5, the instrument differs from a normal guitar in that the strings do not extend continuously from the head to a bridge conventionally positioned on the body of the guitar. Instead there are two sets of strings. The main set of six strings 40, which can be conventional metal guitar strings, are pitch strings and extend from the head 24 just as far as the base of the neck, where they are clamped by a clamping system 42. The second set of six strings 50 is much shorter and is mounted on the body 20 in a position to be struck by the right hand of a right-handed player. These strings 50 are termed the trigger strings. A plan view of the instrument is shown in FIG. 7.

The instruments determines the note being played not by sensing the string vibrations of the strings 40, but rather by detecting the portion of the string which is pressed onto the fingerboard 60. The actual string vibrations are irrelevant, and thus frets can be spaced at any desired spacing and the string tension set to any value which the player finds convenient to play.

In conventional guitars the fret sizes have to be larger at the lower end of the fretboard (nearer the head), and smaller at the other end. This limits the absolute length of the fretboard, and the number of frets on the board, as there are limits at either end of the string as to what is comfortable and physically possible to play. However in the SYNTHAXE instrument each semitone can (if desired) have the same fret size, and the dimensions can be chosen on the basis of what feels comfortable. As a result the musical range of the fretboard can be increased to, for example, two octaves per string. Nevertheless, the instrument retains the generally familiar shape of a guitar, and a guitar player can quite quickly become accustomed to the pitch spacings on the fretboard.

By breaking the strings into two parts, namely the pitch strings and the trigger strings, the two functions of pitch selection and initiation or triggering of the note have become entirely separated. The trigger strings 50 on the body of the instrument can be strummed or struck to play chords or can be plucked to play the strings individually. Each trigger string is provided with a sensor to detect the triggering instant, and preferably also the velocity which the sring reaches when plucked.

The body 20 of the instrument also carries several other controls the purpose of which will be briefly described here and explained in more detail below. As an alternative to use the trigger strings 50, the notes may be triggered by using keys 70, one for each string. The keys can be provided with sensors to sense rate and extent of depression to vary the HOLD or SUSTAIN time of the note, the timing of the entry to the RELEASE part of the note's dynamic cycle, and Initial Level (velocity or rate) and After Level (pressure or depression) parameters which may be used to control such things as the level of the note during the HOLD period, or the harmonic content of the note during the HOLD period.

Figure 8:
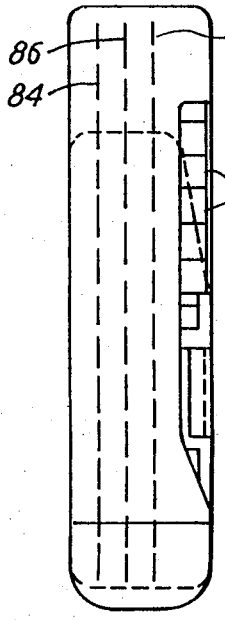
FIG. 8 is a sectional view taken on the line X—X in FIG. 5.

FIG. 8 is a sectional view taken on the line X—X on FIG. 4 showing the location of the strings 50 and keys 70 which are seen to be recessed.

The electrical circuits for the instrument are mounted on a number of circuit boards. As already mentioned, the neck includes a multiplexer circuit board 80 which houses circuitry receiving the pitch signal outputs. The head 24 includes a circuit board 82 carrying the string driver circuitry which applies current to the strings. Three processor boards 84, 86 and 88 are included in the body 20 of the instrument and are shown in dashed lines in FIGS. 4 and 8. Obviously the circuitry may be distributed differently and it may be possible to accommodate it on a lesser number of boards.

The individual components of the apparatus will now be described in greater detail.

String Driver Circuit

Figure 9:
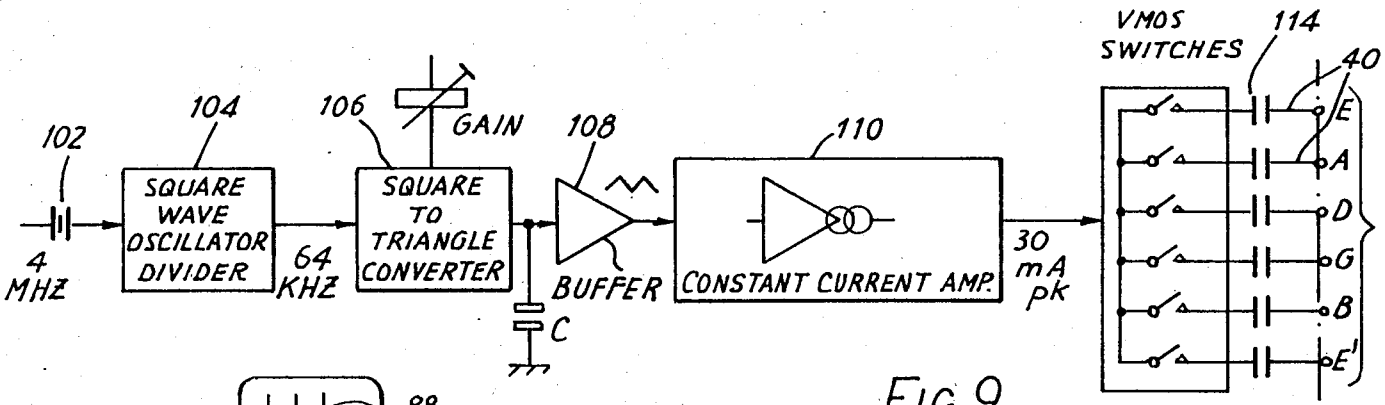
FIG. 9 is a block circuit diagram of the string driver board circuitry.

The string driver circuit board 82 mounted in the head 24 accommodates circuitry shown in FIG. 9. A crystal oscillator 102 provides a signal at about 4 MHz which is divided in a divider 104 down to 64 kHz. The resultant square wave signal is applied to a square-to-triangular waveform converter circuit 106, the output of which in turn is applied through a buffer amplifier 108 to a constant current amplifier 110. The output of amplifier 110 is applied to an array of six FET semiconductor switches 112 each of which is coupled through a respective capacitor 114 to an associated one of the pitch strings 40. There is a similar array of switches at the other end of the strings. The switches 112 are rendered conductive sequentially under the control of a microprocessor The circuit of FIG. 9 is operative to apply cyclically to the six strings in turn generally triangular pulses at a frequency of 64 kHz and a peak amplitude of 30 mA. The voltage applied to the strings is only of the order of two volts or less and is AC coupled through the capacitors 114.

Pitch Determination

The currents passed down the conductive metal strings 40 in turn are collected at the base of the neck and returned through a ground plane formed by a conductor running up the neck when a string is depressed by the musician against an electrical contact on the fingerboard, a voltage is applied to the contact. The point at which the string is depressed can thus be found by noting which contact receives current from the string. A separate contact is provided for each fret position along the string, and the contacts can conveniently constitute the frets.

Figure 10:
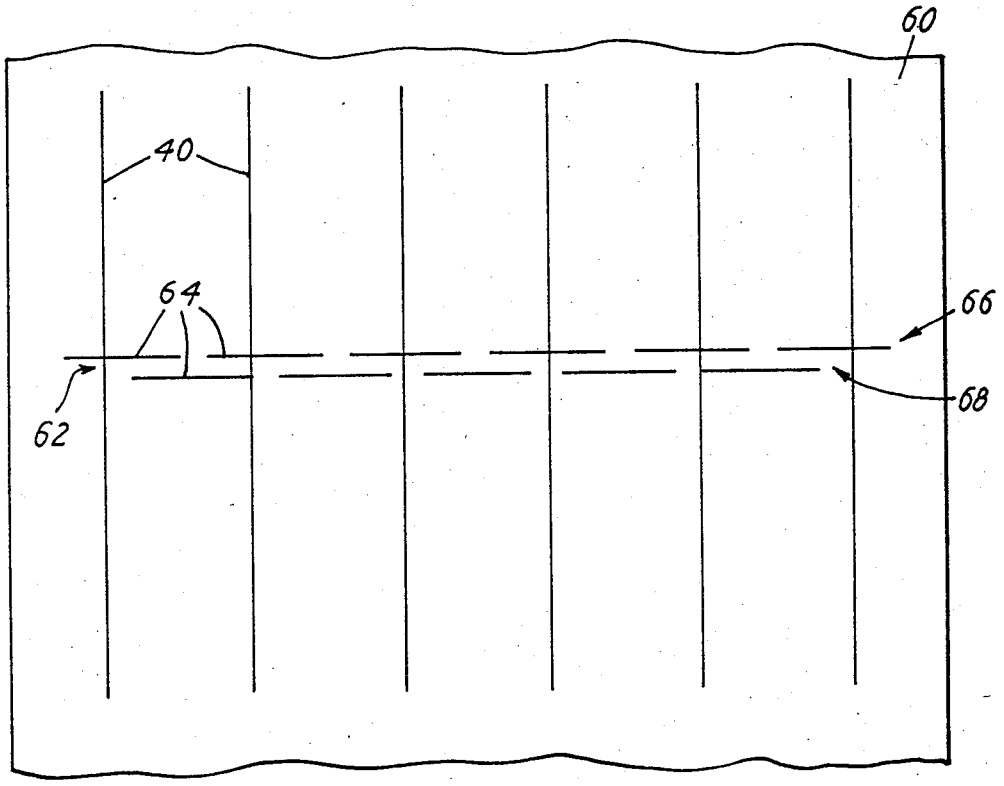
FIG. 10 is a plan view of part of a fingerboard embodying the invention.

Thus, referring to FIG. 10, part of the fingerboard 60 of the stringed instrument is shown. Each fret 62 is constituted by a total of eleven contact pins 64 arranged in two closely spaced rows. The primary row 66 includes six contact pins one under each string. The pin heads are elongate in the direction across the width of the fingerboard, and do not quite touch each other. The secondary row 68 comprises five contact pins centred between adjacent strings.

Figure 11:
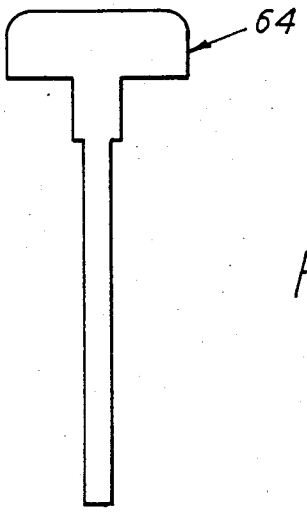
FIG. 11 is an elevational view of one of the contact pins.
Figure 12:
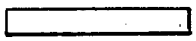
FIG. 12 is a plan view of the head of the pin.

Each contact pin is shown in side view in FIG. 11. A plan view of the head is shown in FIG. 12. The head dimensions may typically be 6 mm by 0.7 mm, and the string pitch is 8 mm across the fingerboard.

Figure 13:
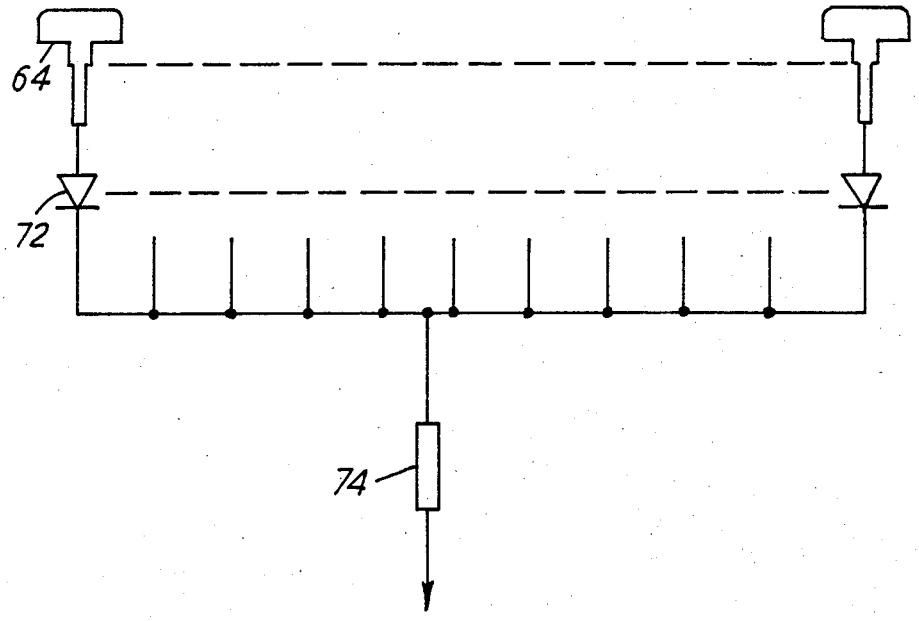
FIG. 13 illustrates the electrical connection of the pins.

The pins are electrically connected as shown in FIG. 13. Each pin is connected to an appropriate isolating diode 72, and the outputs of the diodes of each row are connected together and to a protection resistor 74.

When a string is depressed at a fret, the contact pin or pins which it touches will receive a current synchronously with activation of that string. Even if several strings are depressed, the outputs relevant to the strings can readily be separated as they will occur only when the respective strings are pulsed. Thus the system is not limited to monophonic systems, and the derivation of six different control signals relevant to the six different strings is relatively easy. The diodes 72 operate to make the string outputs fully independent.

Strings which are intentionally stopped on different frets to create specific notes may incidentally be in common contact with a non-active fret somewhere else under the player's hand, and the consequent short would produce spurious data in the absence of the isolating diodes.

Figure 14:
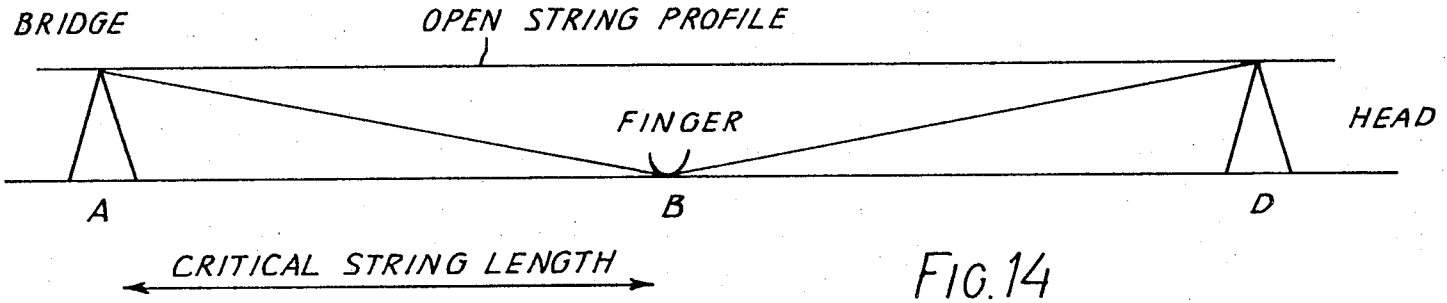
FIG. 14 diagrammatically illustrates a string pressed against the fingerbroad at one point.
Figure 15:
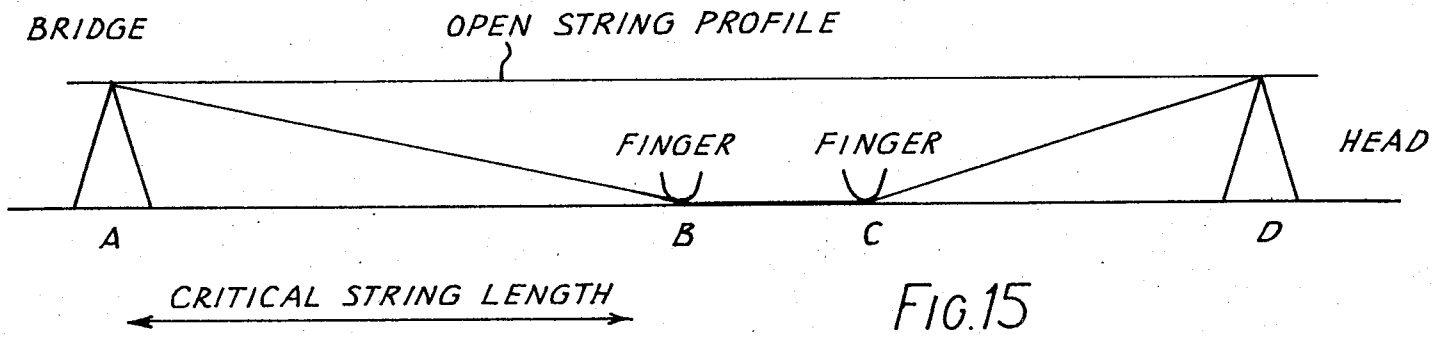
FIG. 15 diagrammatically illustrates a string pressed against the fingerboard at two points.

The output produced from the frets varies according to the position of the string on the fretboard. FIGS. 14 and 15 diagrammatically illustrate two strings 40. FIG. 14 shows the open string profile and also the profile of a string depressed by one finger. Here the instrument has to detect the position of finger B which is the closest point of the string to the fretboard. However the situation shown in FIG. 15 can also arise, where a second finger C passes over the string in order to depress another string. Here it is the point B which it is still desired to detect, but this does not represent the only point of contact with the frets. Care has therefore to be taken to ensure that if the string contacts two frets the one nearest the body is used.

Each string has a sensing system (Left Hand String Touch Sensor described below) which lets Processor No. 1 know whether a string is being touched by the player's hand or not. If the string is not being touched, the string is obviously "open".

Preferably the strings will have an AC current applied to them, and this signal is used to detect active frets. Using a high frequency AC signal allows the use of 50 Hz pick up and DC leakage for string touch sensing. The use of diodes and the contact system allow an economy in parts and six strings playable simultaneously.

String Bending

Another problem which arises with fingerboard sensing systems is due to the modern guitar player's technique of string bending. As he bends a string laterally across the fingerboard, it will lose contact with the primary fret tracks at the dividing points between the strings. Consequently, a composite fret is built up consisting of the two closely placed rows of staggered and overlapping contacts.

Such a solution ensures that the strings are electrically isolated from each other during normal play, and during string bending passages, the string being bent will slide over a number of overlapping, but electrically separated contacts, effectively creating a constant signal on the multiplexer signal line.

In order to avoid spurious data created by strings physically touching each other during string bend passages, it is advisable to synchronise the switching of the signal current to and from the strings at both ends.

If the degree of bending is to be used in modifying the system output signal, a string bend transducer could be used based on detection coils embedded in the neck of the instrument, as described below.

Figure 16:
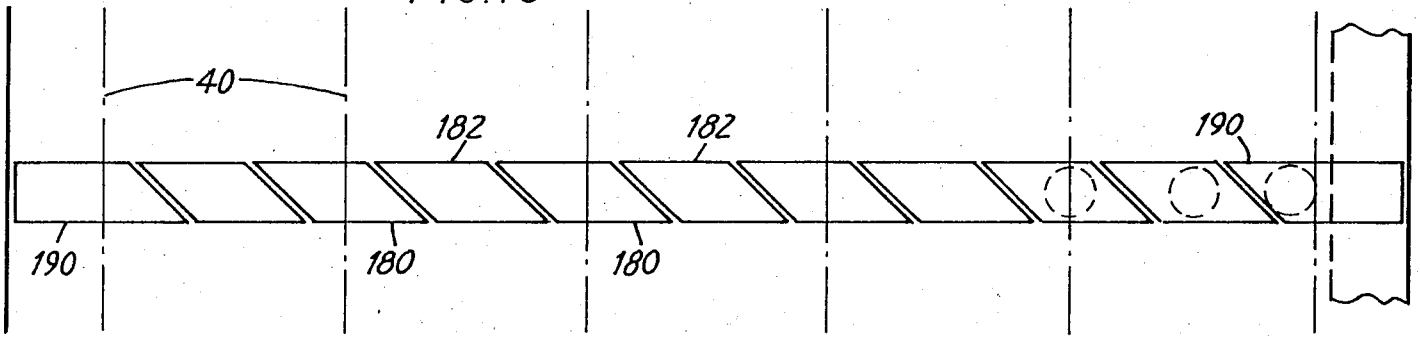
FIG. 16 is a schematic plan view of part of a second fingerboard embodying the invention showing one fret position.

However, a second example will now be described with reference to FIGS. 16 to 23 of the drawings. In this case there are again eleven fret pins to each fret and FIG. 16 shows the arrangement of one fret across the fingerboard. In this instance the eleven fret pins are arranged on a single line. There is one fret pin 180 under each of the six strings 40, and there are also additional fret pins 182 between these principal fret pins. Each fret pin is arranged so that, in plan, it partially overlaps the longitudinal extent of the adjacent pin or pins. That is to say, as seen in FIG. 16, the joins between the pins lie diagonally at 45° or less in relation to the direction of the fret itself. A angle of around 60° has been found to be particularly suitable. This arrangement, in somewhat similar fashion to the use of the auxiliary fret pins 68 in FIG. 10, enables a measure of string bending to be obtained for use in subsequent processing.

Figure 17:
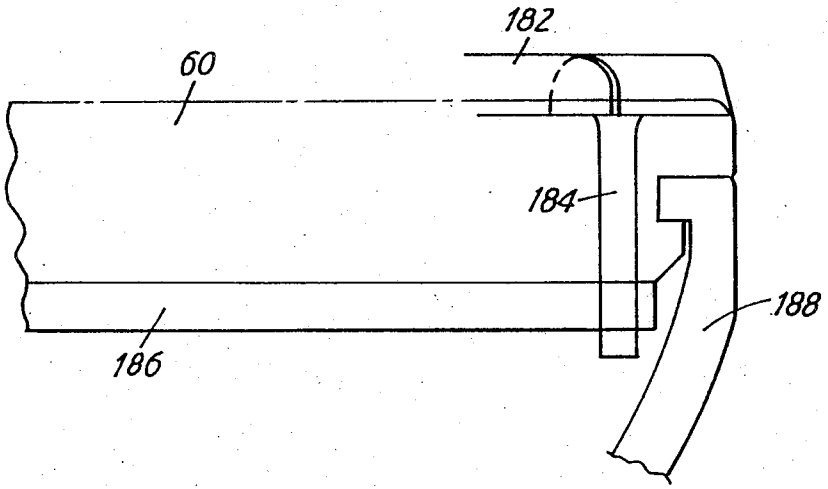
FIG. 17 is a detail sectional view across the neck of the instrument.

As shown in FIG. 17, the fret pins are mounted in and have a shank portion 184 extending through the fingerboard itself 60. A printed circuit board 186 is mounted on the lower surface of the fingerboard and the shanks 184 of the fret pins can make direct connection with this printed circuit board. The fingerboard is mounted by means of a groove and projection in the neck member 188 of the instrument.

Figure 18:
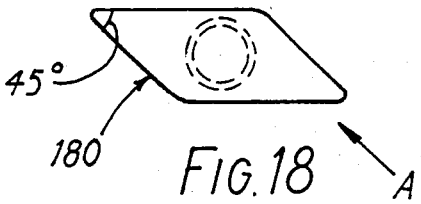
FIG. 18 is a plan view of one of the intermediate fret pins of FIG. 16 on a larger scale.
Figure 20:
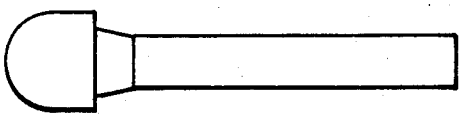
FIG. 20 is a side elevational view of the pin.
Figure 19:
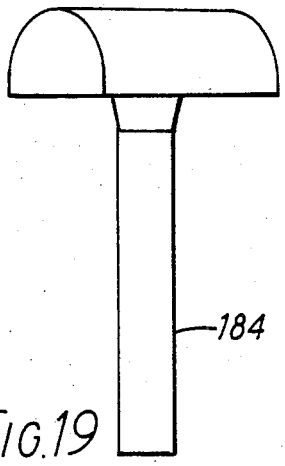
FIG. 19 is a front elevantional view of the pin.
Figure 21:
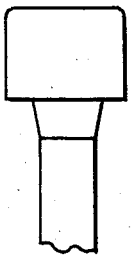
FIG. 21 is a partial elevational view taken on the arrow A in FIG. 6.
Figure 22:
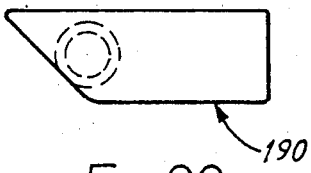
FIG. 22 is a plan view of one of the two external fret pins of FIG. 16.
Figure 23:
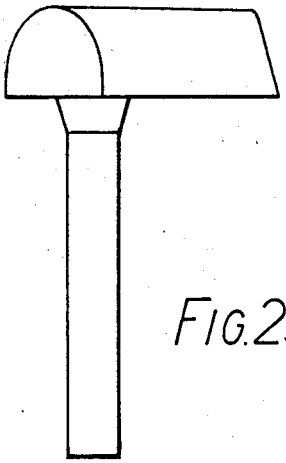
FIG. 23 is a front elevational view of the pin of FIG. 22.

The shape of one of the intermediate fret pins 180 or 182 is shown in FIGS. 18 to 21, which show respectively plan, front elevation and side elevation views and a view on arrow A in FIG. 18. As seen in FIG. 20, the fret pin has a rounded top surface so that the fret as a whole presents a part-cylindrical shape. The two fret pins 190 under the upper and lower E strings are differently shaped, as shown in FIGS. 22 and 23, to present a neat end finish to the shape of the fret.

The precise manner of fixing the pins can be chosen as a matter of convenience. The pins will normally be soldered to the printed circuit board 186 and can pass through slots in the fingerboard to enable a degree of adjustment of the alignment of the pins. The preferred shape of the opposed faces of the pins and spacing between them can be a matter of choice, and in certain circumstances a curved face may for example be preferred.

Electronic System Description

Figure 24:
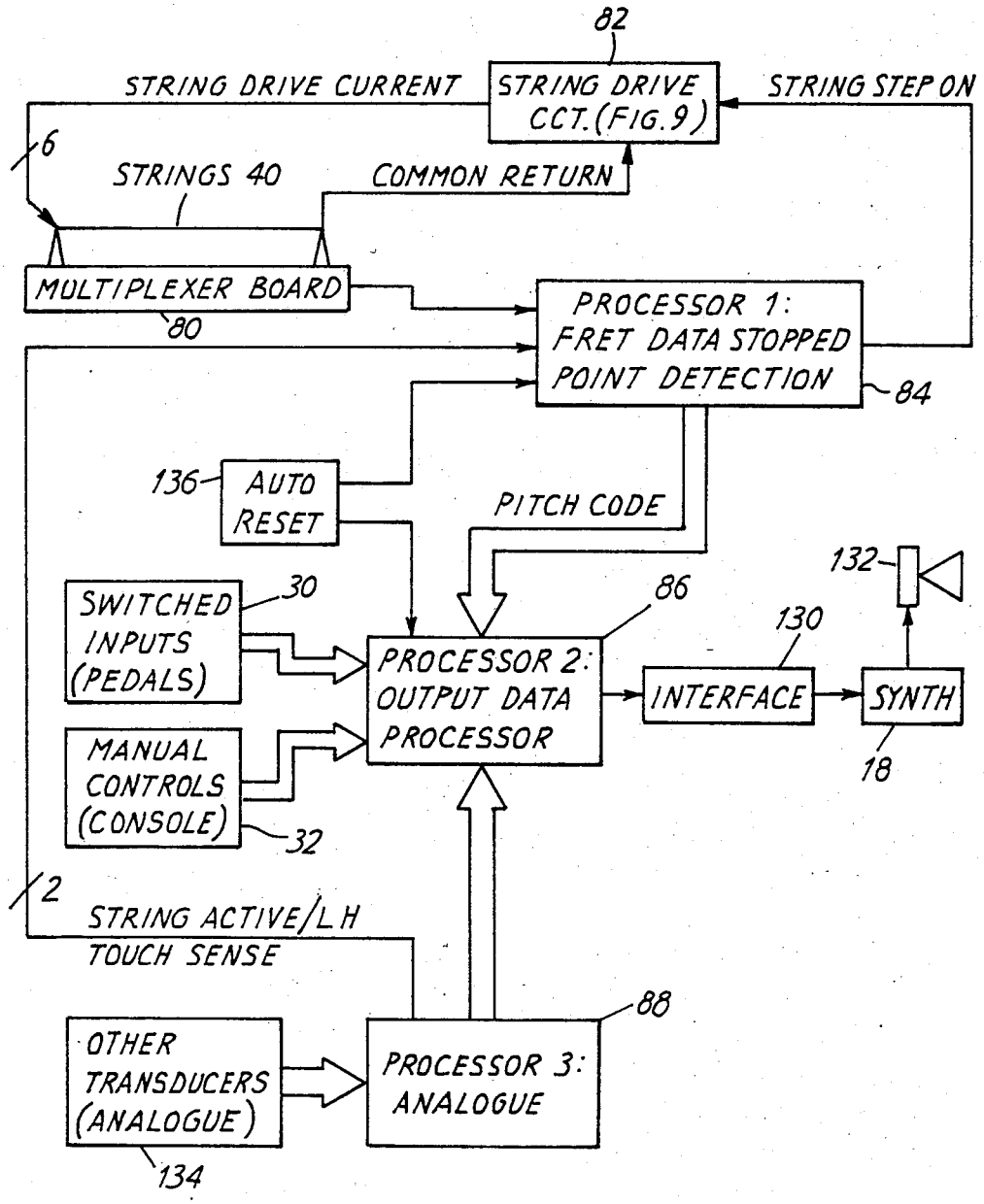
FIG. 24 is a block diagram showing the main components of the electronic system.

The main components of the electronic system are shown in FIG. 24 and are individually described in more detail below. FIG. 24 shows the string driver circuit 82 connected to drive a current through the strings as described above. The multiplexer board 80 provides an output to processor 1 on board 84. Processor 1 determines at what point the strings have been depressed on the fingerboard. This pitch information, is applied to processor 2 on board 86. Processor 2 receives also certain of the switched input control signals, notably those from the pedals 30 and pedestal console 32, and also receives from processor 3 on board 88 other control signals derived from other transducers (generally indicated by block 134) on the instrument 20 itself after appropriate analogue processing in processor 3 as described below. The output from processor 2 is applied through an interface circuit 130 to the synthesiser 18, and thence to a loudspeaker system 132. Certain other connections exist of which the most important only are shown in FIG. 24. Thus processor 1 supplies a control signal to the string drive circuit 82 to cause the string current to be stepped on to the next string, and an auto reset circuit 136 monitors the operation of processor 1 and resets processors 1 and 2 when the power is switched on and in other circumstances where the normal operation fails, e.g. due to external interference causing a processor to 'run wild'. The analogue processor 3 also applies certain control signals to processor 1 as will be described below.

Processor 1

The scanning stage of the operation is composed of two parts: selecting the string and gathering the neck fret data.

Control of the 'string step on' operation is determined by the strings that are touched. Each string touch sensor is checked in turn, if the string is touched when a pitch point detection routine is started. If the string is not touched then the next string of the cyclical sequence is checked. This method of implementing step on saves time as unused strings are not scanned. The open string condition is passed to processor 2.

Before the pitch point detection routine is started for a particular string, the string current driver must be switched to activate that string. Processor 1 has the ability to step on the string being activated and to sense which string is active, forming a closed loop string activating system.

The process of scanning the whole length of the fret board for every string touched is wastefull of time and a coarse/fine search approach can be used to produce an improvement in speed without loss of resolution.

The output from processor 1 is a normalised pitch point representing the player's finger position, whereas the exact pitch produced when a sound is triggered is determined by the operation of processor 2. Data is made available to processor 2 by processor 1 writing the data into a 2-port memory that is readable by processor 2.

Information that is passed to processor 2 includes pitch point data, invalid result and any errors or processor 1 system problems.

As will thus be seen, processor 1 on board 84 functions on its own, and there are no player controls to modify its operation. To rapidly find the pitch points the processor adapts its operation to suit the player's actions moment by moment, untouched strings are left alone for instance.

To speed the response of the system to the player's actions the functions are partitioned between processors 1 and 2, as described, but this need not be so. If a coarser pitch resolution is used or faster computing elements are used the two operations could be merged. Partitioning of these two functions has a greater effect than simply doubling the speed. As perceived by the player, the delay in a sound starting is from the moment of the triggering, not the moment of pitch setting, so that the relatively slow process of determining the pitch point is concealed by the rapid response of processor 2 and the fact that a string player expects to set the pitch before triggering a sound.

String Touch Sensor Circuits

As noted above, the processor 1 is provided with an indication as to whether each string is open (i.e. untouched) or not. This information is received from processor 3 on board 88 which in turn receives the output of a string touch sensor circuit for each string.

The aim of the touch sensing system must be to unambiguously declare to the processor circuitry in the face of a fairly wide range of operating conditions, the state of the string.

This is preferably achieved by a dual-detection method relying on the effects of either or both of 50 Hz mains power field induction (primarily intended for when the players hands and fingers are relatively dry) and alteration to a standing direct voltage sourced at high impedance on the string (primarily intended for when the players hands and fingers are relatively damp).

The conditioning circuitry must generate and detect appropriate signals and provide delays of acceptable duration to mask spuriously induced signals. Its output interfaces directly to processor 3 and exists for a fixed minimum time to enable its presence to be detected.

Some conflicting and demanding compromises have to be met in the design and operation of the string touch sensor circuit. The system must be able to detect a very light finger touch (such as may be used for "damping") when skin and body return resistances of up to 20 megohms would not be unusual, yet must not be vulnerable to moderate external interfering sources. It is difficult to see how a dc based sensing system could be reliable as it would require multimegohm resistors with attendance size, cost, leakage and stability problems. So an ac sensing system must be selected and yet one that is immune to 50 kHz pick-up.

It is easy to design an ac circuit with a very high input impedance (e.g. voltage follower) sensing 50 Hz pickup on the string induced from the fingers or hand of the player as he touches the string. However, this would not always be reliable simply because the player may sometimes present a low impedance to ground (e.g. when sweating). Then the magnitude of the induced 50 Hz component in his body may be very small.

In the above cases, though, a dc method of touch detection would now be easy. If the string were to be held at a modest direct potential with respect to ground, and at a moderately high impedance, then this voltage would significantly fall when the string was touched. All that would be needed would be a voltage comparator arrangement.

The best solution is to use a system of detection that is based on both the ac and dc principles.

When the string is touched, either the player's hand will lower the string voltage to below 2.5 volts, or mains frequency (50 Hz or 60 Hz) pick up from the body will induce an A.C. voltage of several volts into the string. A monostable delay circuit is preferably included which has a duration of greater than 5 ms. This prevents spurious touch sensor signals being generated in response to unwanted transients.

Figure 25:
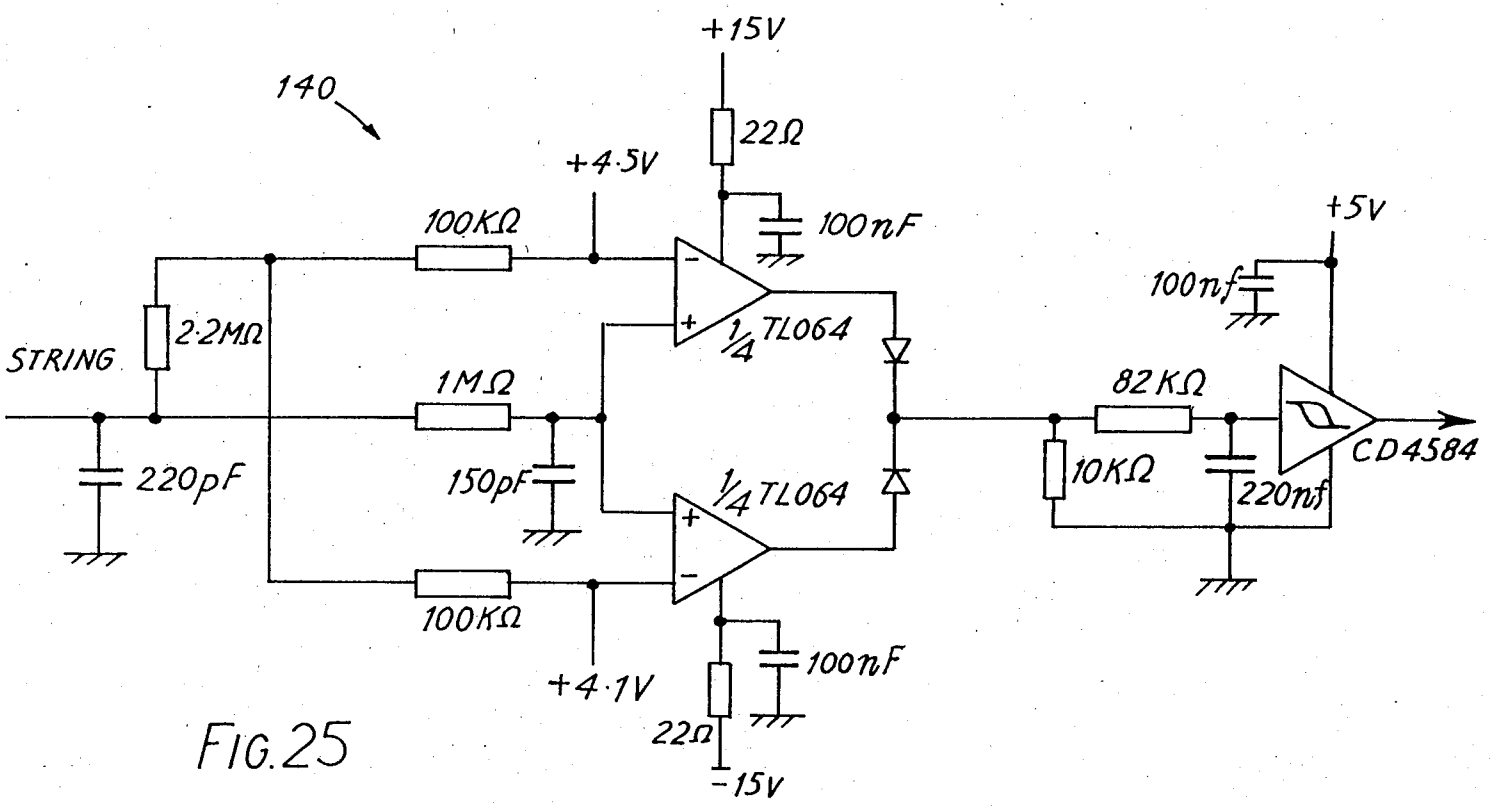
FIG. 25 is a circuit diagram of one possible form for the touch sensor circuit.

FIG. 25 shows one possible example of a touch sensor circuit 140.

Trigger Strings

The trigger strings 50 are operated by the right hand to produce an instantaneous trigger signal when each trigger string is plucked to indicate that the note selected by the corresponding pitch string 40 should now be sounded. Each trigger string is also provided with a touch sensor circuit 140 of the type shown in FIG. 25 to indicate when a string is being touched such as to cause damping of the note.

Each trigger string has a sensor device to detect plucking of the string.

Figure 26:
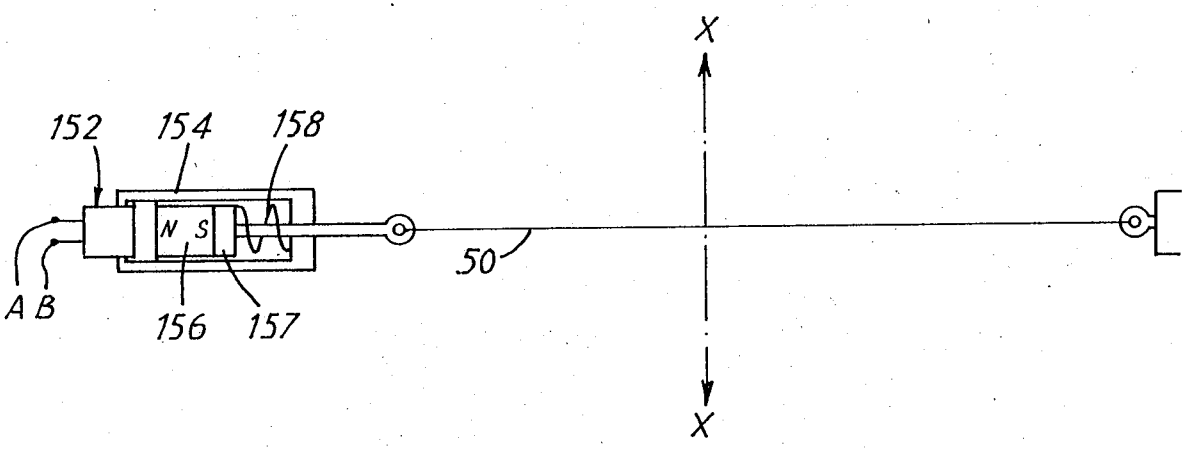
FIG. 26 illustrates the trigger string plucking detector.

The plucking detector shown in FIG. 26 uses a Hall effect sensor 152 which is fixed in a housing 154. The end of the trigger string 50 is attached to a magnet 156 mounted on a plunger 157 which is free to slide in the housing 154 but is subject to the bias of a compression spring 158 which acts to tension the string. Plucking the string will tend to move the magnet 156 axially, thus varying the spacing of the magnet from the Hall effect sensor 152. The output of the sensor 152 is applied to processor 3 on board 88, through a simple rate-of-change detector.

The plucking action of a conventional instrument comprises an initial distortion of the string from its state of rest (in which the string is only storing energy for the triggering action, and has not yet been triggered), and the subsequent release of the string from its preset state of tension (which produces the dynamic trigger or vibration). The present system does not produce a trigger signal while the value of the voltage from the string trigger transducer rises as the string is displaced from its state of rest. The trigger signal is produced when the string is released from its preset state of tension, and the rate of change of voltage produced in the system exceeds a predefined slope. This allows the trigger action, or level of "pluck" required to produce a trigger signal, to be preset to the player's liking, and ensures that the string trigger signal generation can be made neither too sensitive nor too insensitive.

Initial Level and After Level

Many electronic keyboard instruments extract what are called "Initial Level" and "After Level" signals, respectively dependent upon the velocity of the key as the player strikes it, and the continuing pressure which the player exerts on the key as he sustains a note. These parameters can be used to make an electronic musical instrument more expressive.

Although the attack and decay characteristics are preset on a synthesiser's control panel, and there is an arbitrary maximum amplitude associated with each particular setting of the controls, the amplitude of the envelope shape produced can be modified, within limits, by utilizing "Initial" and "After" Level control signals.

For example, some synthesisers allow the player to set the mean level of the envelope shape amplitude on the control panel, but modify the amplitude with the Initial Level signal, so that the faster he hits the keys, the louder will be the maximum peak of the attack characteristic.

On the other hand, on some synthesisers, he can also control the amplitude of the 'sustain' part of the envelope shape by increasing or decreasing the pressure with which he is holding the keys. This means that having hit the keys faster or slower to get higher or lower initial attack amplitude levels, he can make the held notes or chords swell or diminish by varying the pressure on the keys.

Initial and After Level may be used to modulate other parameters such as harmonic content, vibrato speed and depth, or pitch change.

SYNTHAXE Instrument use of Initial and After Level

On an organ, or a synthesiser with organ-like dynamics set up on the envelope shaper, it is very easy to infinitely sustain a note. The key is simply held down. However on a plucked instrument, the amount of time that a note sustains, or takes to die away, depends on the amount of energy imparted to the plucked string, and the acoustic characterstics of the individual instrument.

The trigger strings 50 on the SYNTHAXE instrument are designed to simulate a plucking action; they will be most successful when used with a synthesiser whose dynamic parameters have been preset to act in a similar manner to a stringed instrument. An instantaneous and unsustained trigger signal will initiate a dynamic cycle of attack and decay which includes a relatively long preset decay time, giving a sustained musical effect. If the trigger strings are used to trigger a synthesiser whose dynamic characteristics are set up to respond like an organ or like instruments of the brass family, however, it will not be successful. These instruments have very short decay times (a few milliseconds in an anechoic chamber), and the very short trigger signals produced by plucking the trigger strings will produce a sound which is staccato in the extreme. As the plucked string signal is so transitory, there is no After Level signal.

The Initial Level signal is nevertheless very useful. This can be extracted by sensing the level of displacement of the trigger string from its normal state of rest immediately prior to letting the string go. This value is stored until the trigger signal is generated by the rate of change of the trigger signal output voltage exceeding a predefined threshold—and if required, the Initial Level can be used to modify a variety of parameters. For example, the Initial Level control signal may be used to offset the basic VCA control signal. Therefore, the more the triggerstring is initially displaced, the greater the amplitude of the envelope shape when that note is finally triggered. Alternatively or additionally, a quasi-peak velocity signal can be extracted from the variations in signal level from the Hall Effect ic's. In the case of the trigger strings, the velocity data is extracted from signal variations produced over the entire range of physical movement of the magnet.

This quasi-peak velocity may be used for a variety of functions. Many commercially available synthesisers have internal routing arrangements allowing velocity data to modulate various parameters. For example, velocity data may be used to modify the level of the sound to be generated. Therefore, when a note is played, the trigger information not only starts the note off, but starts it off at a level decided by the velocity value generated at the time of triggering. Consequently, the synthesiser may be set up so that the faster or the harder a trigger string is plucked, the louder the note will be. Level is only one parameter which may be modulated. Some synths allow velocity data to modify the filter value. In this case, the higher the velocity, the higher the harmonic content. Examples of some other parameters which may be controlled in this way are absolute pitch, LFO control oscillator frequency, attack and decay times.

Trigger Keys

As previously noted, the trigger keys 70 provide an alternative method of triggering notes which can be used instead of the trigger strings 50. One key 70 is provided for each of the six strings. The keys are particularly suitable for use when it is desired to control preset envelope shapes similar to the sounds made by an organ or a brass instrument.

Figure 27:
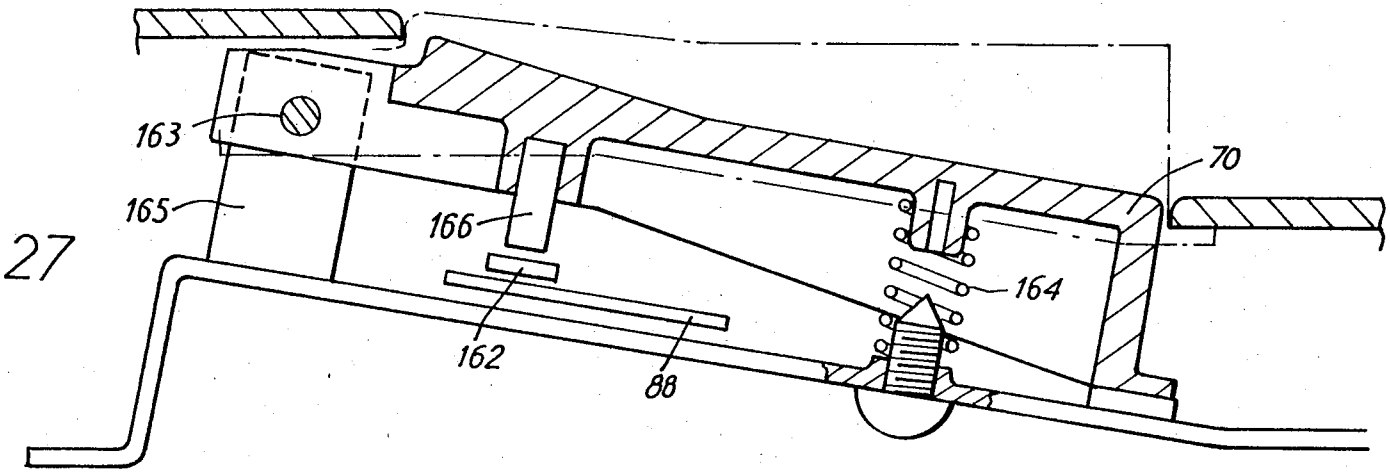
FIG. 27 illustrates a preferred trigger key construction.

FIG. 27 shows a preferred trigger key sensor arrangement using Hall effect sensor 162 mounted conveniently on a portion of the printed circuit board 88. The plastic key 70 pivots about a metal rod 163 journalled in a bracket 165 and is sprung by a compression spring 164 to give it a resilient bias against depression in the direction Y. The key 70 carries a magnet 166 which moves with the key and induces currents in the Hall effect sensor which define the instant of depression of the key and are dependent upon the rate of key depression.

Figure 28:
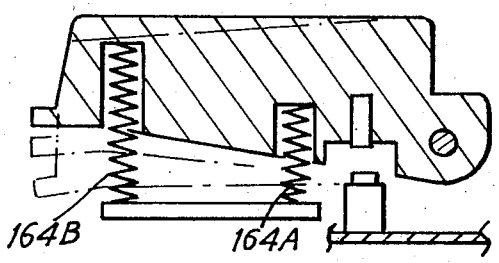
FIG. 28 illustrates a modification having two springs.

The compression spring 164 may be replaced by a two-part spring arrangement such that there is relatively little resistance to initial depression of the key, but about half-way down its travel the second spring comes into play and increases the resistance. This modification is illustrated in FIG. 28 where there are two springs, namely a first spring 164A and a second spring 164B.

The key 70 can optionally carry a soft cover to turn it into a finger pad rather than a key.

The six trigger keys drive the various oscillators or voices in the synthesiser in the same correspondance as the trigger strings. I.e. in conventional guitar tuning they will drive the oscillators or voices associated with E, A, D, G, B and top E open string values. If the guitar player is familiar with a finger-style technique of playing the guitar, (normally the thumb plucks the E, A and D strings, while the index finger plucks the G, the second finger plucks the B and the third finger plucks the top E), then he can very easily assimilate to the new method of playing. The finger/string associations are already established in the brain, but instead of a plucking action, the finger action has to be modified to a striking and/or pressing action—the right hand performs in some respects as if the instrument were a piano, while the left hand performs as with a guitar.

With the detection method illustrated, the velocity with which the player strikes the key (Initial Level), and the variations in the pressure that he maintains on the key (After Level) can also be extracted from the control signal. Thus the guitar player now has a set of keys which give him a means of triggering a synthesiser with all the initial level, after level and note holding effects which are available on the most sophisticated piano style keyboard.

As with the trigger strings, a quasi-peak velocity signal is extracted from the variations in signal level from the Hall Effect ic's. In the case of the trigger keys, the velocity data is preferably extracted from the first part of the throw of the key (the initial range of the first spring 164A) between the position of the key in the unpressed state, and the position of the key at the point when it just touches the second spring.

Velocity data is produced at the beginning of a note, (at the time of initiating a trigger). In the case of the trigger string, that was the end of the story until the next note. However, in the case of the trigger key, it is possible to produce a velocity value, not only at the beginning of a note (at the time a key is pressed on), but also at the end of a note, (at the time a key is let up).

Not all synths can use this data, but some allow modulation of synth parameters by Note Off Velocity completely separately to Note On Velocity. Consider the case where the Note On Velocity is modulating VCA Level, Filter and Dynamic Attack, and Note Off Velocity is modulating Dynamic Release. Striking a trigger key softly and slowly will produce a low Note On Velocity value. Therefore the note produced will be relatively low-level, of slow attack, and will not have many filter induced harmonics. If the key is then let up slowly, the Note Off Velocity value will also be low, and the Dynamic Release time will be long. The overall effect is legato. Conversely, if the key strike is hard and fast, the Note On Velocity will be high, and the note produced will be relatively high-level, of fast attack, and will have many filter induced harmonics. If the key is then let up fast, the Note Off Velocity will be high, and the Dynamic Release time will be fast. The overall effect is staccato.

This application of Note On and Note Off Velocity produces very expressive results on the synthesiser in a manner natural to the musician.

The trigger key also produces pressure data when the key is pressed. As previously discussed, the velocity data is extracted from the variations in signal level produced by the Hall Effect ic when the magnet is moving through the initial range of the 1st spring. Having gone through this range, the player comes up against the second spring. If he wishes to use the effects available by using the pressure data, he pushes the key on down into the range of the 2nd spring.

The absolute level of signal from the Hall Effect ic is, within the range of the key movement, relative to the pressure exerted on the key by the player. This signal is analysed within Processor No. 2, and After Level data is produced.

Processor 2 software is arranged so that the after level value output to the synthesiser remains at minimum value through the initial range of the 1st spring. There is also a guard band between the point at which the output after level value starts to rise. This allows for any mechanical overshoot in starting a note which may inadvertently produce unintentional after level effect.

After level can be used to modulate synth parameters in the same way as Note On and Note Off Velocity. The most obvious ones are level and filter effects. If after level is set up to modulate both of these parameters together, then, having triggered a note by moving the key through the 1st range, the further pressure applied to take the key down through the second range will produce level swelling and filter modulation effects.

Group Trigger Keys

In addition, we have found it desirable to include two group trigger keys 300, 302 (FIG. 4) which serve each to actuate three of the trigger keys 70 by a mechanical interlock. That is, key 300 actuates the lower three keys 70 and key 302 actuates the upper three keys.

Figure 29:
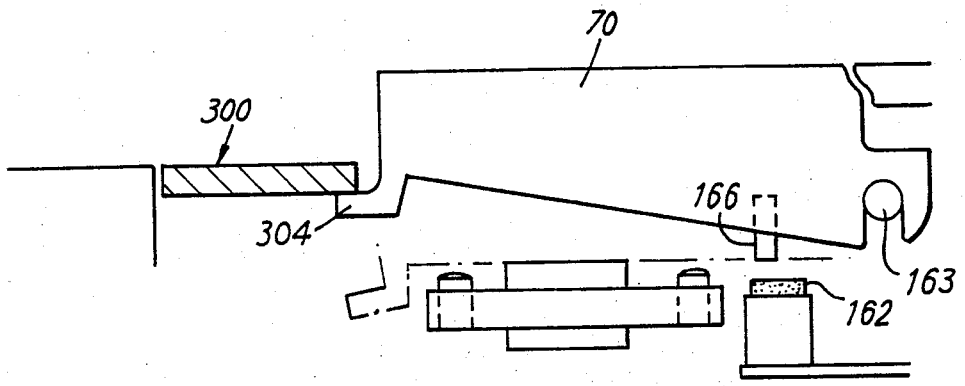
FIG. 29 illustrates a modification including a group trigger key.
Figure 30:
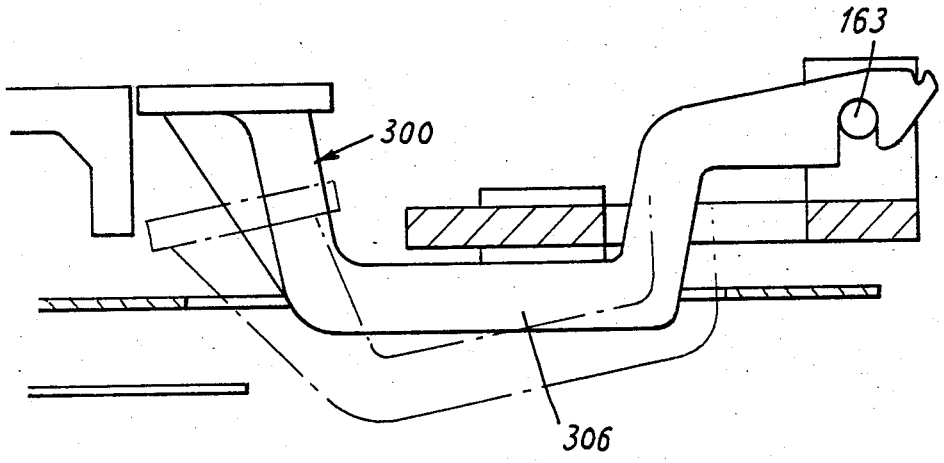
FIGS. 30 & 31 are a side and plan view of one of the group trigger keys.
Figure 31:
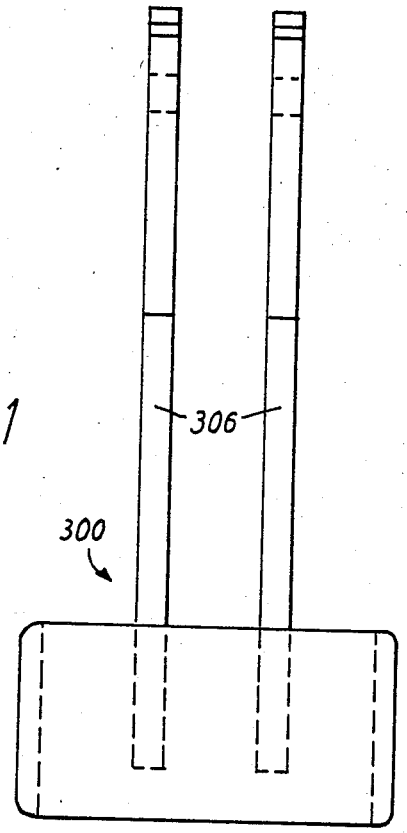

The mechanical interlock is shown in the modified construction of FIGS. 29 to 31. The key 300 is wide enough to extend across the three lower keys 70 and on depression depresses a tag 304 on the keys 70, as shown in FIG. 29. The shape of the key 300 is shown, without the keys 70, in FIGS. 3 (side view) and 31 (plan view). The key 300 is mounted by two arms 306 to pivot about the same pivot shaft 163 as the keys 70.

Thus depression of the key 300 (or 302) causes all three associated keys 70 to be depressed and the magnets 166 mounted on them to actuate the Hall-effect circuits 162.

Master Trigger Key

In addition to the six individual trigger keys 70 and the group trigger keys 300, 302, the SYNTHAXE instrument is provided with a master trigger key 204, shown in FIG. 5, which can be operated with the palm or 'heel' of the right hand. This key switch operates as though all six trigger keys 70 were depressed simultaneously, and this triggers all six strings at the same instant.

Left Hand Trigger Switches

There may be two left-hand trigger switches 200 and 202 on the body of the SYNTHAXE instrument, as shown in FIG. 5. They are parallel in function and operation, and have two modes:

(i) Fleeting, in which the left-hand trigger function only operates when the button is held down, and is automatically cancelled when the button is released, and (ii) Locked, in which the left-hand trigger function may be latched on, and will remain on until the button is operated a second time and unlatched from the left-hand trigger function. The latching may be mechanical but is preferably achieved electronically in processor 2.

One button 200 is mounted beside the top E string trigger key 70, and is operated by the small finger of the right hand when using the keys. The other 202 is mounted beside the top E string 50, and is operated by the small finger of the right hand when using the trigger strings. Either can be used, as is most convenient to the player.

When the left-hand trigger function is selected, it is not necessary to use either the trigger keys or the trigger strings to trigger a note. Instead, when the left hand trigger (LHT) mode is selected, a trigger signal will automatically be produced each time a new note is fingered with the left hand and a new pitch code is produced by the neck/fret system. A re-trigger will be initiated each time the finger moves from one fret to the next.

An open string will not produce a trigger signal (otherwise it would be impossible to control the triggering).

This feature allows very fast intricate passages, which are normally difficult when playing in the conventional two-handed way, to be performed with much more ease. Synchronisation of pre-setting the pitch with the left hand and triggering the string with the right hand is a matter of split-second timing. With the left hand trigger facility, players find an immediate improvement in their playing speed.

The trigger keys 70 and the trigger strings 50 are still active during the left hand trigger mode, and it is possible to achieve many two-handed triggering effects, and also to bring open strings into play in the middle of the left hand trigger runs if necessary. Also the master trigger key 204 can be used to effect a retriggering of all the strings.

The left hand trigger buttons simply produce a high or a low on a single digital line. This tells the Processor No. 2 which mode the player desires, and if the left hand trigger mode is selected, incoming pitch codes are monitored to generate trigger signals accordingly. Left hand trigger signals may be generated to simulate plucked or sustained trigger signals.

Other Input Controls

We have so far described the two most important controls for each string, namely pitch selection and note triggering. Before describing the operation of the output processor to these stimuli, we shall first described a number of auxiliary inputs which can be supplied to enable more sophisticated musical effects to be obtained.

String Bend Coils

As an alternative to using solely the frets of FIGS. 10 to 13 or 16–23, string bend information can be provided by coils beneath the pitch strings 40. The coils produce a varying voltage directly proportional to the lateral displacement of the string mounted above. The string bend signals obtained in this way can be used to modify or modulate the pitch slightly. A modifying pitch code is generated which is added to the basic pitch code.

This mimics the technique used by guitar players in the production of vibrato by holding the string down on a particular fret to produce a basic note value, and then pushing or pulling the string laterally across the fretboard in an oscillating action. This repeated change of tension in the string modulates the pitch or frequency of the basic note.

The string bend value can be manipulated within the processor system to provide the player with the string bend response of his choice. Parameters may be set to allow him to preset the amount of pitch change for a given lateral string movement. String bending can therefore be as subtle, or as coarse as the player wishes—and the law of string bend pitch change to lateral displacement can be modified as desired. For example, if the player wishes an initial predefined range of lateral string displacement to produce subtle increments of pitch change, but for the increments to increase outside this range, it is possible to preset the required law in software according to the player's wishes.

Figure 32:
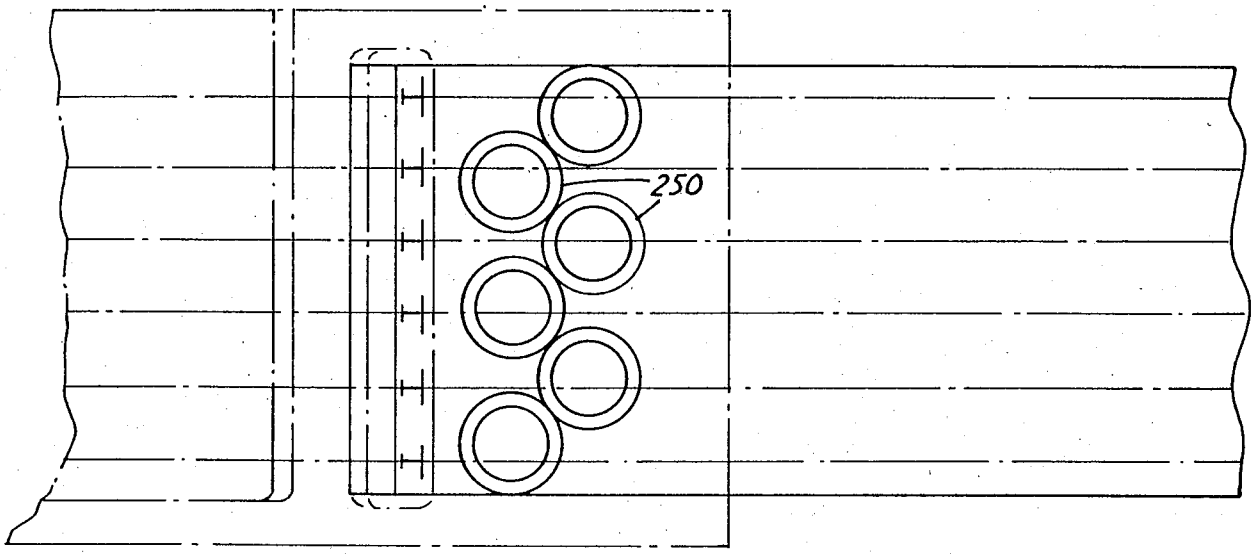
FIG. 32 is a front view of part of the fingerboard illustrating the string bend detector coils.
Figure 33:
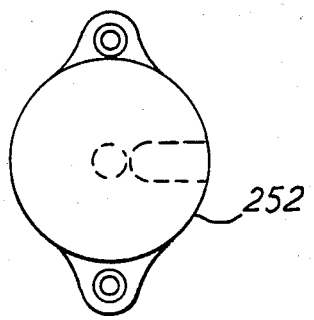
FIGS. 33 & 34 are top and side views of the coil former.
Figure 34:
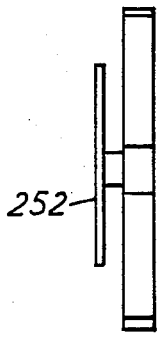

The coils 250 are illustrated in FIGS. 32 and 34. FIG. 32 illustrates the positions of the coils in the neck, and FIGS. 33 and 34 are plan and side views of the coil former 252. There is one coil associated with each string 40 and an array of the six coils is deployed in horizontal arrangement relative to the strings in two staggered rows beneath the strings 40, near the bridge.

The coils pick up the 64 kHz current which is directed down each pitch string in turn. A circular magnetic field therefore surrounds the active string and induces a voltage into the coil mounted under it. A typical coil may have some 3000 turns and is preferably provided with a resistive termination to damp oscillations within it.

The emf induced will depend on the vertical proximity of the string to the coil. This separation will clearly vary as different pitch selections are made on different frets for a given string—the closer the fingering becomes to the bridge, the less the separation between coil and string. Therefore string bending at higher fret positions will naturally produce greater outputs than at the lower positions for a given lateral displacement.

In a similar vein, a given lateral displacement at a higher fret position will also generate more output than from a lower fret position for reasons that are best expressed through triangulation. In effect the string bend detector is a string angle detector working on the angle included between the string rest position and the string deflected position seen in the horizontal plane. This angle will increase as the player operates towards the bridge end of the neck.

Both these aberrations are pitch related. Therefore a correction algorithm can if required be deduced whose factor, obtained from an appropriate look-up table in software, or indeed directly computed, for the last (and therefore still current) pitch value for that string, may be applied to the measured output of the string bend coil.

In practice, the small inaccuracies that occur because the resolution of the correction algorithm cannot exceed the resolution of the pitch determining system, are found to be operationally insignificant.

The outputs of the six coils are multiplexed into one common amplifier before sample and hold and digital conversion are performed. The multiplexer address is already known by the digital processing system as it will be the same as the active pitch string address. Multiplexing (i.e. switching in the appropriate coil at the right time) rather than using coils in a parallel or serial arrangment is desirable as the sensitivity of the coil is sufficient to cause measurable response from some distance away. Namely, string-one coil could pick up sizeable signals when string-six is active.

The phase sensitive nature of the output waveform (i.e. when sampled it goes from a positive limit to a negative one as the string progresses over the centre of a coil) allows a certain latitude in mechanical positioning.

In practice, any discrepancies that may occur can sensibly be obviated by a software routine in the digital processor which effectively normalises all readings it sees from the six coils on power-up.

Figure 35:
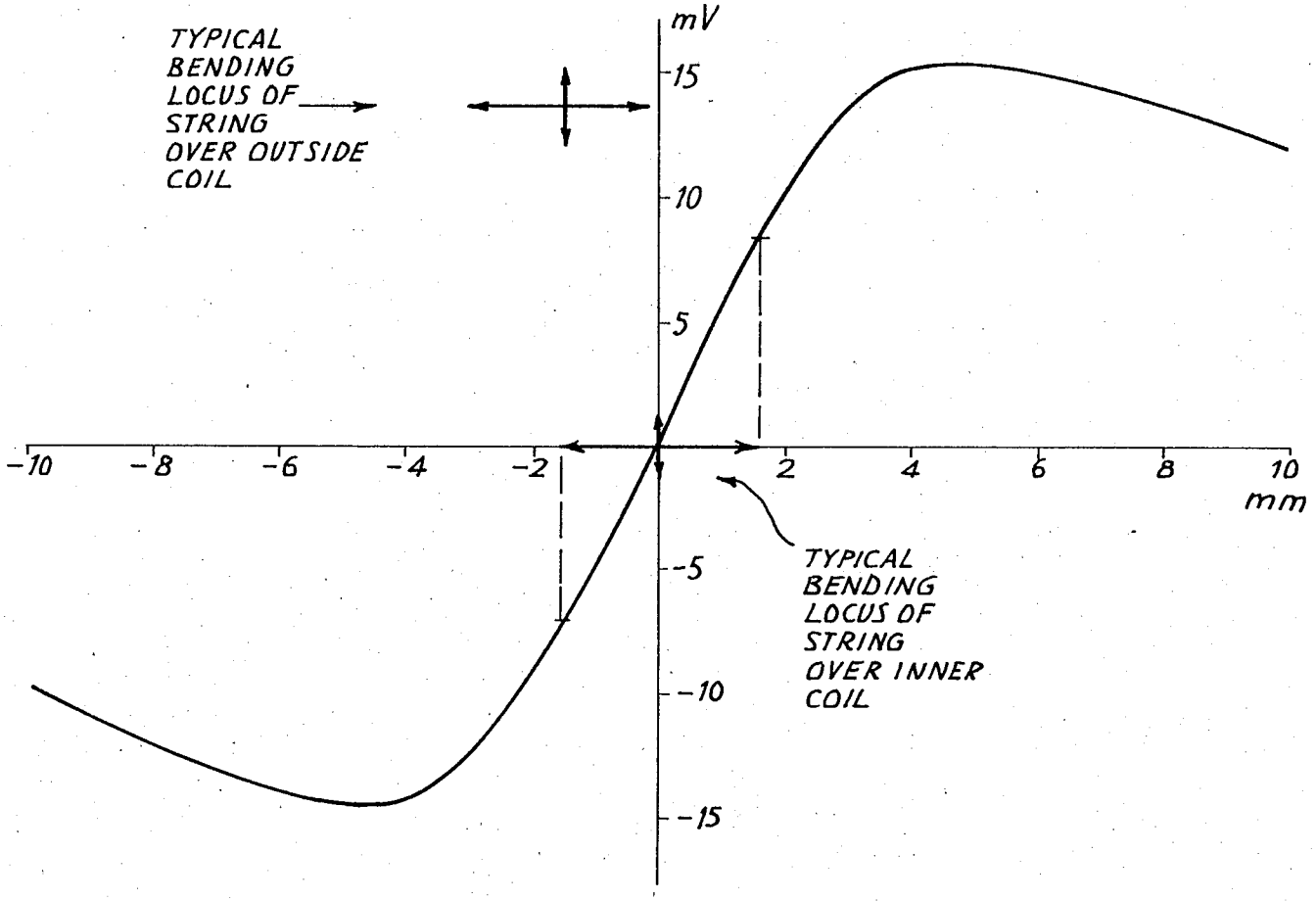
FIG. 35 illustrates a typical bending locus for one string bend coil.

The graph of FIG. 35 shows a typical bending locus for one string. It can be seen that the transfer characteristics are substantially linear over the operational range.

This demonstrates an advantage of using substantially large diameter coil assemblies.

An important feature of the SYNTHAXE is that the accuracy of the main pitch codes is not affected by string bending, and thus the separately-generated string bend codes can be used in selected desired proportions to modify or modulate the output.

Vibrato Arm

Each string on a conventional electric guitar is preset at the tension at which the string will produce the correct pitch. This is preset mechanically by the machine head. A limited range of variations of tension above and below the nominal tensions of the strings may be introduced by manipulating a vibrato arm. This facility can be used to produce a vibrato sound. The vibrato arm in a conventional guitar is mechanically coupled to each string by a spring loaded system which holds the vibrato arm and the strings in a state of equilibrium. The vibrato arm may, however, be "waggled" closer to or further away from the body of the guitar in order to produce variations in tension above and below the nominal tension in the strings, so producing variations in the notes produced by each string.

The SYNTHAXE instrument is provided with a vibrato arm 210 shown in FIGS. 5 and 7 which is also spring loaded to keep it in a state of equilibrium, but the variations in pitch which the vibrato arm 210 produces are controlled by digital codes output from a Hall effect integrated circuit mounted below the body of the instrument. The Hall effect IC produces an analogue signal which is converted into a string of digital values for manipulation by the control system. If the vibrato arm 210 is pressed down closer to the body of the instrument, a magnet is pushed closer to the Hall effect IC. If the arm is pulled away from the body, the magnet is moved further away from the Hall effect IC. The Hall effect IC produces analogue voltages related to the movements of the vibrato arm, and these voltages are converted into codes by processor 2. These codes are then used to produce desired variations in pitch by combining them within processor 2 with the basic pitch codes from processor 1.

Figure 36:
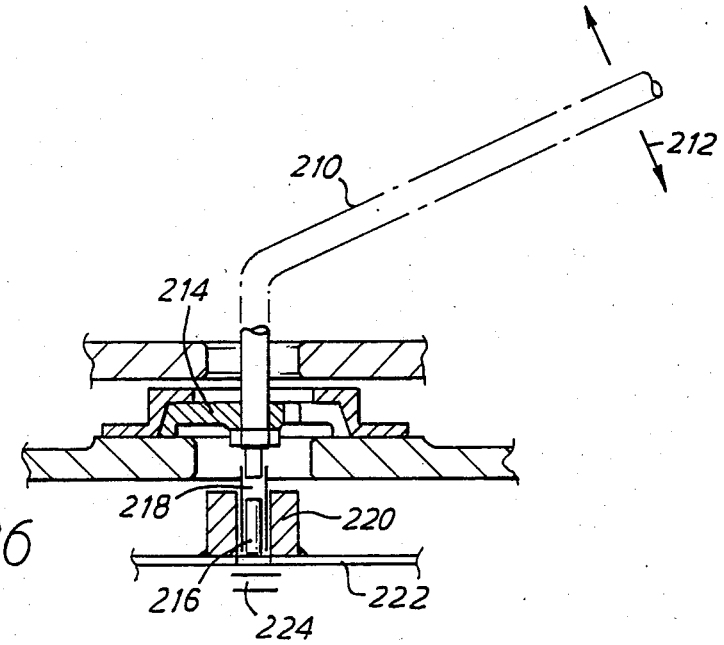
FIG. 36 is a sectional view through the vibrato arm mounting.
Figure 37:
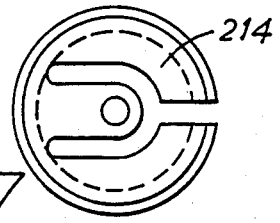
FIG. 37 is a plan view of a bush in the vibrato arm mounting.

The detailed construction of the Vibrato arm 210 is shown in FIG. 36. The arm is movable in the direction of the arrow 212 and is rotationally mounted in a flexible bush 214. A magnet 216 is coupled to the arm by a sleeve 218 and constrained by a magnet guide 220. The whole is mounted above a portion 222 of printed circuit board which carries a Hall effect integrated circuit 224. A plan view of the bush 214 is given in FIG. 37.

Neck Angle

It should be noted that the neck of the instrument is fixed to the body with the pitch strings 40 at an angle to the trigger strings, as shown in FIG. 5. The preferred angle is around 36°, though other angles may be found convenient anywhere in the range from 5° or preferably 15° up to 45° or so. It is found subjectively that the instrument is particularly comfortable and ergonomic to play with this angular offset.

It would alternatively be possible to pivot the neck 22 relative to the body 20. The pitch strings 40 can then be lined up with the trigger strings 50, in which case the instrument looks most like a conventional guitar. However, pivoting of the neck relative to the body allows the player to position the strings in a relative orientation which he finds most convenient to use. A suitable locking arrangement may be provided.

The Pedestal

The pedestal 12 provides a control console 32 at approximately waist height, as shown in FIG. 4, which can be operated by the player's hands while standing or sitting. This console provides various tuning and transposition functions.

Before fully describing the function of the pedestal 12, its worth noting the following points about the general tuning system. The initial pitch codes produced by each string are identical given an identical longitudinal position on the fretboard. If we consider the instrument to be configured like a conventionally strung and tuned guitar, the six open strings should produce the following musical intervals—E, A, D, G, B and top E. To form output codes which will produce the correct musical intervals, digital codes of varying values have to be added by Processor 2, to the respective initial string codes output from each string. For example, A is five semi-tones above E, and therefore the A string code will have to have a value corresponding to a five semi-tone difference added to the initial pitch code to produce the correct result. The top E string is two octaves, or 24 semi-tones above the lower E string, and so a 24 semi-tone code value will have to be added to the pitch code for that string.

Consequently, if a player wishes to play with an unconventional tuning, it is a simple matter of replacing the standard interval codes in the software with the variations required. The pedestal 12 provides various means for storing and initiating these variations.

Figure 38:
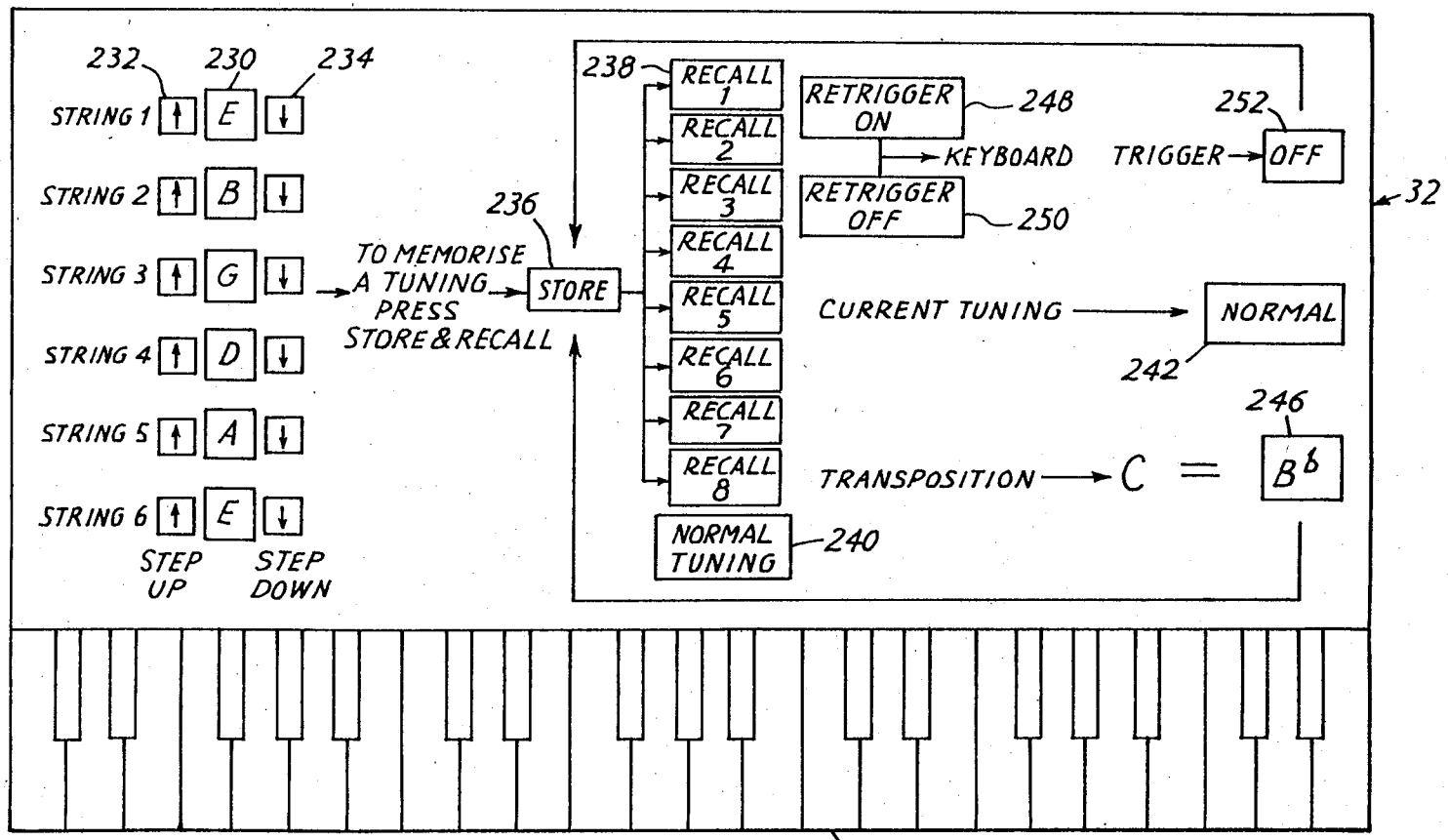
FIG. 38 is a view of a first console arrangement.

FIG. 38 shows one possible form for the layout of the console 32 of the pedestal 12. The console includes at the left six units for the six strings respectively, each including an indicator 230 showing the open string note and 'step up' and 'step down' pushbuttons 232 and 234 or other manually-operable actuators. A store button 236 is used to store the set of six open-string notes in one of eight memory locations as identified by eight recall buttons 238, which can be used to recall the stored settings. A button 240 selects normal tuning, and an indicator 242 indicates the tuning condition currently selected.

The conventional pitch intervals are also set as a 'default' in the software, and appear automatically on the displays 230 to show the current open string value of each string.

The individual string step up and step down buttons allow the player to increment in semi-tone intervals away from the conventional tuning. When he has the tuning he wants, he can store it along with a number of others. These can be recalled by using the recall buttons 238. If he wishes at any time to return to normal, he uses the normal button 240.

Transposition of the whole instrument is possible by implementing this method on a master basis rather than string by string. The eight preset tuning settings form a sequence, and keys 206 and 208 (FIG. 4) on the body 20 of the instrument can be used to go forwards or backwards in the sequence at will.

In order to transpose up and down octaves, octave up and octave down buttons (not shown) may be used, which will allow the SYNTHAXE instrument to encompass any pitch range available on a synthesiser.

There is also a two-octave piano keyboard 244 on this console. This is used for transposing the range of the SYNTHAXE instrument in chromatic increments, whilst maintaining relative tuning between strings. In the normal mode, the system is set so that the fret normally associated with middle C produces a middle C from the synthesiser. If the player now depresses the E above middle C on the keyboard, the SYNTHAXE codes will be moved up 4 semi-tones, and the middle C fret on the SYNTHAXE will now produce an E above middle C from the synthesiser. The transposition is also indicated on a display 246. To return to normal, the player depresses the middle C button.

Some unusual musical effects can be produced by holding chords with the left hand on the neck of the instrument, and using the keyboard 244 on the pedestal to play passages of block-transposed chords. In order to exploit this possibility, it would be possible to include a retrigger facility, which when activated will instruct the processor to initiate a retrigger every time the player depresses a key on the keyboard. To this end pair of buttons 248 and 250 marked RETRIGGER ON and RETRIGGER OFF respectively would be added. These buttons are related to the transposition function, and control the action of the triggering systems when a transposition is selected by operating the piano style keyboard 244.

If the RETRIGGER has been selected by depression of button 248, while a note is being played, then as the pitch control is switched to retune the note to the transposed value, the dynamic control will be reset and retriggered, so that on the instant of transposition, the transposed note will go through a completely new cycle of attack and decay. If the RETRIGGER has not been selected, then as the pitch control is switched to retune the note to the transposed value, on the instant of transposition, the new note will already be at the same point in the attack and decay cycle as the old one. The retriggering correlation is indicated by an indicator 252.

Figure 39:
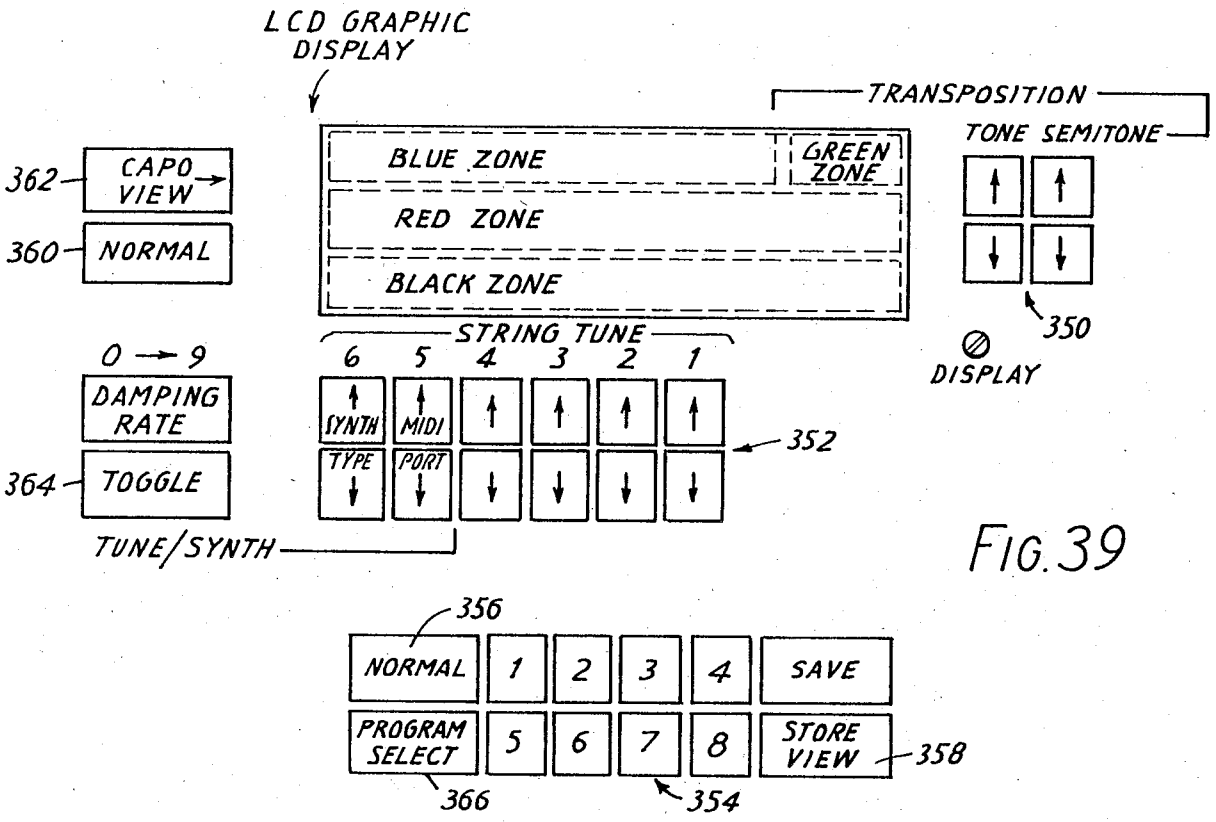
FIG. 39 is a view of a second alternative console arrangement.

An alternative console arrangement is shown in FIG. 39. In this case a variety of functions are offered as follows:

1. Tuning (a) Transposition—The 6 strings can be tuned as one entity, over the range of the target synth, by keys 350.

(b) Individual Strings—In semitone steps, over the range of the target synth, by keys 352.

2. Set ups

Eight or more independent non-volatile set ups can be entered by keys 354 and recalled at any time. The things remembered are tuning, transposition, capo setting, destination synth type and which output interface to drive.

The current tuning can be set to a default 'normal' by use of the 'normal' button 356. The tuning in a set up store can also be normalled.

The player can 'peek' into a set up store, without making its contents the current setting, using Store View key 358 and keys 354.

3. Miscellaneous control

Release (damping) rate can be set to a desired value. The range and type of control depends on the type of synth being addressed. The panel layout includes an LCD display divided into zones—blue, red, green and black. These display as follows:

1. Normal—(Key 360)

Red Zone=System report, including current synth type and the interface active.

Blue Zone=Flag and pedal states. Damping, capo on and hold.

Black Zone=String tuning in musical notation.

Green Zone=Transposition in semitones (+/−) within range of target synth.

2. Capo View—(Key 362)

Blue Zone=Capo values in musical notation, replacing the normal display all the while the capo view button is held.

Other zones are as normal.

3. Synth control:

The synth control page can be selected with the Synth/Tune Toggle button 364, and the whole display changes over to displaying the synth type currently selected and the interface selected, all this in much greater detail than the normal display. Alternate functions of the string 5,6 tune buttons are enabled, allowing the player to flick through the available synth types supported by the console unit, and to change the interfacing details. This setting can then be written into a set up store 1–8. Examining a store in this mode shows the synth type and interface patched in to that set up.

4. Program select—(Key 366)

The red zone will display the number selected, or nothing if no program change has been sent.

The Footpedals

Figure 40:
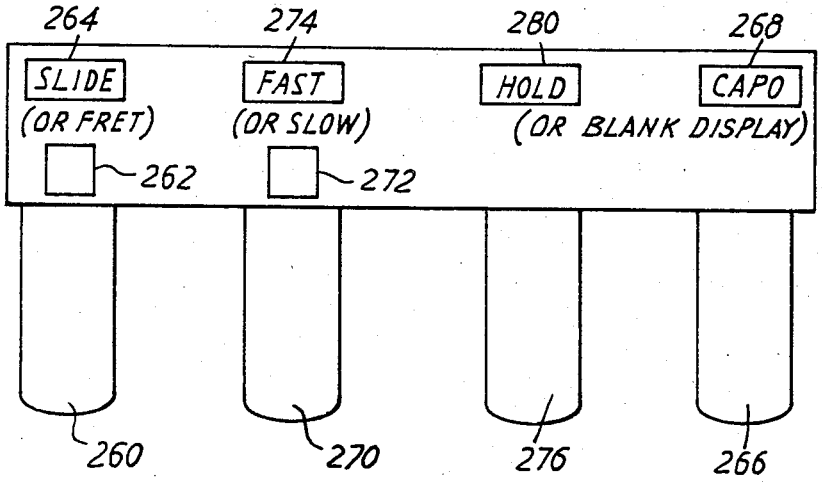
FIG. 40 is a view of the footpedals and associated indicators and switches on the pedestal.

The footpedals 30 are diagrammatically shown in FIG. 4. FIG. 40 shows them in more detail. There are four in number as follows:

1. Fret/Slide pedal 260

In one mode the pitch control is used to locate the semitone selected by the player, as in a guitar. This is termed the FRET mode of operation in that it is like the fretboard of a guitar.

Alternatively the player may select the SLIDE mode, which makes the instrument more like a violin in that it applies interpolation to increase the effective resolution of tones.

A switch 262 is used to indicate the normal one of the modes as selected by the player and this is indicated in an indicator 264. The pedal 260 is then used to switch temporarily to the non-set mode for so long as the pedal is depressed.

A signal is sent to Processor 2 to tell it whether the player wishes a violin mode, or a chromatic mode from the neck pitch codes, and the processor acts on the pitch codes accordingly. When the slide mode is selected, inertia software in the synthesiser or in processor 2 is enabled, whereas it is disabled in the fret mode.

2. Capo pedal 266

In conventional guitar usage, a Capo is a flat piece of metal, wood or plastic which is mounted on a bracket with a screw tension arrangement. If a guitar player uses open strings in a particular piece which renders that piece impossible in another key, he can transpose the open-string note values by screwing on the Capo across one of the frets, making the string length shorter for all the strings equally. He can vary the degree of transposition by choosing one fret or another, but only the frets between the Capo and the bridge remain effective. Therefore, the higher the transposition, the less effective range the instrument has.

The SYNTHAXE instrument produces Capo effects without the effort of having to screw on a Capo.

If the player wishes to simulate a Capo across the third fret, he presses all six strings down on the third fret (this is called a barre), and depresses the Capo pedal 266. The signal from the Capo pedal instructs Processor 2 to apply the appropriate logic.

Processor 2 uses the same transposition systems as before, except that they only apply to open string conditions. This produces the same result as a conventional Capo, except that it can be achieved much more quickly with the press of a pedal, with the added advantage that the player can use the complete fretboard above *and* below the Capo fret.

Also, the system is not limited to a straight Capo as in the mechanical version. The mechanical version has to be applied straight across the fretboard, holding all the strings down on the same fret. The SYNTHAXE Capo can register complex chord shapes and substitute these values on open string conditions. This brings many new possibilities to the player. When the Capo is selected, indicator 268 is illuminated.

3. Fast/Slow Decay pedal 270

This allows the player to choose how the contact of his hand with the pitch strings affects the dynamic performance of the synthesiser.

The plucking action applied to a guitar string is discussed above; the sustain perceived due to the slow decay of a stopped note depends on the player's hand remaining on the fretboard. However, if the player moves his hand from the fretboard, the decay of the note is brought to a premature end. This effect is produced on the SYNTHAXE instrument in conjunction with the Fast/Slow decay pedal 270.

The left hand and right hand string touch sensing circuits produce signals if either hand comes in contact with a pitch string or a trigger string respectively.

If a guitar string is physically touched without being firmly pressed against the fretboard, it is in an acoustically damped condition. If an open string is struck, will continue to ring (Slow Decay) until the energy in the string has been used up. If, during this Slow Decay, the player's hand damps the string, the note will come to a premature end (Fast Decay).

Similarly, if a player has a string pressed down on the fretboard and he plucks it, the string will ring so long as he keeps the string firmly pressed down on the board (Slow Decay). However, if he takes his finger off the board, the string will momentarily go through a condition where the finger is in contact with the string, but the string is not pressed down on the board. In this condition, the note which was previously on a Slow Decay will now be subject to a Fast Decay or premature damping action.

The Fast/Slow decay pedal 270 signals to Processor 2 whether the player wishes the synthesiser to react in one mode or another. If the Fast Decay is selected on the pedal, the control signals output by the SYNTHAXE instrument will instruct the envelope shaper circuits on the synthesiser to prematurely damp, by switching to damping rate preset in the console unit regardless of how slow is the nominal decay time selected on the envelope shape controls of the synthesiser. On preset sounds with an envelope shape similar to that of a plucked instrument, a guitar player will find that the instrument responds in the expected way. On the other hand, if he switches the pedal to Slow Decay, the premature damping instruction will be ignored, and the envelope shape will continue on its normal decay, regardless of the behaviour of the player's hands.

This means that the guitar player can now do something impossible on a conventional guitar. He can preset a chord with his left hand, trigger it, and move his hand away from the fretboard without any fear of damping the chord prematurely. While the chord is decaying, he can preset the next chord, and trigger when he chooses.

Each string may of course be individually controlled by either right or left hand, and the effects possible are considerably widened.

The player uses switch 272 to select either the fast or the slow mode as normal, and then depresses pedal 270 when he desires to change temporarily to the other mode. The current mode is shown by indicator 274.

4. Hold Pedal 276

When the automatic hold footpedal 276 is depressed, any notes then played are permanently sustained, even when the pedal is released. Any combination of strings can be put on 'hold' in this way. A string will be released from hold if it is retriggered, by the appropriate trigger key or string, or if the instrument is in the left-hand trigger mode, by selecting a new note on the fingerboard. If the hold pedal is depressed again all strings will be released from hold. An indicator 280 lights if any strings are on hold. Further details of the operation of the hold function can be ascertained from the described of processor 2 below.

Processors 2 and 3

As described above with reference to FIG. 24, the signal processing to provide an output for the synthesiser is undertaken by two processors, namely processors 2 and 3. Processor 2 provides the output and receives some control inputs directly and others after processing by processor 3, together with pitch codes from processor 1. Processor 3 is thus conveniently described first.

Processor 3

Figure 41:
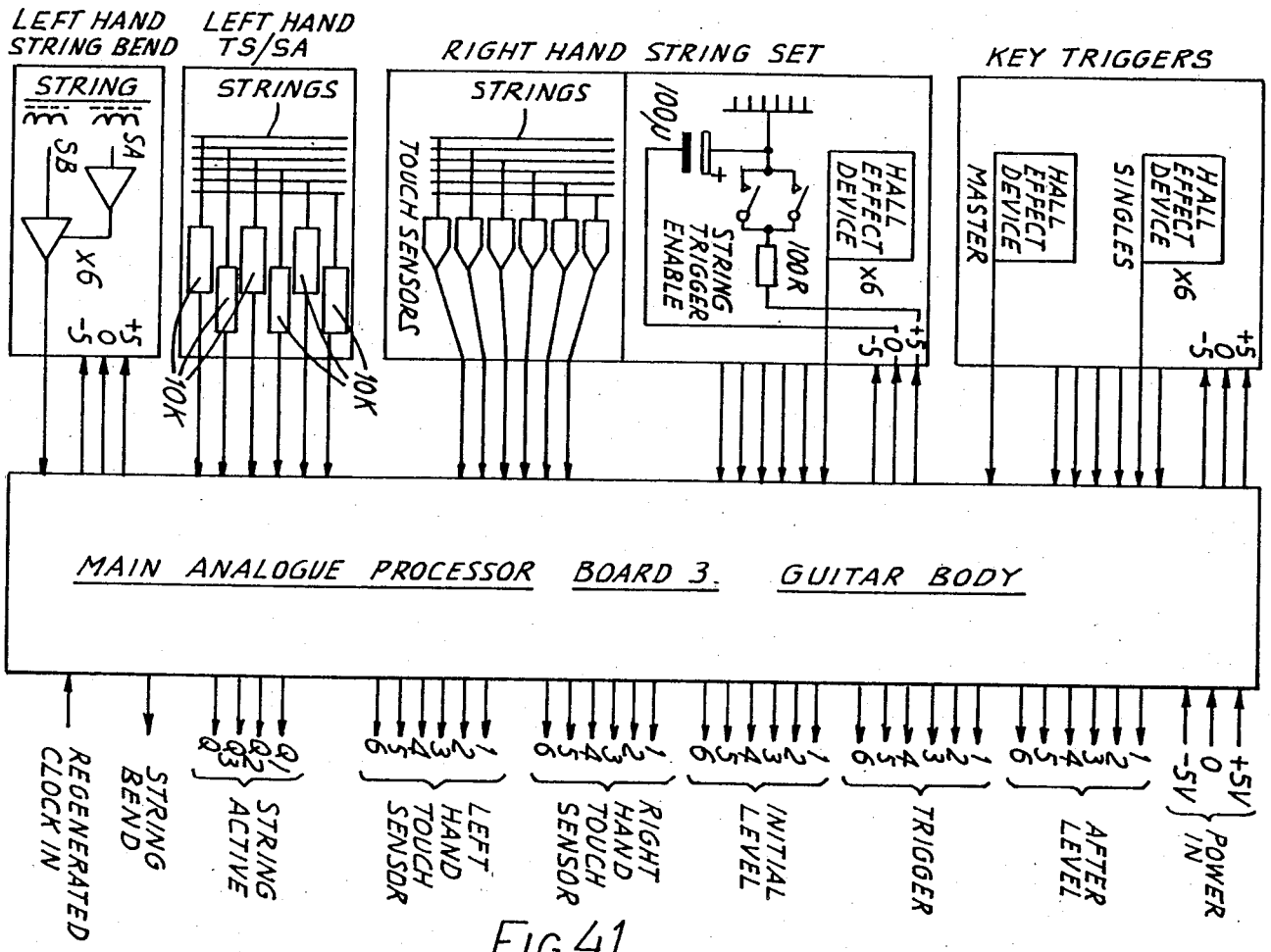
FIG. 41 is a block diagram of the analogue processor 3 showing its inputs and outputs.
Figure 42:
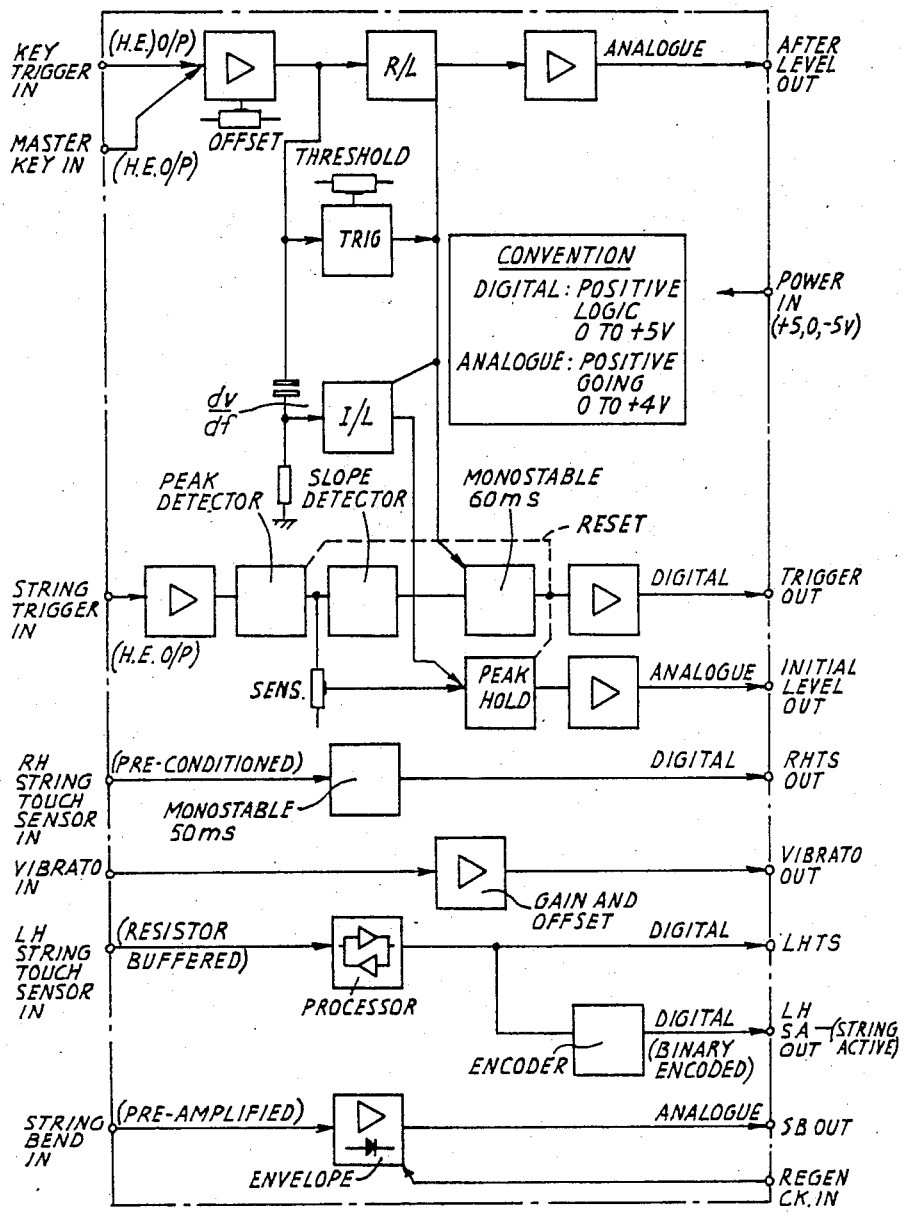
FIG. 42 is a block diagram schematically illustrating the internal functions implemented by processor 3.

This processor operates on the analogue input signals, in particular signals from the following:

(a) Vibrato arm
(b) String trigger—derivation of trigger and initial level
(c) Key trigger (including master key trigger)—derivation of trigger, initial level and after level
(d) Left hand touch sensing
(e) Right hand touch sensing
(f) String bend detection
(g) String active detection These functions will be described individually with reference to FIGS. 41 and 42, of which FIG. 41 shows the principle external connections to processor 3, and FIG. 42 illustrates schematically the internal functions which it implements.

(a) Vibrato Arm

The vibrato arm has a mechanical feel akin to that on an electric guitar but, of course, no alteration to the tension of Synthaxe strings is required. Instead, as the arm is moved against a string back-tension, a small cylindrical magnet is carried towards and away from a linear Hall-effect transducing element. The output of this element needs conditioning to provide variable gain, dc offset and some noise masking.

A straight-forward dual stage dc coupled operation is all that is required to process this signal. A dc offset is provided together with suitable amplification and high frequency filtering.

This voltage signal is then converted to a pitch code and added to or subtracted from the main pitch code in the manner described below.

(b) String Trigger

The design of the transducer on the string trigger assembly must detect motion of the trigger string 50. The conditioning which follows it must NOT react to the initial bending of the string, for this is NOT the action which a player would expect to create a sound. Instead, only when the deflected string is released to return eventually to its rest state must a trigger pulse be originated. Note that this trigger string itself could be struck in any possible direction (i.e. up, down or sideways) and equal results must ensue.

Also, the sensitivity of the system should not be such that extraneous triggers are generated by normal handling of the guitar. In practice, the sensitivity should be such that fingers can be lightly laid on the string set without creating triggers. Certain ruggedness in response to some external influences must also be considered.

It is also a requirement of this transducer system that a signal is separately generated which is an analogue of the deflection initially applied to a trigger string. This signal is referred to as INITIAL LEVEL. It could be used by the player for a number of purposes but clearly the obvious one is for it to set the initial loudness of the new note according to how hard the string was struck.

A number of other factors have to be considered in the design of the electronics which process the signal from the string trigger transducers.

Firstly, assuming the circuitry has determined that a string has been triggered, the trigger pulse generated must sustain sufficiently long for the processor to detect it and also to mask further triggers that may be caused by the string continuing to vibrate in its naturally damped oscillatory mode. However, time inhibits applied to the generation of subsequent triggers must not be so long as to cause undue delays for a player trying deliberately to create rapid triggers. The compromise is thought to be best at between 50–100 ms of masking before a new trigger can be generated.

Secondly, the initial level value must not vary for the duration of a trigger pulse. If it were to, such a condition would present confusion. This is not quite straightforward to achieve, for initial level can be measured from a string's movement either by detection of its maximum deviation when released, or by detection of its velocity as it passes through its reset position. In the SYNTHAXE, the former method is employed to register initial level but the latter method is used to determine whether the speed of movement is sufficient to justify a trigger state.

The input stage of the string trigger processor has a complex dynamic characteristic. It has a dual role in providing as much dynamic conditioning as possible and yet provide dc offset to allow for a maximum dynamic range on its output, bearing in mind the limitation of the 5 v rails.

Its behaviour is best seen from a transient viewpoint rather than a frequency response characteristic. The 100 nF input capacitor (FIG. 31) provides simple dc decoupling (the Hall-effect transducer would otherwise present about 2 v of offset) and more importantly excludes gradual changes from the system which might otherwise be introduced by unintentional movements of the trigger string. This then enables the dc mode to be that of voltage follower allowing the output to be set at approximately −2 v by use of a zener diode bias system for the non-inverting input. A 220 pF capacitor reduces the system gain at high rates of change and yet permits the amplifier to reach gains of around 50 dB where the encountered rates of change correspond with those from the hand operated string trigger transducers.

So, what leaves the transducer is a small negative-going pulse of rounded shape and what leaves the output of the preamplifier is a magnified positive going pulse (maybe several volts in magnitude) sitting on −2 v.

The next stage is "peak-hold". The output of this block follows its input and then holds the maximum voltage it reaches.

This held voltage is deemed to be a measure of the initial level and is presented via a level control (to match it with the initial level from the key triggers, q.v.) to a hold capacitor and hence through an output buffer to the processor 2. However, a finite time is taken whilst the string traverses to its maximum deflection and to prevent the initial level analogue voltage doing the same and leading to possible ambiguity later, the hold capacitor is kept shorted for this finite time.

Also following the peak hold detector is a "unipolarity slope detector". It responds only when the rate of change is positive, and when this rate of change exceeds a certain minimum value. This corresponds to the string flying back at its natural rate. This prevents spurious response to "knocks and bangs" on the guitar or accidental touching of the trigger strings.

Should this detector trip, then a "trigger" has been initiated. After the delay mentioned above, and via a buffer which converts the logic level to 0/5 v, the trigger pulse is delivered to processor 2.

The activated trigger string may well continue to oscillate under naturally or artifically damped conditions and on the next cycle may initiate another trigger. This could only happen if the transient vibratory mode of the string has a few successive peaks which continue to exceed each other before being damped off. Such a characteristic is dependent on the manner in which energy is put into the string by the pick or hand which plucks it. To prevent undue, or poorly timed triggers, a monostable (e.g. of 100 ms) is enabled by the first peak seen (providing it is fast enough) and this also has the advantage of producing a substantially long pulse which stands no chance of being missed by processor 2. Furthermore, it masks random peaks which occur immediately after the first one.

As the trigger pulse expires, the initial level hold capacitor is discharged to zero rapidly and the peak-hold capacitor is reset to the dc output voltage of the preamplifier (about −2 v) all ready for the next trigger action.

(c) Key Triggers

The trigger keys provide two additional features over those of the trigger strings.

These are the inclusion of the single MASTER key trigger 204 to activate all six triggers simultaneously, and the use of AFTER LEVEL. The differences in concept and realisation between the string and key triggers justifies the use of a completely different approach in the electronic conditioning necessary.

The conceptual difference is that trigger keys work on static conditions or gently varying conditions that may be effectively regarded as static, whereas the trigger strings function on dynamic conditions.

Thus once a key trigger is initiated, the key can be held "down" to maintain that initiation indefinitely. This cannot be so with string triggers. It will be realised that once a key trigger is activated, or rather, has passed its trigger threshold, it can be varied subsequently without detriggering. This variation can be used by the synthesiser to affect, say, loudness of the note being played. The trigger ceases once the key has been released above this threshold point.

The aim of the conditioning process in the electronics associated with the key trigger transducers is to reflect the above as precisely as possible and convert derived voltage signals into an appropriate interface standard for presentation to processor 2.

The arrangement of circuitry in the key trigger process is dissimilar from the string trigger except that, because the commands "trigger" and "initial level" are common to both systems, they are each combined before presentation to processor 2 which does not need to know which system originate the signal.

"After level" is a signal unique to the key trigger.

The main active block in this circuit is a triple operational transconductance amplifier which is characterised by a high impedance (or current) output and a gain determined by a small bias current into a control terminal. This current can be used to gate the amplifier on or off. The advantages of using an OTA here are its low power consumption, its excellent properties as a high speed comparator, the ability to wire-OR its output to another, that it can be strobed on or off and the component savings that result.

The input signals from the Hall-effect transducers under the trigger keys are amplified, dc zeroed and, with the Master trigger key signal added in, presented to the triple OTA's by the single operational amplifier stages.

The key triggers differ from the string triggers in that they must be considered as static (or gently varying) controls and therefore dc coupling is demanded. As a key is depressed a point is reached (trigger threshold) where the first OTA, wired as a comparator, trips. Its output is buffered and wired-OR to the string trigger output. The trip point is set by the preset control.

The trigger signal from the first OTA then strobes ON the other two, one for initial level and the other for after level. The latter signal will have a substantial dc component by this stage which would result in a sharp step as this stage turns on. To lose this, the non-inverting input of the after level OTA is returned to the same potential as the trigger comparator. When it turns on, then, its output is offset to just about zero as the key passes its threshold point. Further depression of the key then results in more output from this stage, which after buffering is presented to the Processor 2. Releasing the key results in this OTA being turned off, but the after level output would have returned to zero before that.

The initial level signal is the analogue of the rate at which the key is being pressed as its passes its threshold point. This signal is easily derived by a CR differentiation circuit on the input to the initial level OTA. This signal is held in the same circuit as was used for the string trigger initial level and consequently remains sensibly constant until the trigger is closed down.

(d) Left-hand touch sensing

The left-hand touch sensor circuitry has been described above and is illustrated in FIG. 25. It provides a conditioned output signal which is passed to processor 2 as one of a set of six lines representing the left hand touching any or all of the main pitch strings. Associated with this circuit there may be a string active detector, in a case where the string active detection is not provided by coils formerly part of the string bend detector.

(e) Right hand touch sensing

The string trigger set of strings is primarily used to initiate notes by plucking or striking as with conventional guitars. However, alternative and additional use may be made of them if they can indicate whether they are touched or not. A similar arrangement of circuitry is derived as for the left hand touch sensor, (d) above, and its role is to allow the player to damp down the system by touching the appropriate string(s), should he so wish, as an alternative to doing so by raising the fingers of his left hand above the threshold point for the main pitch strings.

The circuit of the right hand touch sensor is similar to that of the left hand touch sensor except that there exists no need for string active detection.

The main electronic components of the circuit are mounted on a board immediately beneath the string trigger assembly and deliver to the main analogue board a conditioned + and −5 v signal which just requires extending in duration to 50 ms and converting to 0/5 v logic before entering processor 2.

(f) String bend detection

The role of the analogue conditioning circuitry is to produce a steady state voltage directly related to the amount of string bending that has occured.

Because only one string is active at any one time, only one pitch bend coil can be used at any one time. The outputs of the six coils are therefore multiplexed together, sampled and held using a timing pulse derived from the main computer system, and presented back to the computer in a suitable dc form for processing.

When that string becomes activated with 64 kHz current as part of the main pitch determining operation, a signal is also induced into the pitch bend coil 250. Should this coil be precisely aligned with the string, then no output will result and a voltage only appears when the string is deflected slightly off the axis of the coil. In practice, perfect alignment is impossible to achieve but this is of no import for the main processor is able to apply correction algorithms. When the pitch string is untouched, it must also be that NO deflection is present, therefore, the output from the bend coil can be called normalised zero and calculations later made from that value as to how much string bending is going on.

The signal from a pitch bend coil is characterised by amplitude and phase. The former is an indication of how much bending is in evidence and the latter indicates which way the string has been bent.

Only one pitch string is active at any one time, therefore only one pitch bend coil will be producing signals at any one moment. The output from the six coils is therefore multiplexed on to one line using the string control address lines derived elsewhere for string active. This signal is buffered and filtered before being applied to a sample and hold detector.

The sample pulse is produced from the regenerated clock within the main computer and timed by monostables into duration and position. The position of the sample pulse is under the control of a preset resistor. The only other controls are for level. The output of the sample and hold integrated circuit is buffered before delivery to an input on processor 2.

Thus, the pitch bend output looks like a direct, steady-state voltage consisting of up to six interleaved signals from each of the detector coils corresponding to touched and active strings.

(g) String active detection (electronic)

As will be seen from the foregoing, a need exists within the system to detect which string is actually active (has the current passing down it). The main processor can confirm that a current driver switch has indeed stepped on when instructed to do so, and control signals for multiplexers can be derived. The string active circuitry operates closely with the left hand touch sensor system because it is there that a sample of the string condition may easily be made.

When a string becomes active, a simple detection circuit converts the small 64 kHz voltage which it sees to dc, and drives a 6-line to 3-line binary encoder. Thus binary string-active data is to be sent to the processors and to the string bend coil gating circuitry.

Each string returns its current through a 1000 nF capacitor which creates a small voltage drop. This 64 kHz signal is passed through the voltage follower of the touch sensor circuit via the 10 kohm isolation resistor and then tapped-off to the string active detector.

It is first amplified and then squared by an OTA before rectification and logic level conversion. The output of a buffer inverter stage which carries out this operation is fed, along with the outputs of the five similar stages, to a priority encoder block which converts these six signals to a binary-encoded three-line signal for presentation to processor 2.

Processor 2

As shown in FIG. 24, processor 2 receives data from the various transducers on the SYNTHAXE, its associated pedals and the manual controls on the pedestal via Processor 3, and the optimised neck code via processor 1. It processes this information, and sends control codes out to the interface 130.

The operational response to the various controls on the instrument, pedals and manual controls, and the resultant control codes transmitted to the synthesiser being driven by the SYNTHAXE is dictated by the way the SYSTEM LOGIC is written, and it is therefore possible to change the way the instrument operates by re-writing the software. The following description thus relates to one example only.

Figure 43:
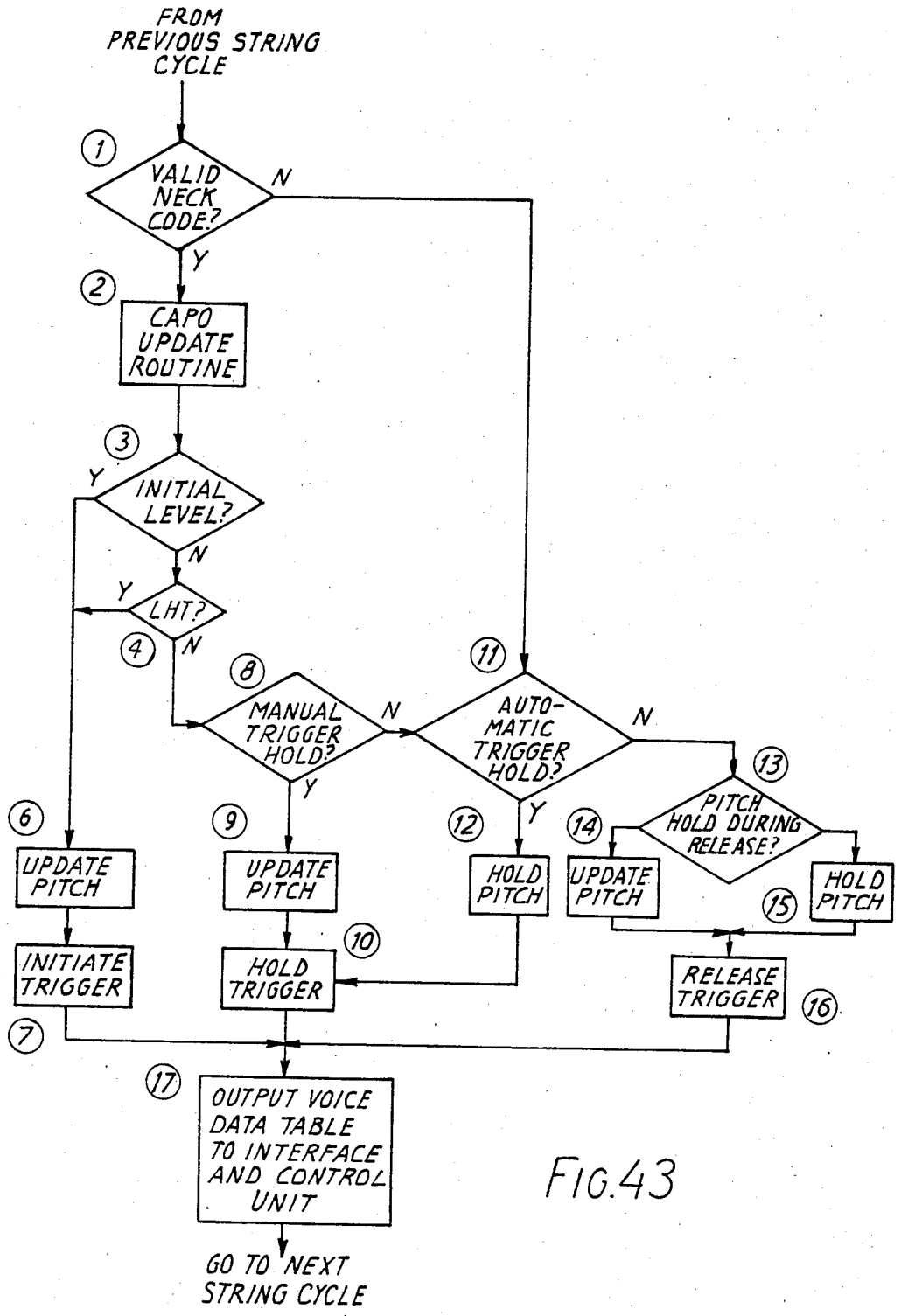
FIG. 43 is a general block flowchart showing the general routines followed by the system software.
Figure 44:
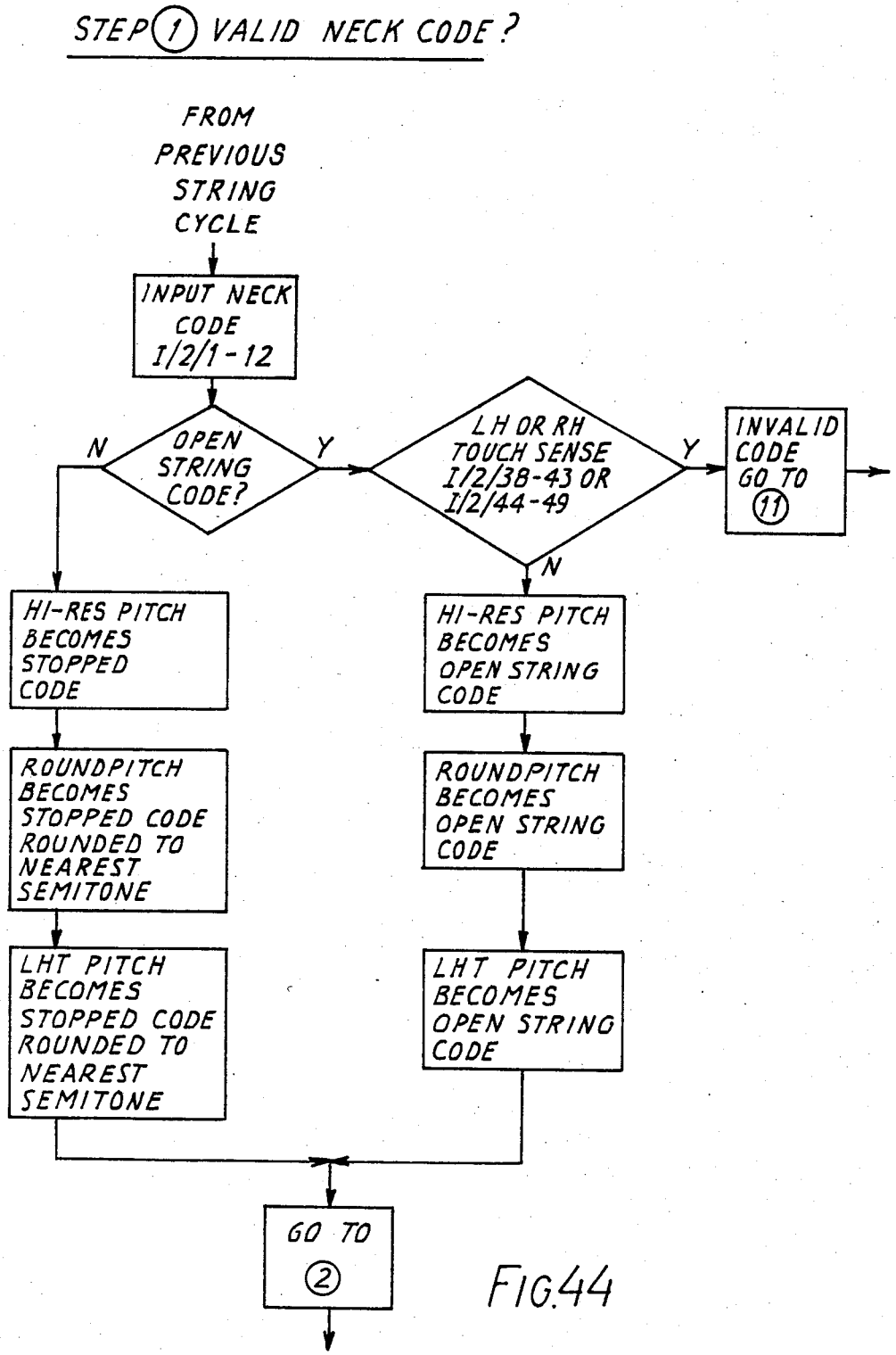
FIGS. 44 to 58 are individual flowcharts for the various stages shown in FIG. 43.
Figure 45:
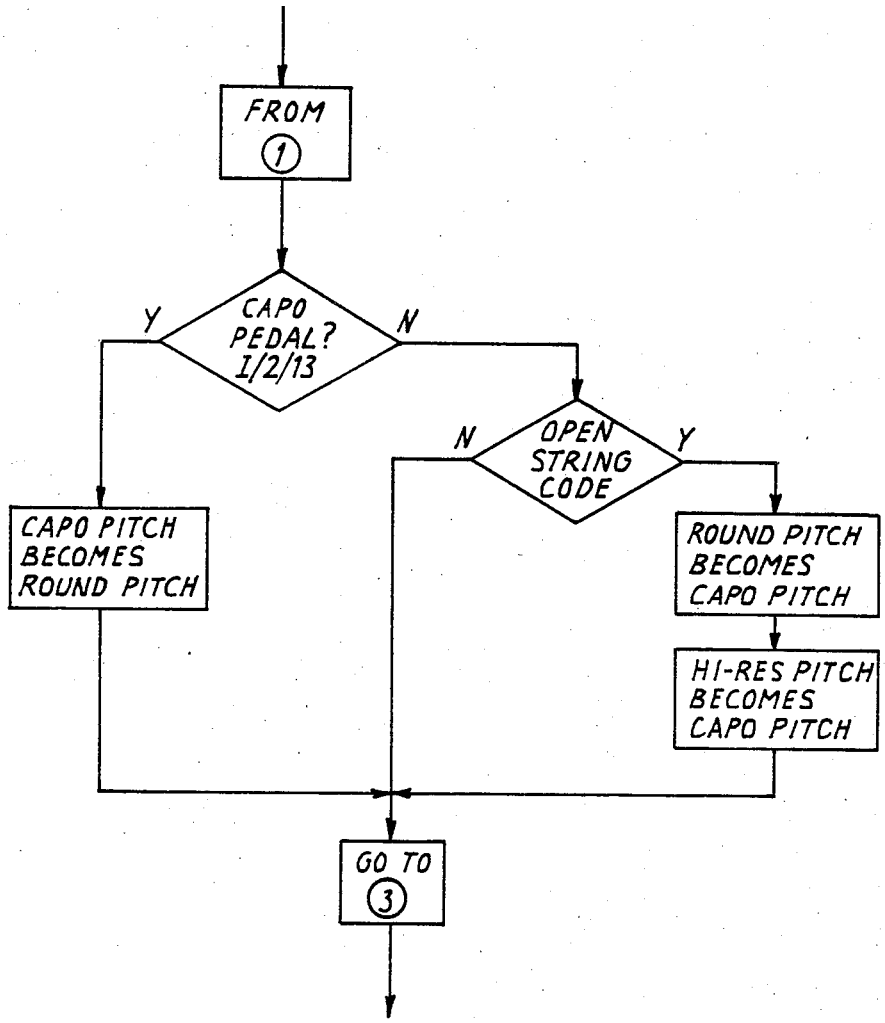
Figure 46:
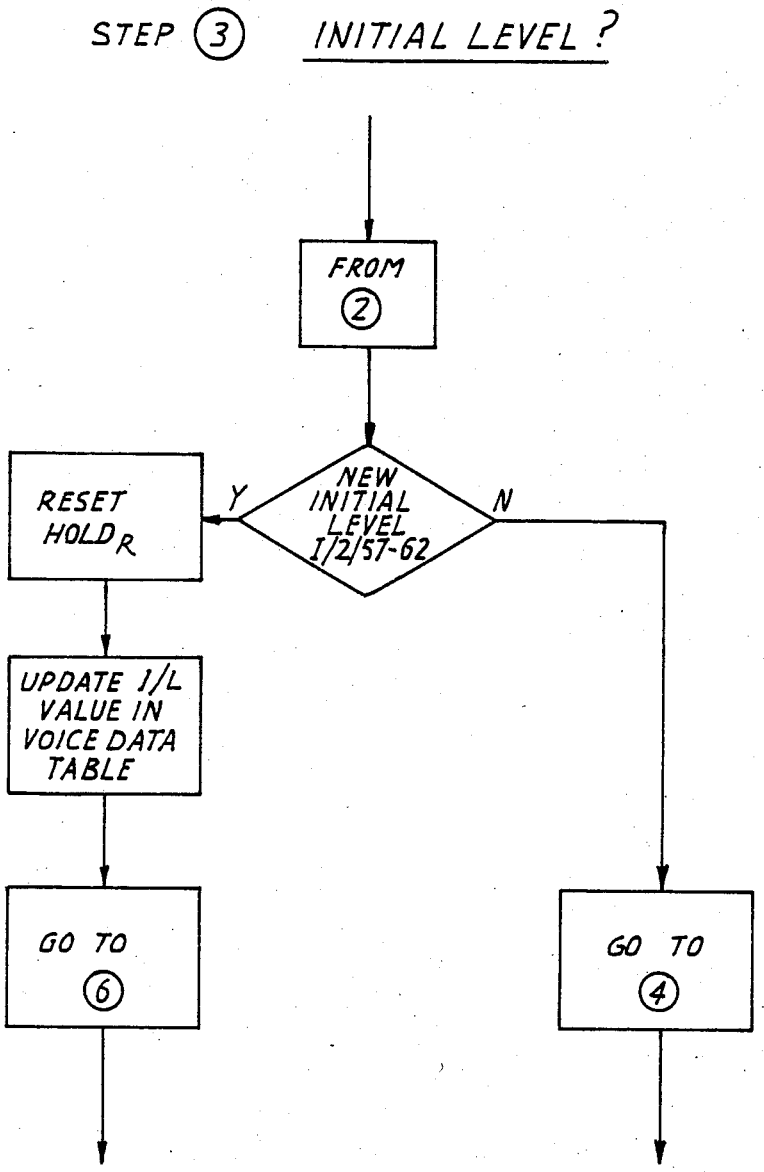

FIG. 43 is a general block flowchart showing the general routines and decisions that the SYSTEMS LOGIC will make with regard to one particular string on the SYNTHAXE. The same logic is repeatedly applied to each string on the instrument. Certain terms used in the following description are more fully explained in Appendix A below.

Each step on the general flowchart represents a decision or routine whose outcome will vary, depending on the variation of the states of a number of input parameters. Each logical step on the General Block Schematic is described in more detail in Appendix B.

The general system steps are as follows.

Step 1—Valid Neck Code?

The first logical step within a STRING CYCLE is to examine the state of the NECK CODE for a particular string. As well as examining the NECK CODE, the LEFT, and RIGHT HAND STRING TOUCH SENSORS are checked to see if a hand is in contact with the relevant right or left hand string.

Invalid Condition

If an OPEN STRING code is detected along with either a LEFT or RIGHT TOUCH condition (i.e. hand is in contact with string), then the NECK CODE is said to be INVALID, and the only possible logical conclusions to this STRING CYCLE will either be via step 10 (Hold Trigger), or step 16 (Release Trigger). Which of these routines is implemented depends on the decision made in step 11 (Automatic Trigger Hold). ps Valid Conditions If the NECK CODE is OPEN STRING, and the LEFT and RIGHT HAND TOUCH SENSORS are not detecting a hand in contact with the string, then the NECK CODE is VALID, and is said to be OPEN STRING value.

If the LEFT and RIGHT HAND TOUCH SENSORS are detecting a hand in contact with the string, but the neck is producing a PITCH CODE other than OPEN STRING (i.e. the string is making proper contact with the fingerboard), then the NECK CODE is also VALID, but will be one of a number of STOPPED values.

In either of these conditions, the outcome of Step 1 is to route the logical process immediately to Step 2. Ultimately, there are a large number of logical possibilities which will lead to either Step 7, 10 or 16 via a variety of routes, depending on the condition of other input parameters.

Step 2—Capo Update Routine

If the logical process is routed via Step 2, the NECK CODE must be VALID, but will be either STOPPED or OPEN.

During this routine, STOPPED CODES may be stored for subsequent implementation as CAPOVALUES, or OPEN STRING CODES may be replaced by previously stored CAPOVALUES.

Steps 3 and 4—Trigger Tests

These steps test for the conditions necessary for the SYNTHAXE SYSTEM LOGIC to INITIATE a TRIGGER.

A TRIGGER will be INTIATED if an INITIAL LEVEL signal is present (Step 3).

A TRIGGER will be INITIATED if the conditions for a LEFT HAND TRIGGER are satisfied (Step 4).

No Trigger Present

If none of these trigger tests are satisfied, then the logic will ultimately be routed either via Step 10 (Hold Trigger), or Step 16 (Release Trigger), and the means of getting there will vary, depending on the state of a number of other input parameters.

Steps 6 and 7

If the SYNTHAXE SYSTEM LOGIC decides that any one of the above TRIGGER INITIATION conditions are satisfied, then the logic must be routed via Step 6 (Update Pitch), and Step 7 (Initiate Trigger).

Step 8—Manual Trigger Hold?

A NOTE may have been TRIGGERED during a previous STRING CYCLE. This step tests for a possible HOLD condition.

A NOTE is HELD manually by either holding down the KEY TRIGGER on the SYNTHAXE or by continuously STOPPING the same fret in a LEFT HAND TRIGGER condition. either of these sets of manual HOLD conditions are satisfied, then the logic will ultimately be routed to Step 10 (Hold Trigger).

Step 11—Automatic Trigger Hold?

The logic routes to Step 11 from either Step 1 (INVALID CODE), or via Step 8 (No Manual Trigger Hold).

In either case, these are conditions which normally result in a RELEASE action (Step 16), unless a HOLDSTATE has been set during a previous STRING CYCLE by the operation of the HOLD PEDAL. HOLDSTATE may be set in either Step 7 or Step 10.

Step 11 tests for this HOLDSTATE.

If there is a HOLDSTATE, then the required NOTE is HELD automatically as the logic will now route via Step 12 (Hold Pitch), and Step 10 (Hold Trigger).

If there is no HOLDSTATE, then the normal RELEASE routine is implemented via Step 16.

Release Routine

Steps 13, 14 and 15 decide if PITCH CODES are to be updated during the RELEASE routine or not.

General Points

Pitch Updates

If a TRIGGER is to be INITIATED, then the PITCH CODE output to the INTERFACE and CONTROL UNIT must be updated.

If a TRIGGER is to be HELD or RELEASED, then the PITCH CODE output to the INTERFACE and CONTROL UNIT may or may not be updated, depending on the reaction of the logic to other input parameters.

Step 17—Output Voice Data Table to Interface and Control Unit

This Step is always implemented at the end of a STRING CYCLE, and is the logical outcome of all the changes in state of all the input parameters relative to one string.

The VOICE DATA TABLE is then output to the INTERFACE and CONTROL UNIT to implement the player's wishes.

The individual steps 1 to 16 are described in more detail in Appendix B below. Individual flow charts for these steps are given as FIGS. 44 to 58 respectively.

Interface Unit

The interface unit 130 (FIG. 24), located in the pedestal, houses the power supply, communicates with the footpedals, console and instrument, and outputs data to the synthesiser.

In particular, the interface unit receives the following signals: trigger, pitch, initial-level, after level, and release time (fast/slow), from processor 2. The interface unit 130 converts these signals into a form suitable for the synthesiser which is to be used. Separate circuitry may be provided for each of the 'voices' or channels of the synthesiser, in particular it is envisaged that one voice will be associated with each string of the instrument.

If the synthesiser is controlled by analogue, control voltages an analogue synthesiser, then the interface unit will make the necessary digital-to-analogue conversion to provide analogue voltages to drive the synthesiser. Where the synthesiser is digitally controlled, however, the interface unit will perform any necessary transcoding between the processor 2 output codes and the synthesiser input codes.

Throughout this specification the term "left" and "right" have been used in their conventional sense as for a right-handed player. For a left-handed player they would of course be reversed.

APPENDIX A

DEFINITIONS OF VALUES AND STATES PRODUCED IN PROCESSOR 2

CAPOPITCH

When a string is producing a STOPPED NECK CODE, and the CAPO pedal is pressed, the STOPPED value is stored in memory and is labelled CAPOPITCH.

When a string is producing an OPEN STRING NECK CODE, the CAPOPITCH is added to the OPEN STRING value in order to simulate the effect of attaching a mechanical CAPO to the neck.

There are six individual CAPOPITCHES, one for each string.

The system starts up with a zero value in CAPOPITCHES 1–6, and there will be no modification to OPEN STRING values until a non-zero CAPOVALUE has been input by the action of the CAPO pedal.

If the CAPO pedal has been on during a STOPPED code, the CAPOPITCHES are added to the OPEN STRING values producing CAPO effects.

To reset the CAPOPITCH to zero (i.e. to remove the CAPO effect), press the CAPO pedal while the string is OPEN and not TOUCHED.

FINALPITCH

INTERPITCH+VARIPITCH=FINALPITCH

HI-RESPITCH sub-semitone codes generated by inertia software from semitone codes.

HOLDPITCH

The ROUNDPITCH stored when HOLDSTATE is initiated by the HOLD pedal, and to be used as INTERPITCH, regardless of any changes in the NECK CODE until HOLDSTATE is reset by another operation of the HOLD PEDAL.

HOLDSTATE

If the HOLD pedal is pressed while a NOTE is played, the NOTE will be sustained indefinitely on the last VALID PITCH CODE until either the HOLD pedal is re-pressed, or the string being SUSTAINED is RE-TRIGGERED. In order to HOLD TRIGGER and PITCH signals, a state called HOLDSTATE is generated within the SynthAxe SYSTEM LOGIC if the HOLD pedal is pressed while a TRIGGER signal is INITIATED or HELD. HOLDSTATE is tested before DE-TRIGGER routines, and if HOLDSTATE is set, the DE-TRIGGER routine will be by-passed. To reset HOLDSTATE, and thereby return to a DE-TRIGGER routine, a fresh TRIGGER must be INITIATED with the HOLD pedal unpressed, or the HOLD pedal must be re-pressed.

INTERPITCH

FINALPITCH output to the INTERFACE and CONTROL UNIT includes all pitch modifying parameters.

Before FINALPITCH is computed, the basic pitch value may be derived from a variety of sources (HI-RESPITCH, ROUNDPITCH, CAPOPITCH, HOLDPITCH) depending on the state of the SLIDE/-FRET, CAPO and HOLD pedals.

Whichever of these values is finally implemented by the SynthAxe SYSTEM LOGIC is called INTERPITCH, and to the INTERPITCH value is added VARIPITCH (including STRING BEND, VIBRATO ARM, MASTER TRANSDUCER and INDIVIDUAL STRING TUNING INTERVAL codes), in order to derive FINALPITCH.

LHT HOLD

So that the LHT facility allows NOTES to be held as well as INITIATED, a state must be generated within the SynthAxe SYSTEM LOGIC called LHT HOLD. This is set (LHT HOLD) when an LHT is INITIATED, and remains set so long as a VALID CODE is maintained (string is in contact with the fingerboard). When the NECK CODE goes INVALID, LHT HOLD is reset.

LHT PITCH

When HI-RESPITCH is converted and stored as ROUNDPITCH, this rounded value is also stored separately with the label LHT PITCH. LEFT HAND TRIGGERS are INITIATED as a result of comparisons between current and previous rounded codes. Therefore, there would be scope for a certain amount of confusion if CAPO effects are required and CAPOPITCH values were substituted for ROUNDPITCH values. LHT PITCH is never over-written by CAPOPITCH, although ROUNDPITCH may be. This retains the integrity of the LHT system, even when CAPO effects are used.

ROUNDPITCH

HI-RESPITCH rounded to the nearest perfect semitone value.

VARIPITCH

The resultant of a number of values generated by the STRING BEND, VIBRATO ARM, MASTER TRANSPOSITION and INDIVIDUAL STRING TUNING INTERVALS. VARIPITCH is added to INTERPITCH to produce FINALPITCH.

APPENDIX B

LOGIC STEP 1 (FIG. 44)

The current NECK CODE is examined.

The code is tested for OPEN STRING value.

NOT OPEN STRING BRANCH

The PITCH CODE is therefore a STOPPED CODE. The PITCH CODE is also in its corrected HI-RESOLUTION form, having come straight from PROCESSOR NO 1. This current HI-RESOLUTION PITCH CODE is stored in an area of memory labelled HI-RESPITCH. The previous cycle's HI-RESPITCH is also stored in the SYNTHAXE SYSTEM LOGIC memory for comparison with the current HI-RESPITCH in subsequent steps during this STRING CYCLE.

As the SYNTHAXE SYSTEM LOGIC has not yet deduced whether it will need to implement a HI-RESOLUTION PITCH CODE, or a ROUNDED PITCH CODE, it now proceeds to ROUND the current HI- RESPITCH, and store it separately under the label ROUNDPITCH. The previous cycle's ROUNDPITCH is also stored in memory for comparison with the current ROUNDPITCH later on in this STRING CYCLE. Also note that the logic may use both the HI-RES and the ROUND versions of the PITCH CODE for different functions during the same STRING CYCLE.

As ROUNDPITCH may be replaced by CAPOPITCH under certain conditions (see Step 2), the current ROUNDPITCH is also stored under the label LHTPITCH. This is used in conjunction with the previous cycle's LHTPITCH to decide whether an LHT TRIGGER INITIATION should be implemented. This measure avoids any possibility of misinterpreting a substituted CAPOPITCH with the previous cycle's ROUNDPITCH in relation to LEFT HAND TRIGGER decisions (see Step 4).

The logic is now routed to Step 2.

OPEN STRING BRANCH

If the String is OPEN, the logic now tests to see if either the LEFT HAND or the RIGHT HAND STRING TOUCH SENSOR is active.

Invalid Code

If either is active, the PITCH CODE is INVALID, and the logic is routed to Step 11.

Valid Open String

The VALID OPEN STRING CODE is now stored in the areas of memory labelled HI-RESPITCH, ROUNDPITCH and LHTPITCH. The reasons for storing these values is as explained in the "Not Open String" description.

The logic is routed to Step 2.

LOGIC STEP 2 (FIG. 45)

Having established that the NECK CODE is VALID, the logic proceeds to test for an active CAPO PEDAL.

CAPO PEDAL ACTIVE

If the CAPO PEDAL is active, the current ROUNDPITCH value is stored in an area of memory labelled CAPOPITCH. CAPOPITCH is only updated when the CAPO PEDAL is pressed in conjunction with a VALID NECK CODE (either OPEN or STOPPED). CAPOPITCH is used on subsequent STRING CYCLES in order to introduce CAPO effects during OPEN STRING conditions. CAPO effects may be cancelled by operating the CAPO PEDAL during a VALID OPEN STRING condition, thereby storing an OPEN STRING CODE in CAPOPITCH. The SYNTHAXE SYSTEM LOGIC is written so that the system fires up with an OPEN STRING value already in COPOPITCH.

CAPO PEDAL NOT ACTIVE

If the CAPO PEDAL is not active, then the logic tests to see if the string is OPEN.

If the string is OPEN, then the OPEN STRING CODE is replaced by the last stored CAPOPITCH value, thereby introducing a CAPO effect.

If the string is not OPEN and the CAPO PEDAL is not active, there are no CAPO related parameters to be updated or implemented, and the logic is routed to Step 3.

LOGIC STEP 3 (FIG. 46)

Having established that there is a VALID NECK CODE, and that the CAPO UPDATE ROUTINE has been implemented, the next stage is to test for a TRIGGER INITATION.

The first TRIGGER INITIATION test is Step 3—Initial Level Present?

An INITIAL LEVEL signal can be produced by either the STRING TRIGGER, or the KEY TRIGGER, and is routed to PROCESSOR NO 2 on a common set of lines via Board No. 3.

INITIAL LEVEL is always produced at the beginning of a TRIGGER action on either the STRING TRIGGER or the KEY TRIGGER, and the presence of this signal within the SYNTHAXE SYSTEM LOGIC is the first condition which will lead to a TRIGGER INITIATION. Of course, the INITIAL LEVEL signal will not "happen" for a neat period of time co-incidental with a particular STRING CYCLE. It will therefore be necessary for the system to keep a note of the performance of the INITIAL LEVEL signal relative to time, to know when a new INITIAL LEVEL signal should properly lead to a TRIGGER INITIATION, and not to confuse this condition with the "tail end" of an old INITIAL LEVEL signal, thereby causing an unwanted repetition of the TRIGGER INITIATION routine. This requirement is inferred by the question in the decision box on the Step 3 flowchart—New Initial Level?

INITIAL LEVEL PRESENT

First of all the LHT HOLD state must be reset. How LHT HOLD is set, will be discussed in the next Step (4).

If there is a new INITIAL LEVEL present, the logic will ultimately proceed to Step 6, but before it does so, there is one more routine to be performed.

Apart from inducing a TRIGGER INITIATION, the INITIAL LEVEL signal is an analogue voltage which is converted into a range of codes which may be used to control a variety of parameters on an external synthesiser. Consequently, before proceeding with the TRIGGER INITIATION the INITIAL LEVEL CODE must be stored in the VOICE DATA TABLE for output to the INTERFACE and CONTROL UNIT at the end of the STRING CYCLE.

The logic is then routed to Step 6.

INITIAL LEVEL NOT PRESENT

If there is no INITIAL LEVEL present, the logic is routed to Step 4 to test for the next possible TRIGGER INITIATION—a LEFT HAND TRIGGER condition.

Figure 47:
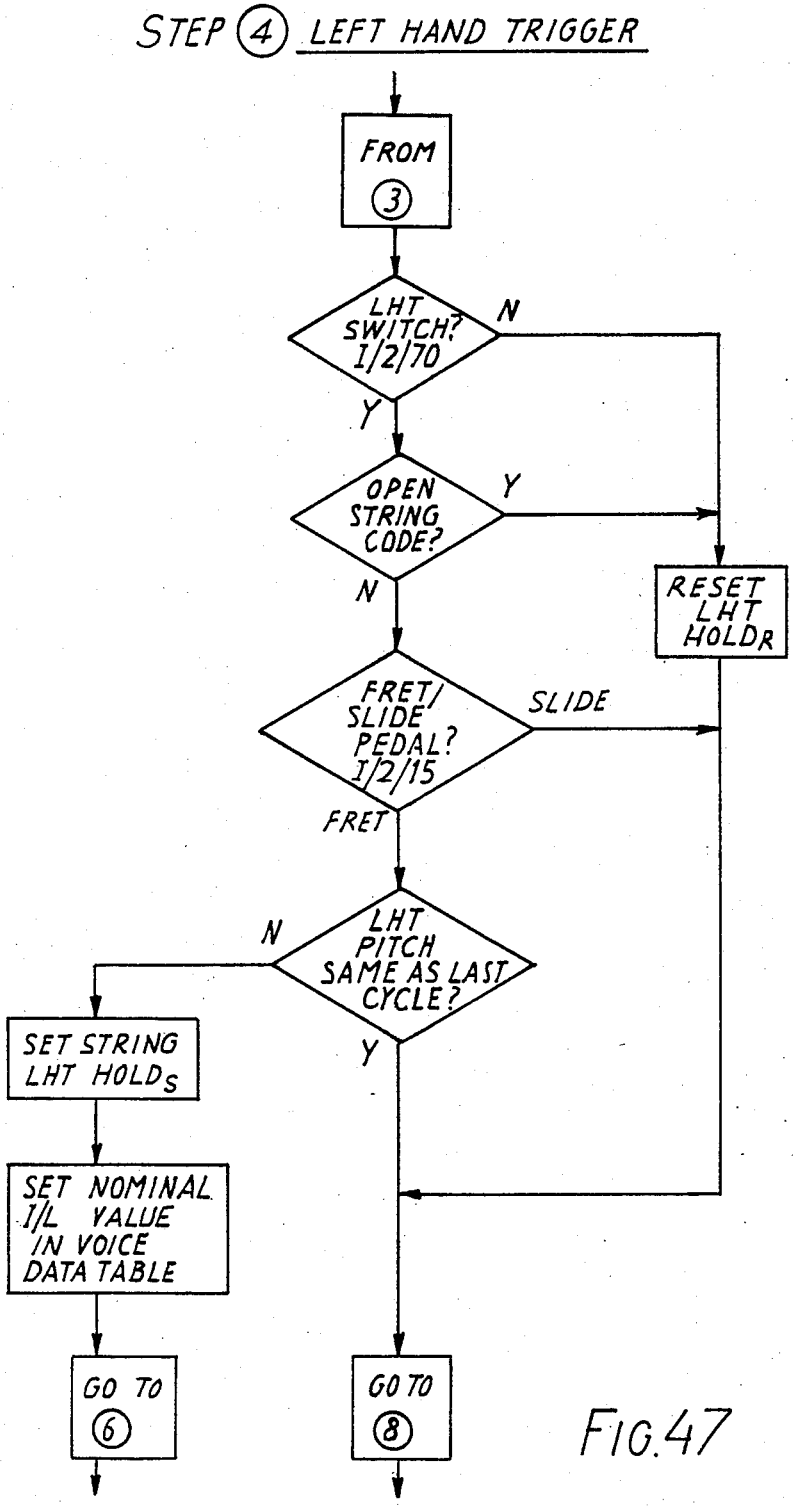

LOGIC STEP No. 4 (FIG. 47)

Having come from Step 3, the NECK CODE must be VALID, (it could be either STOPPED or OPEN), and the INITIAL LEVEL signal does not satisfy the conditions for TRIGGER INITIATION.

Step 4 tests to see if the LEFT HAND TRIGGER parameters warrant a TRIGGER INITIATION.

LHT SWITCH?

First of all, the LEFT HAND TRIGGER switch on the SynthAxe body is tested to see if it is active.

LHT SWITCH INACTIVE

If the LHT SWITCH is not active, LEFT HAND TRIGGER is not required, and the logic will be routed to Step 8.

However, in this branch there is one task to be performed before proceeding to the next test. There is a state within the logic called LHT HOLD, which decides if a NOTE TRIGGERED by the LEFT HAND TRIGGER should be HELD or not. This is one of the Manual Trigger Hold states defined in Step 8, and the conditions for creating an LHT HOLD within the logic (thereby HOLDING a LEFT HAND TRIGGER NOTE) will be discussed in detail with the rest of Step 8.

In Step 4, it may be necessary to clear down a previously set LHT HOLD, and one of the conditions which will cause a clearing down of this state is the inactive state of the LHT SWITCH.

As we have just tested for an LHT SWITCH, and as it has proved inactive, the player is not using the LEFT HAND TRIGGER facility, and any previous LHT HOLD should therefore be cleared down. Consequently, the logic resets LHT HOLD, and proceeds to Step 8.

LHT SWITCH ACTIVE AND OPEN STRING CODE

The LEFT HAND TRIGGER facility only works with STOPPED CODES.

Therefore, an OPEN STRING CODE produces the same result within the logic as when the LHT SWITCH is inactive.

LHT SWITCH ACTIVE AND NOT OPEN STRING

To come down this branch of the logic, the NECK CODE must be VALID. Therefore, if the NECK CODE is NOT OPEN, it must be STOPPED.

FRET/SLIDE PEDAL?

The LEFT HAND TRIGGER facility only INITIATES TRIGGERS from the FRETTED mode (semitone steps). Therefore, if the pedal is in the SLIDE mode, the logic bypasses the possibility of a TRIGGER INITIATION, and routes itself to Step 8.

However, it is possible to be HOLDING a NOTE which has been INITIATED by the LHT facility, and to switch to SLIDE during the HOLD period, thereby changing the PITCH while HOLDING the NOTE—without RE-INITIATING TRIGGERS. For this reason, the sensing of the SLIDE condition does not cause LHT HOLD to be reset like the OPEN STRING or the LHT SWITCH NOT ACTIVE conditions just tested.

LHT PITCH CODE SAME AS LAST CYCLE?

Having established that the LHT SWITCH is active, the NECK CODE is STOPPED, and that the FRET mode is active, the logic tests further to see if a TRIGGER INITIATION is required.

YES

The current LHTPITCH (stored during Step 1), is compared with the LHTPITCH from the previous cycle. If it is the same, then the player's finger has been resting on the same fret for at least one STRING CYCLE, and he is HOLDING the NOTE. Therefore, no TRIGGER INITIATION is required on account of the LEFT HAND TRIGGER facility, the LHT HOLD state is maintained (no reset), and the logic goes to the next trigger test—Step 8. NO If the current LHTPITCH is different from that of the previous cycle, then the finger has STOPPED the string on a new fret since the last STRING CYCLE, and an LHT TRIGGER INITIATION is required.

The LHT HOLD state is set up within the logic, (to be examined in subsequent STRING CYCLES Steps 8 for maintenance of HOLD condition).

LEFT HAND TRIGGERS do not produce INITIAL LEVEL values, therefore a default value for INITIAL LEVEL must be output to the VOICE DATA TABLE at this stage.

The logic can now proceed to Step 6, and from there to Step 7 (INITIATE TRIGGER).

Figure 50:
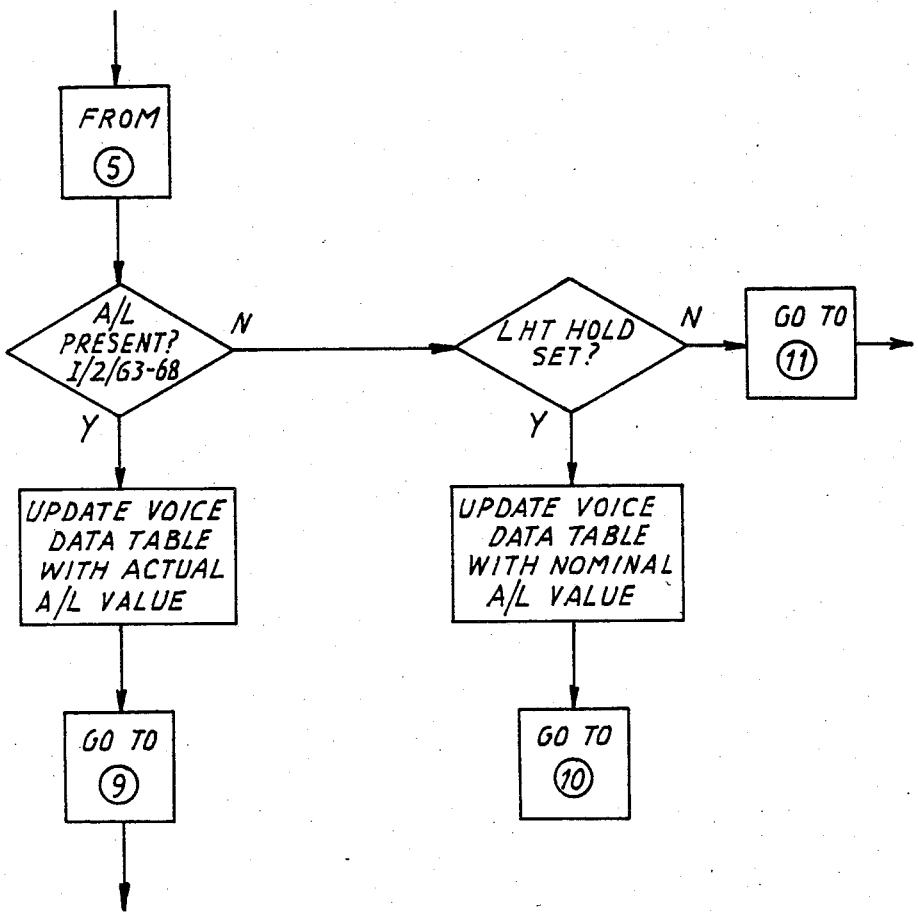

LOGIC STEP No. 8 (FIG. 50)

In order to arrive at Step 8, the NECK CODE must be VALID (it could be either STOPPED or OPEN), and neither the INITIAL LEVEL signal, nor the LEFT HAND TRIGGER parameters are in a condition to induce a TRIGGER INITIATION. The rest of this step is described below.

Figure 48:
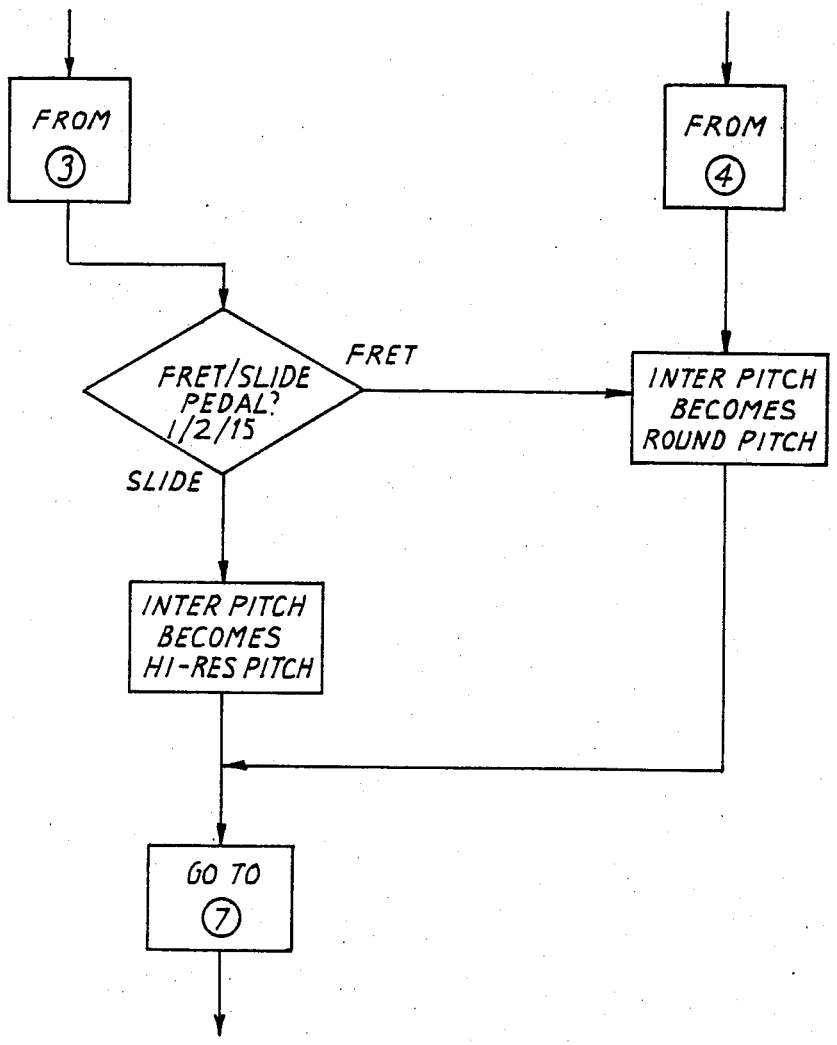

LOGIC STEP No. 6 (FIG. 48)

To get to Step 6, the NECK CODE must be VALID (it could be either STOPPED or OPEN), and either the INITIAL LEVEL signal or the LEFT HAND TRIGGER parameters have signalled the conditions necessary to produce a TRIGGER INITIATION.

The PITCH CODE must be updated in case of a TRIGGER INITIATION.

FRET/SLIDE PEDAL?

If the logic has come to Step 6 from Step 3, the FRET/SLIDE PEDAL is sensed to see whether the HI-RESPITCH or the ROUNDPITCH values should be used in INTERPITCH.

If the logic has come from Step 4, the FRET/SLIDE pedal has already been proved to be in the FRET condition, so there is no need to test again.

Having updated INTERPITCH, the logic is routed to Step 7.

Figure 49:
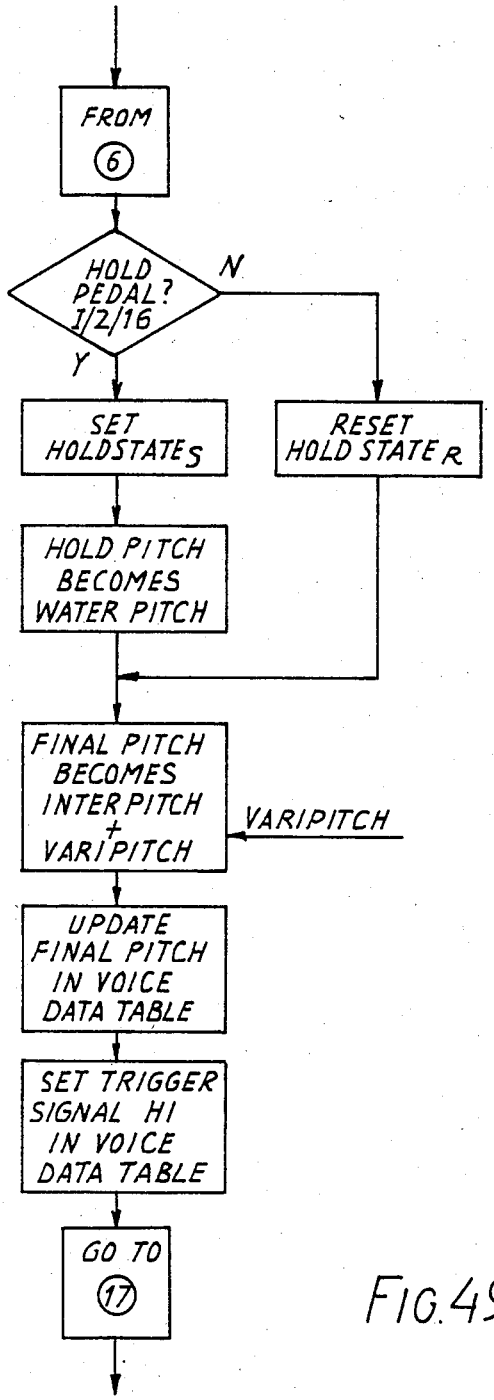

LOGIC STEP No. 7 (FIG. 49)

INTERPITCH has been updated, and TRIGGER is about to be INITIATED.

First the HOLD PEDAL is tested to see if it is active. When a NOTE is TRIGGERED or HELD when the HOLD PEDAL is active, that NOTE will be automatically HELD indefinitely during subsequent STRING CYCLES (subject to conditions defined in Step 11).

In order to maintain a NOTE in HOLD when it is not being HELD manually, a state is set within the software called HOLD-STATE.

Only two sets of conditions will reset a HOLD-STATE.

(a) When a new NOTE is INITIATED.

(b) When the HOLD PEDAL is switched on again after having been switched off since the setting of the last HOLDSTATE.

HOLD PEDAL?

YES

As the HOLD PEDAL is active, the player wishes to HOLD the current NOTE automatically. Therefore HOLDSTATE is set.

The current VALID NECK CODE (INTERPITCH) is stored in HOLDPITCH. HOLDPITCH is used in subsequent STRING CYCLES as the PITCH CODE of the NOTE which is to be automatically HELD (Step 12).

NO

As the HOLD PEDAL is not on, the player wishes to override any previously HELD NOTE on this string, therefore the HOLDSTATE is reset.

FINALPITCH BECOMES VARIPITCH

This is the final pitch modification including TRANSPOSITION, INDIVIDUAL STRING TUNING, STRING BEND and VIBRATO ARM variations.

The VOICE DATA TABLE is now updated with the new FINALPITCH and the TRIGGER INITIATION signal.

The logic is routed to Step 17.

LOGIC STEP No. 8 (FIG. 50) (continued)

In order to reach Step 8, the NECK CODE must be VALID (it could be either STOPPED or OPEN), but NEITHER of the TRIGGER conditions as defined in Steps 3 or 4 have been met.

This Step tests to see if a NOTE is to be HELD manually.

A/L PRESENT?

YES

In this condition, a NOTE INITIATED during a previous STRING CYCLE is being HELD by the TRIGGER KEY.

The A/L Level (pressure parameter) is output to the VOICE DATA TABLE, and the logic is routed to Step 9 to UPDATE PITCH and HOLD TRIGGER.

NO

The logic tests to see if an LHT HOLD state is set. (See Step 4).

YES

If so the NECK CODE must be STOPPED on the same fret as the previous STRING CYCLE, and the NOTE is to be HELD.

A nominal A/L level is output to the VOICE DATA TABLE, and the logic is routed to Step 10. There is no need for a PITCH UPDATE (Step 9) as the string must be STOPPED on the same fret as it was during the previous STRING CYCLE.

NO

If not, there is no manual TRIGGER HOLD, and the logic is routed to Step 11.

Figure 51:
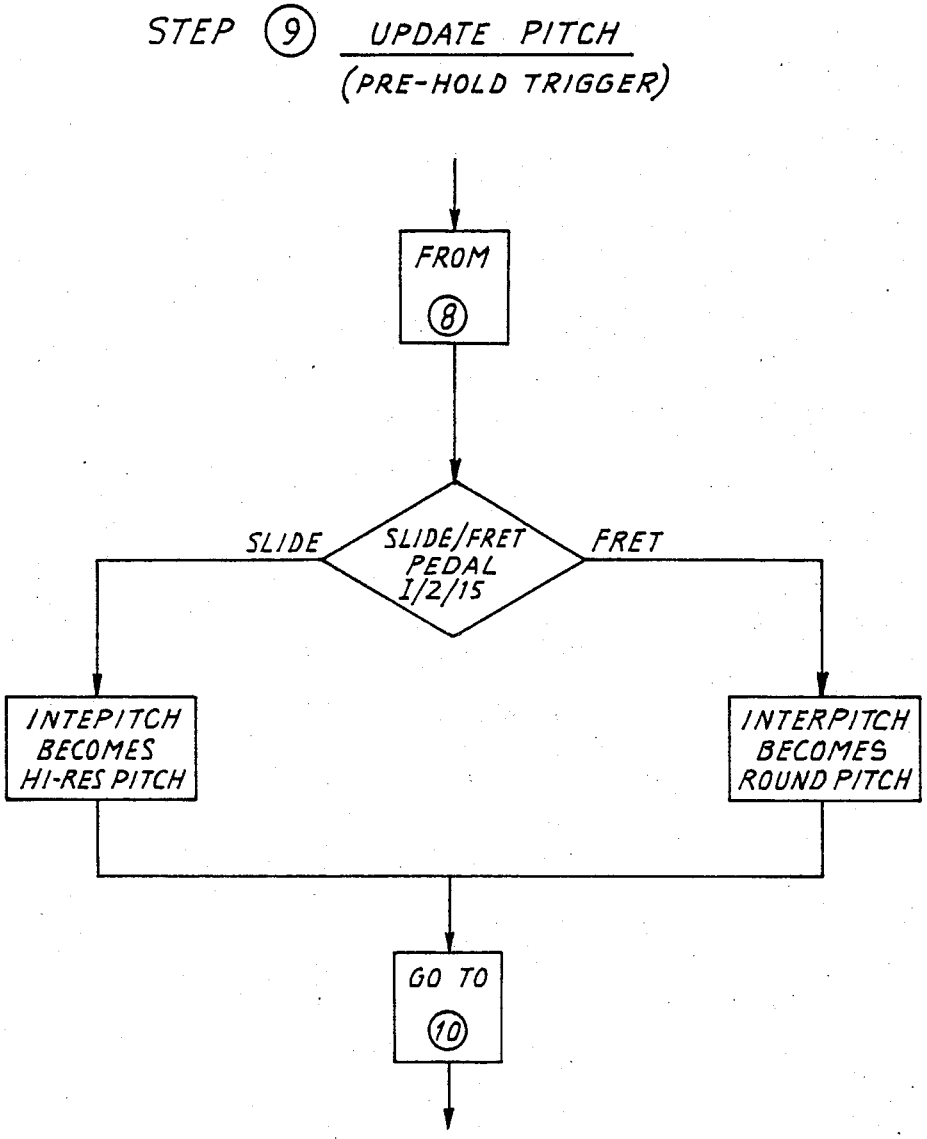

LOGIC STEP No. 9 (FIG. 51)

To get to Step 9, a NOTE is being HELD, but it is possible that the player wishes to slide the PITCH of the NOTE on the fingerboard while it is being HELD.

That is why it is necessary to have a PITCH UPDATE routine at this stage.

Before updating INTERPITCH, the logic tests the SLIDE/FRET PEDAL in order to see whether HI-RESEARCH or ROUNDPITCH should be used in updating INTERPITCH.

The logic is then routed to Step 10.

Figure 52:
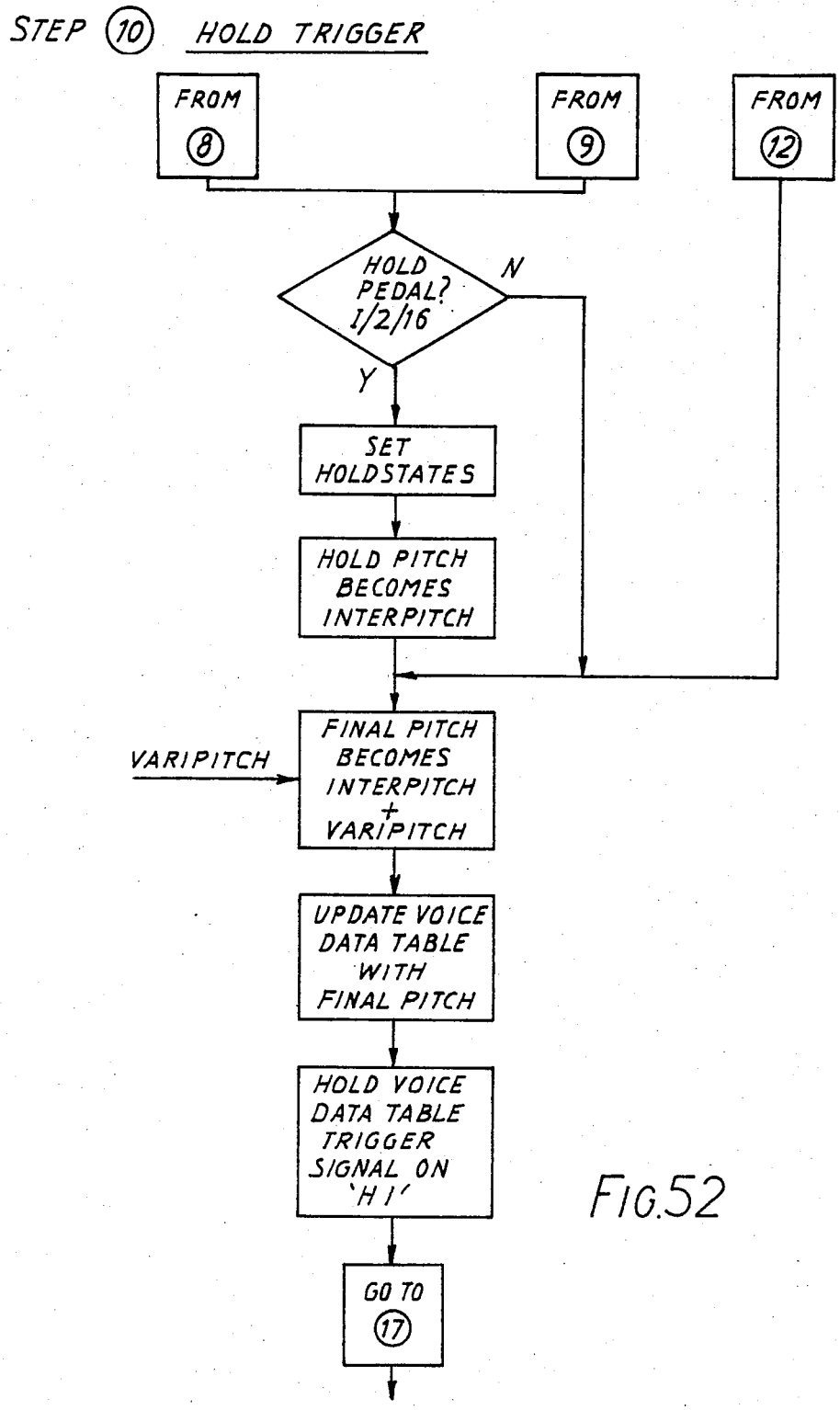

LOGIC STEP No. 10 (FIG. 52)

To get to Step 10, the NOTE is to be HELD as decided in either Step 8 or Step 11, and the necessary PITCH UPDATES have been performed in either Step 9 or Step 12.

Before the FINALPITCH and TRIGGER HOLD signals are output to the VOICE DATA TABLE, the HOLD PEDAL is tested. If the HOLD PEDAL is operated while a NOTE is being HELD, then HOLDSTATE will be set, and that NOTE will be automatically HELD until HOLDSTATE is reset.

When HOLDSTATE is set, the current INTERPITCH is stored in HOLDPITCH for use in subsequent Steps 12 during automatic HOLD.

If the HOLD PEDAL is not active, then the set HOLDSTATE and overwrite HOLDPITCH routines are bypassed.

Figure 53:
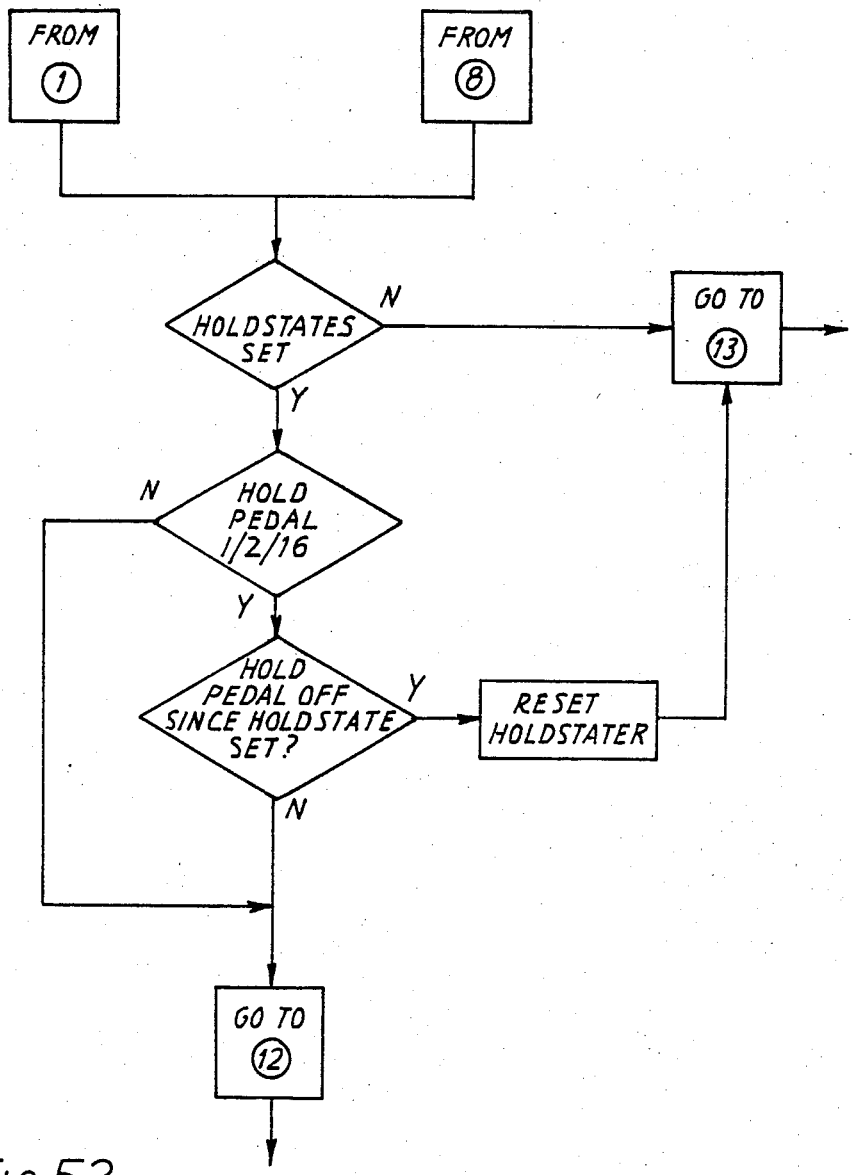

LOGIC STEP No. 11 (FIG. 53)

Step 11 may be reached via Step 1, in which case the NECK CODE is INVALID, or it may be reached va Step 8, in which case the NECK CODE is VALID (either STOPPED or OPEN), but the previous NOTE has been manually RELEASED.

In either case, these are conditions which should lead to a TRIGGER RELEASE routine (Step 16)—unless a NOTE is to be automatically HELD by the setting up of a HOLDSTATE (previous STRING CYCLES Steps 7 or 10).

HOLDSTATE NOT SET

If the HOLDSTATE is not set there is to be no automatic HOLD, and the logic is routed to the TRIGGER RELEASE routine via Step 13.

HOLDSTATE SET

If the HOLDSTATE is set, the HOLD PEDAL is tested to see if it is active.

If it is not active, the logic is routed to Step 12, thereby HOLDING the NOTE automatically.

If it is active, the logic tests to see if it has been continuously active since the HOLDSTATE was set, (hold pedal on last string cycle?), or whether this is the leading edge of a second action of the HOLD PEDAL since the HOLDSTATE was set.

If the HOLD PEDAL has been on continuously since the last HOLDSTATE was set, the NOTE is automatically HELD, and the logic is routed to Step 12.

If not, the HOLD PEDAL has been released, and pressed a second time since the setting of the HOLDSTATE, and this is one of the conditions which resets the HOLDSTATE, thereby cancelling an automatic HOLD.

In this case the logic is routed to Step 13 and then to TRIGGER RELEASE.

Figure 54:
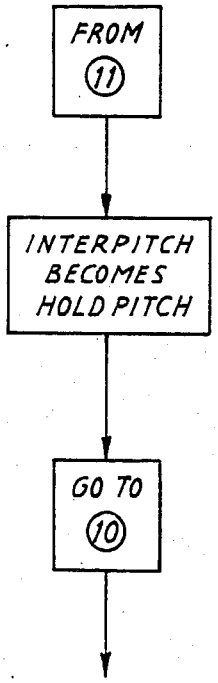

LOGIC STEP No. 12 (FIG. 54)

If the logic reaches Step 12, a NOTE is to be automatically HELD.

This Step simply takes the pitch code (HOLDPITCH) stored when the last HOLDSTATE was set (Steps 7 or 10), and transfers it to INTERPITCH as the PITCH CODE for the NOTE to be automatically HELD.

The logic is routed to Step 10 for TRIGGER HOLD.

Figure 55:
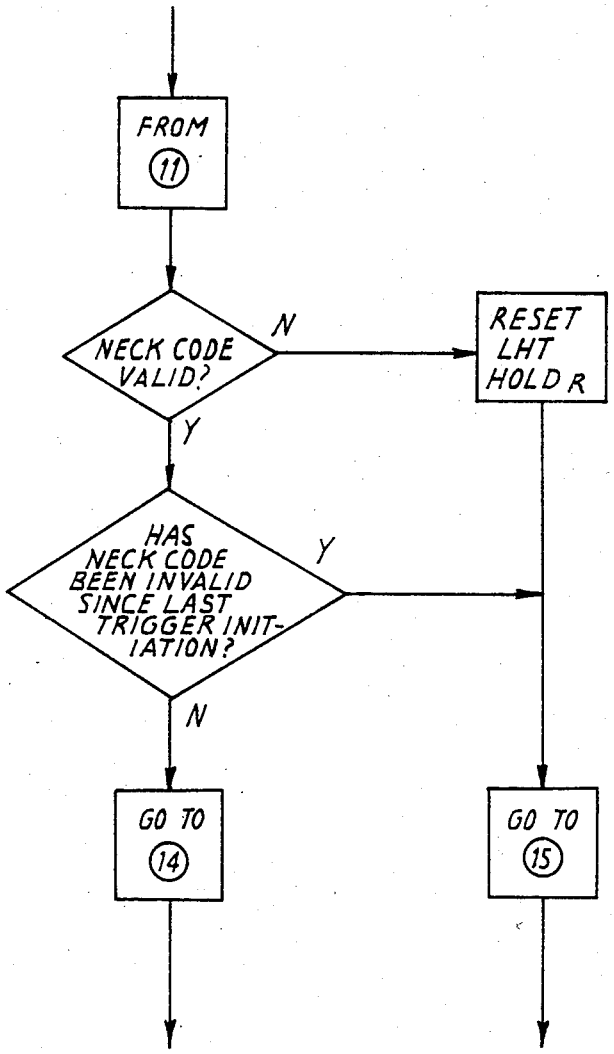

LOGIC STEP No. 13 (FIG. 55)

If the logic reaches Step 13, there are no conditions to satisfy either TRIGGER INITIATION or TRIGGER HOLD.

However, the fingerboard may be producing VALID CODES (OPEN or STOPPED), or there may be an INVALID condition.

In either case, the TRIGGER RELEASE routine (Step 16) will be performed, but what happens to the PITCH of the NOTE during RELEASE depends on Step 13.

INVALID NECK CODE

If the NECK CODE is INVALID, LHT HOLD is reset and the logic proceeds to Step 15 (HOLD PITCH during RELEASE) and Step 16 (RELEASE TRIGGER).

VALID NECK CODE

If the NECK CODE has been continuously VALID since the last NOTE was RELEASED, then the player can slide the PITCH of the NOTE around with a series of VALID CODES during the RELEASE period on the synth. In this case, the logic will be routed to Step 14 for PITCH UPDATE.

If the NECK CODE has been INVALID since the last NOTE was RELEASED, then any variations in the NECK CODE may be intermediate stages in the presetting of a new NECK CODE for the next NOTE. In this case, these variations are to be ignored. However, these variations may happen during the RELEASE period of the previous NOTE which may still be clearly audible. In this case, the PITCH CODE output to the VOICE DATA TABLE sould be that of the last VALID NECK CODE. Step 15 takes care of that.

Figure 56:
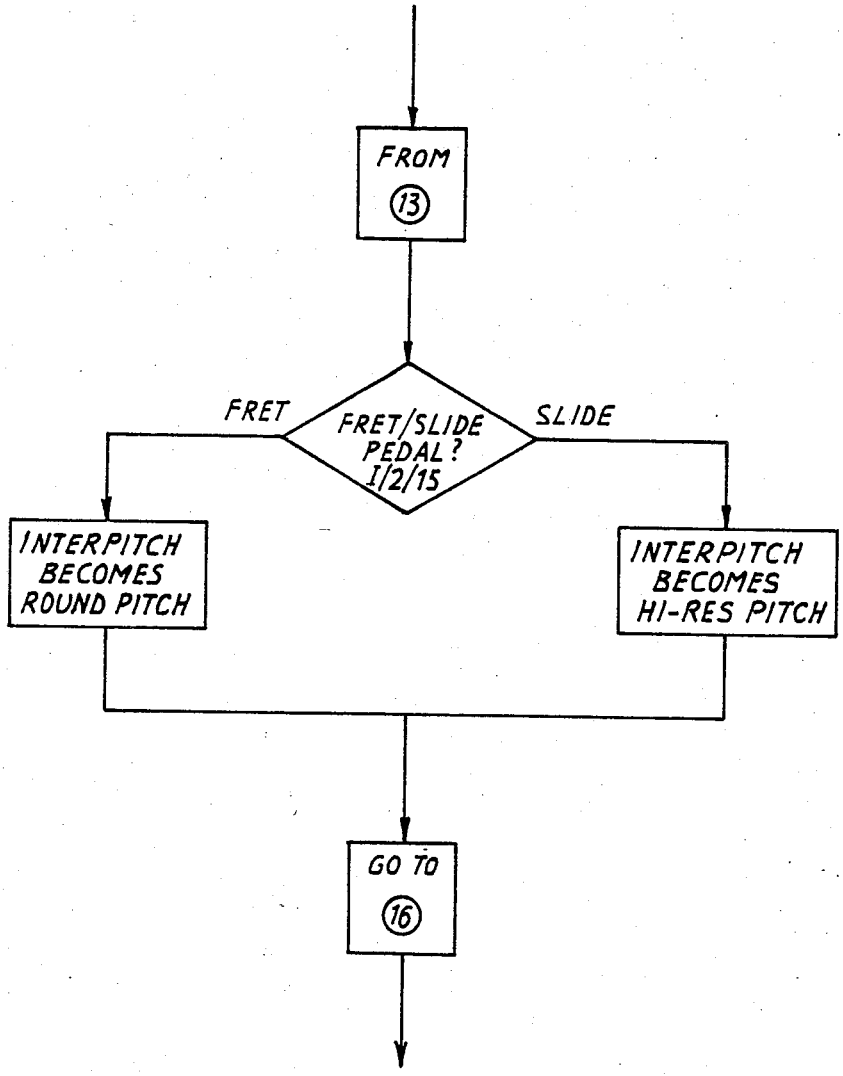

LOGIC STEP No. 14 (FIG. 56)

This step takes care of any necessary PITCH UPDATES while the player is sliding the PITCH of the NOTE during the RELEASE period.

Only the FRET/SLIDE PEDAL needs to be checked in order to see if ROUNDPITCH or HIRESPITCH should be implemented.

The logic is then routed to Step 16.

Figure 57:
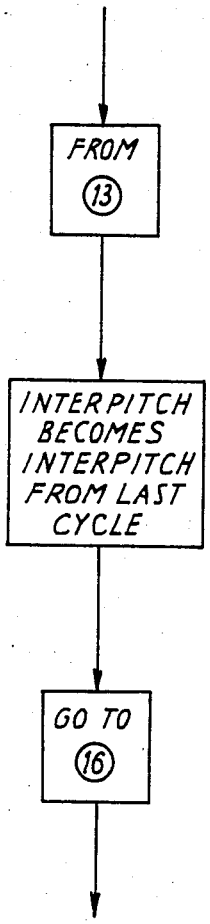

LOGIC STEP No. 15 (FIG. 57)

This Step maintains the last VALID INTERPITCH during the RELEASE of a NOTE.

It allows the player to pre-set the NECK CODE for the next NOTE without affecting the last NOTE during its RELEASE period with any spurious intermediate NECK CODES.

The logic is then routed to Step 16.

Figure 58:
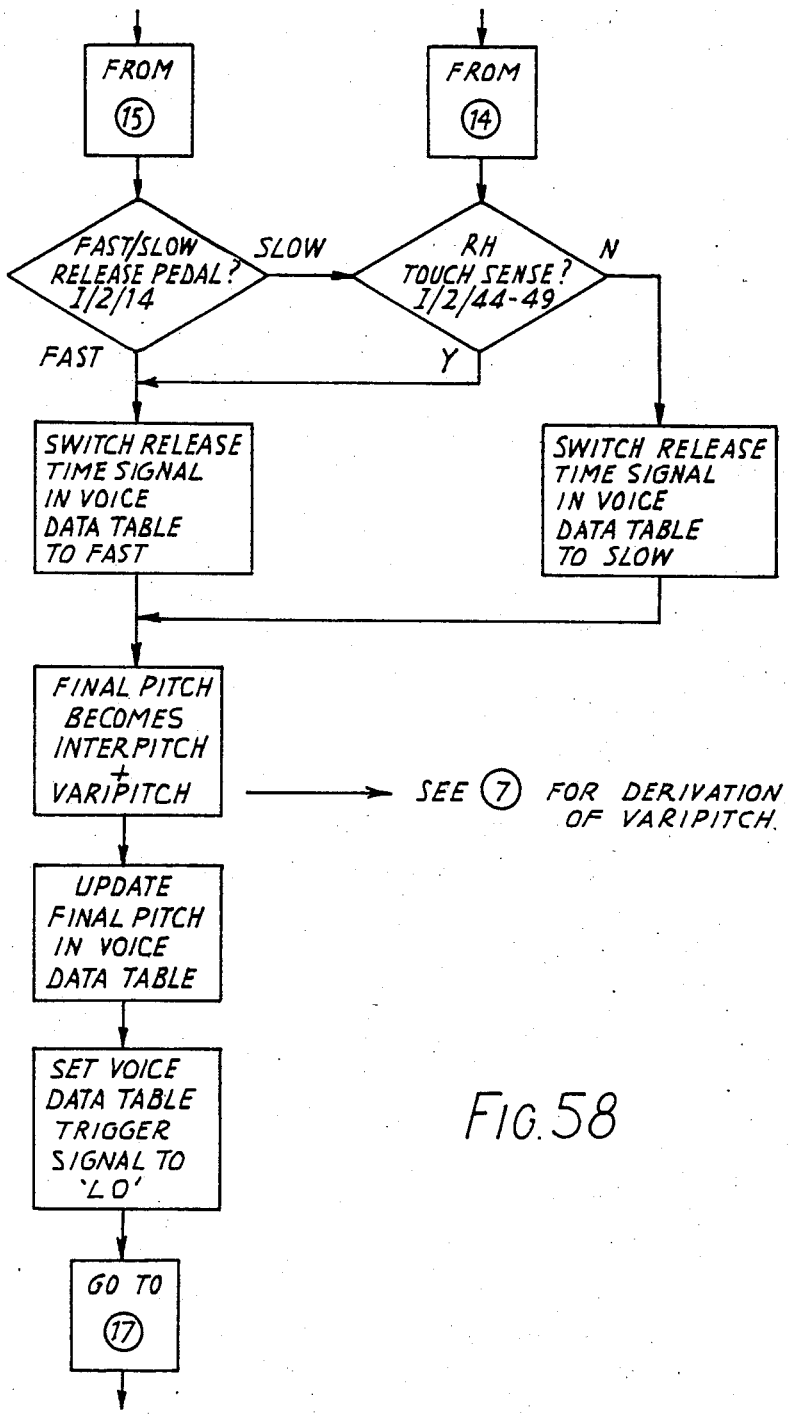

LOGIC STEP No. 16 (FIG. 58)

If Step 16 is reached via Step 15, the NECK CODE must have been INVALID since the last NOTE was INITIATED. If it is reached via Step 14 the NECK CODE must have been continuously VALID since the last NOTE was INITIATED.

An INVALID condition will lead to a FAST RELEASE unless the FAST/SLOW RELEASE PEDAL is switched to SLOW.

If it is on SLOW, the only thing that can override a SLOW RELEASE is the RIGHT HAND TOUCH SENSOR.

If the RIGHT HAND TOUCH SENSOR is active, the RELEASE characteristic is switched to FAST regardless of any other conditions.

If the NECK CODE has been continuously VALID since the RELEASE of the last NOTE, the RELEASE characteristic will be SLOW unless there is an active RIGHT HAND TOUCH SENSOR.

After deciding on RELEASE characteristics, the normal INTERPITCH+VARIPITCH=FINALPITCH routine is done. This is necessary, as even if the PITCH is to be HELD during RELEASE, variations of VIBRATO ARM, STRING BEND etc. may be wanted by the player.

FINALPITCH is output to the VOICE DATA TABLE, and then the TRIGGER signal is set to LO in the VOICE DATA TABLE.

The logic is routed to Step 17.

We claim:

1. An electronic musical instrument configured to represent a guitar-like instrument and comprising a neck and a body, in which the neck carries a plurality of pitch strings, and pitch sensing means for electrically sensing the location of depression of the strings by a player, and the body carries key-operated switches corresponding to the strings respectively for initiating notes of a pitch defined by the output of the pitch sensing means.

2. An instrument according to claim 1, in which the pitch strings make electrical contact with frets on the neck to define the selected note.

3. An instrument according to claim 1, in which the body additionally carries trigger strings, one for each pitch string respectively, which can be struck to initiate a note.

4. An instrument according to claim 1, including a master trigger switch for initiating notes in respect of all the strings simultaneously.

5. An instrument according to claim 1, including interlock means enabling simultaneous operation of some of the key-operated switches.

6. An instrument according to claim 1, including means actuable in an alternative mode of operation for automatically triggering a note in response to depression of a string.

7. An instrument according to claim 3, including means actuable in a further mode of operation for automatically triggering a note in response to depression of a string.

8. An electronic musical instrument configured to represent a guitar-like instrument and comprising a neck and a body, in which the neck carries a plurality of pitch strings and means for electrically sensing the location of depression of the strings by a player, and for automatically triggering a note in response to depression of a string, in which the body carries alternative triggering means, and switch means for selectively disabling automatic triggering.

9. An electronic musical instrument configured to represent a guitar-like instrument and comprising a plurality of strings, and touch sensor means for detecting touching of the strings by a player, in which the touch sensor means comprises a driver circuit for applying to the strings selectively a low frequency a.c. signal component together with a d.c. component, and detecting means for detecting a variation in response to either of the said components to indicate touching of the string.

10. An electronic musical instrument configured to represent a guitar-like instrument and comprising separate pitch determining means on the neck of the instrument and triggering means on the body of the instrument, in which the triggering means comprises a manually-actuable triggering member, a magnet, and a Hall effect device, the magnet being in physical connection with the triggering member such that movement of the triggering member causes the magnet to move, and the Hall effect device detects movement of the magnet to provide a trigger output signal to initiate triggering.

11. An instrument according to claim 9, including circuit means connected to the output of the Hall effect device for providing a first signal indicative of the timing of the-manual actuation of the triggering member, and a second signal indicative of the rate or amplitude of the movement of the triggering member.

12. An electronic muscial instrument configured to represent an guitar-like instrument and comprising a neck and a body, in which the neck carries a plurality of pitch strings, and including circuit means for generating electrical output signals representative of the pitches determined by the pitch strings, sensor coils in the neck for sensing forced lateral deflecton of the strings from their undeflected positions and producing an output in response thereto, and means connected to receive the output of the sensor coils to control the circuit means to vary the pitches represented by the output signals.

13. An electronic musical instrument configured to represent a guitar-like instrument and comprising a neck and a body, in which the neck carries a plurality of pitch-determining pitch strings and means for electrically sensing the location of depression of the strings by a player, and in which the body carries a vibrato arm, and includes means for generating a varying electrical output signal in dependence upon movement of the vibrato arm, and means for varying the pitch of the instrument about that set by the pitch strings in dependence on the output signal, the signal generating means comprising a Hall effect device and a magnet co-operating with the Hall effect device, the magnet being in physical connection with the vibrato arm such that movement of the triggering member causes the magnet to move, with the Hall effect device for detecting movement of the magnet to provide said electrical output signal.

14. An electronic musical instrument configured to represent a guitar and comprising a neck and a body, in which the neck carries a plurality of substantially parallel pitch strings which overlie a series of frets, and the body carries a corresponding number of substantially parallel trigger strings, and in which the two sets of strings lie at an angle to each other.

15. An instrument according to claim 14, in which the angle lies between 5 degrees and 45 degrees.

16. An electronic musical instrument configured to represent a guitar-like instrument and comprising a neck carrying a plurality of pitch strings, a plurality of parallel conductive fret means extending across the neck transversely of the pitch strings, and means connected to the pitch strings and the fret means to sense the location of depression of the strings by a player, in which each fret means comprises a plurality of sections at least equal to the number of strings forming each fret, each string being capable of lateral deflection by the player to cause pitch variation, and to contact a fret section adjacent to that which the string overlies, the sections of each fret means being coupled to a common output for that fret means through respective electrical isolating means between each section of the fret means and the common output, whereby electrical isolation between different pitch strings is maintained on forced lateral deflection of the strings.

17. An instrument according to claim 16, in which said electrical isolating means comprise diodes.

18. An electronic musical instrument configured to represent a guitar-like instrument and comprising a neck carrying a plurality of pitch strings, conductive fret means, and means connected to the pitch strings and the fret means for sensing the location of depression of the strings by a player, in which each fret means comprises a plurality of sections at least equal to the number of strings forming each fret, and in which each fret means comprises fret sections under each undeflected string and fret sections which are only contacted when a string is laterally deflected.

19. An electronic musical instrument, configured to represent a guitar-like instrument and comprising a neck carrying a plurality of pitch strings, conductive fret means, and means connected to the pitch strings and the fret means for sensing the location of depression of the strings by a player, in which each fret means comprises a plurality of sections at least equal to the number of strings forming each fret, and in which adjacent fret sections closely abut and the end faces of the sections are not parallel to the length of the strings.

20. An electronic musical instrument configured to represent a guitar-like instrument and comprising a neck carrying a plurality of pitch strings and means for electrically sensing the location of depression of the strings by a player, further comprising means for selectively individually resetting the musical value of the note which corresponds to the free undepressed strings.

21. An electronic musical instrument configured to represent a guitar-like instrument and comprising a neck carrying a plurality of pitch strings and means for electrically sensing the location of depression of the strings by a player, further comprising means for storing selected values for the free strings and for recalling selected ones of the stored values.

22. An electronic musical instrument configured to represent a guitar-like instrument and comprisng a neck carrying a plurality of pitch strings and means for electrically sensing the location of depression of the strings by a player, further comprising means for electrically simulating the effect of a capo in resetting the lowermost notes of each string to a selected lowest pitch different from the free value pitch for the string.

23. An electronic musical instrument configured to represent a guitar-like instrument and comprising a neck and a body, in which the neck carried a plurality of pitch strings and means for electrically sensing the location of depression of the strings by a player, and the body carries triggering means for initiating the selected notes, further comprising manually-operable means for selectively varying the decay rate of the selected notes, said instrument further including touch sensor means for sensing when the strings are touched by a player, and for switching between preselected decay rates.

* * * * *

UNITED STATES PATENT AND TRADEMARK OFFICE

CERTIFICATE OF CORRECTION

PATENT NO. : 4,658,690

DATED : April 21, 1987

INVENTOR(S) : Aitken et al

It is certified that error appears in the above-identified patent and that said Letters Patent is hereby corrected as shown below:

Col. 44, line 55, "claim 9" should be -- claim 10 --.

Col. 44, line 58, "the-manual" should be -- the manual --.

Col. 46, line 44, "carries" should be -- carried --.

Signed and Sealed this

Tenth Day of November, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,658,690

DATED : April 21, 1987

INVENTOR(S) : Aitken et al.

It is certified that error appears in the above-identified patent and that said Letters Patent is hereby corrected as shown below:

Col. 44, line 55, "claim 9" should be -- claim 10--.

Col. 44, line 58, "the-manual" should be -- the manual --.

Col. 46, line 44, "carried" should be -- carries --.

This Certificate supersedes certificate of correction issued November 10, 1987.

Signed and Sealed this

Fourteenth Day of June, 1988

*Attest:*

*Attesting Officer*

DONALD J. QUIGG

*Commissioner of Patents and Trademarks*